US009476669B2

(12) United States Patent
Masse

(10) Patent No.: US 9,476,669 B2
(45) Date of Patent: Oct. 25, 2016

(54) COMPRESSED GAS GUN

(71) Applicant: KEE Action Sports I LLC, Sewell, NJ (US)

(72) Inventor: Robert K. Masse, Redmond, WA (US)

(73) Assignee: GI Sportz Direct LLC, Sewell, NJ (US)

( * ) Notice: Subject to any disclaimer, the term of this patent is extended or adjusted under 35 U.S.C. 154(b) by 0 days.

(21) Appl. No.: 14/293,618

(22) Filed: Jun. 2, 2014

(65) Prior Publication Data

US 2015/0059725 A1 Mar. 5, 2015

Related U.S. Application Data

(63) Continuation of application No. 13/488,067, filed on Jun. 4, 2012, now Pat. No. 8,739,770, which is a continuation of application No. 11/747,107, filed on May 10, 2007, now Pat. No. 8,336,532, which is a continuation-in-part of application No. 11/654,721, filed on Jan. 18, 2007, now Pat. No. 8,191,543, and a continuation of application No. 10/656,307, filed on Sep. 5, 2003, now Pat. No. 7,237,545, said application No. 11/654,721 is a continuation of application No. 10/656,307, filed on Sep. 5, 2003, now Pat. No. 7,237,545, which is a continuation-in-part of application No. 10/090,810, filed on Mar. 6, 2002, now Pat. No. 6,708,685.

(51) Int. Cl.

| | |
|---|---|
| ***F41B 11/00*** | (2013.01) |
| ***F41B 11/72*** | (2013.01) |
| ***F41B 11/57*** | (2013.01) |
| ***F41B 11/723*** | (2013.01) |
| ***F41B 11/73*** | (2013.01) |
| ***F41B 11/721*** | (2013.01) |

(52) U.S. Cl.
CPC ..... *F41B 11/72* (2013.01); *F41B 11/57* (2013.01); *F41B 11/721* (2013.01); *F41B 11/723* (2013.01); *F41B 11/73* (2013.01)

(58) Field of Classification Search
USPC ..... 124/71–77
See application file for complete search history.

(56) References Cited

U.S. PATENT DOCUMENTS

| | | | |
|---|---|---|---|
| 495,767 | A | 4/1893 | Winans |
| 645,932 | A | 3/1900 | Beck et al. |
| 1,116,675 | A | 11/1914 | Cook |
| 1,441,975 | A | 1/1923 | Edelin |
| 2,116,860 | A | 5/1938 | Blaylock et al. |
| 2,123,324 | A | 7/1938 | Webby |
| 2,147,003 | A | 2/1939 | Kozurik |

(Continued)

FOREIGN PATENT DOCUMENTS

| | | |
|---|---|---|
| EP | 0772022 A1 | 5/1997 |
| GB | 570178 | 6/1945 |

(Continued)

OTHER PUBLICATIONS

Dye Precision, Inc., "Proto Rail"—Rail Owner's Manual, copyright 2011 (32 pages).

(Continued)

*Primary Examiner* — Michael David
(74) *Attorney, Agent, or Firm* — Volpe and Koenig, P.C.

(57) ABSTRACT

A compressed gas gun is provided, having a body. A firing mechanism may be received within the body and may comprise a bolt and valve arranged in-line along a longitudinal axis of the compressed gas gun body. Externally accessible velocity adjustment mechanisms may be provided. A removable end cap may be engaged to a rearward end of the body. A control circuit may be provided in communication with a pressure sensor.

8 Claims, 44 Drawing Sheets

(56) References Cited

U.S. PATENT DOCUMENTS

| | | | | |
|---|---|---|---|---|
| 2,252,754 | A | 8/1941 | Browning | |
| 2,357,951 | A | 9/1944 | Hale | |
| 2,568,432 | A | 9/1951 | Cook | |
| 2,594,240 | A | 4/1952 | Wells | |
| 2,618,254 | A | 11/1952 | Wells | |
| 2,809,624 | A | 10/1957 | Becher et al. | |
| 2,817,328 | A | 12/1957 | Gale | |
| 2,881,752 | A | 4/1959 | Blahnik | |
| 3,000,371 | A | 9/1961 | Hyde | |
| 3,204,625 | A | 9/1965 | Shepherd | |
| 3,308,803 | A | 3/1967 | Walther | |
| 3,333,508 | A | 8/1967 | Kruzell | |
| 3,342,171 | A | 9/1967 | Ryan et al. | |
| 3,420,220 | A | 1/1969 | Ferrando | |
| 3,465,742 | A | 9/1969 | Herr | |
| 3,572,310 | A | 3/1971 | Chiba | |
| 3,612,026 | A | 10/1971 | Vadas et al. | |
| 3,653,538 | A | 4/1972 | Lamar | |
| 3,675,534 | A | 7/1972 | Beretta | |
| 3,741,189 | A | 6/1973 | Kester et al. | |
| 3,765,396 | A | 10/1973 | Kienholz et al. | |
| 3,788,298 | A | 1/1974 | Hale | |
| 3,951,038 | A | 4/1976 | Van Langenhoven | |
| 4,004,566 | A | 1/1977 | Fischer | |
| 4,083,349 | A | 4/1978 | Clifford | |
| 4,148,245 | A | 4/1979 | Steffanus et al. | |
| 4,362,145 | A | 12/1982 | Stelcher | |
| 4,531,503 | A | 7/1985 | Shepherd | |
| 4,616,622 | A | 10/1986 | Milliman | |
| 4,770,153 | A | 9/1988 | Edelman | |
| 4,819,609 | A | 4/1989 | Tippmann | |
| 4,819,610 | A | 4/1989 | Lacam et al. | |
| 4,850,330 | A | 7/1989 | Nagayoshi | |
| 4,899,717 | A | 2/1990 | Rutten et al. | |
| 4,936,282 | A | 6/1990 | Dobbins et al. | |
| 4,951,644 | A | 8/1990 | Bon | |
| 5,063,905 | A | 11/1991 | Farrell | |
| 5,078,118 | A | 1/1992 | Perrone | |
| 5,230,324 | A | 7/1993 | Van Horssen et al. | |
| 5,257,614 | A | 11/1993 | Sullivan | |
| 5,280,778 | A | 1/1994 | Kotsiopoulos | |
| 5,299,813 | A | 4/1994 | McKenna | |
| 5,333,594 | A | 8/1994 | Robinson | |
| 5,337,726 | A | 8/1994 | Wood | |
| 5,339,791 | A | 8/1994 | Sullivan | |
| 5,349,938 | A | 9/1994 | Farrell | |
| 5,349,939 | A | 9/1994 | Perrone | |
| 5,383,442 | A | 1/1995 | Tippmann | |
| 5,429,108 | A | 7/1995 | Hsieh | |
| 5,462,042 | A | 10/1995 | Greenwell | |
| 5,477,843 | A | 12/1995 | Kunimoto | |
| 5,494,024 | A | 2/1996 | Scott | |
| 5,497,758 | A | 3/1996 | Dobbins et al. | |
| 5,515,838 | A | 5/1996 | Anderson | |
| 5,572,982 | A | 11/1996 | Williams | |
| 5,613,483 | A | 3/1997 | Lukas et al. | |
| 5,634,456 | A | 6/1997 | Perrone | |
| 5,646,910 | A | 7/1997 | Bouyoucos | |
| 5,669,369 | A | 9/1997 | Scott | |
| 5,704,342 | A | 1/1998 | Gibson et al. | |
| 5,727,538 | A | 3/1998 | Ellis | |
| 5,769,066 | A | 6/1998 | Schneider | |
| 5,771,875 | A | 6/1998 | Sullivan | |
| 5,778,868 | A | 7/1998 | Shepherd | |
| 5,796,066 | A | 8/1998 | Guyot | |
| 5,881,707 | A | 3/1999 | Gardner, Jr. | |
| 5,904,133 | A | 5/1999 | Alexander et al. | |
| 5,908,024 | A | 6/1999 | Staev | |
| 5,913,303 | A | 6/1999 | Kotsiopoulos | |
| 5,924,413 | A * | 7/1999 | Johnson et al. | 124/72 |
| 5,957,119 | A * | 9/1999 | Perry et al. | 124/73 |
| 5,967,133 | A | 10/1999 | Gardner, Jr. | |
| 6,003,504 | A | 12/1999 | Rice et al. | |
| 6,003,547 | A | 12/1999 | Tippmann, Jr. | |
| 6,024,077 | A | 2/2000 | Kotsiopoulos | |
| 6,035,843 | A | 3/2000 | Smith et al. | |
| 6,065,460 | A | 5/2000 | Lotuaco, III | |
| 6,125,834 | A | 10/2000 | Ciccarelli et al. | |
| 6,138,656 | A | 10/2000 | Rice et al. | |
| 6,158,424 | A | 12/2000 | Kunimoto | |
| 6,276,354 | B1 | 8/2001 | Dillon | |
| 6,311,682 | B1 | 11/2001 | Rice et al. | |
| 6,343,599 | B1 | 2/2002 | Perrone | |
| 6,349,711 | B1 | 2/2002 | Perry et al. | |
| 6,474,326 | B1 | 11/2002 | Smith et al. | |
| 6,520,171 | B2 | 2/2003 | Reible | |
| 6,550,468 | B1 | 4/2003 | Tippmann, Jr. | |
| 6,557,542 | B1 | 5/2003 | Orr | |
| 6,561,176 | B1 | 5/2003 | Fujimoto et al. | |
| 6,564,788 | B1 | 5/2003 | Hu | |
| 6,601,780 | B1 | 8/2003 | Sheng | |
| 6,637,421 | B2 | 10/2003 | Smith et al. | |
| 6,644,295 | B2 | 11/2003 | Jones | |
| 6,708,685 | B2 * | 3/2004 | Masse | 124/75 |
| 6,986,343 | B2 | 1/2006 | Carnall et al. | |
| 7,044,119 | B2 | 5/2006 | Jones | |
| 7,185,646 | B2 | 3/2007 | Jones | |
| 7,210,473 | B2 | 5/2007 | Jong | |
| 7,237,545 | B2 * | 7/2007 | Masse | 124/75 |
| 7,398,777 | B2 | 7/2008 | Carnall et al. | |
| 7,461,646 | B2 | 12/2008 | Jones | |
| 7,533,664 | B2 | 5/2009 | Carnall | |
| 7,556,032 | B2 | 7/2009 | Jones et al. | |
| 7,591,262 | B2 | 9/2009 | Jones et al. | |
| 7,617,819 | B2 | 11/2009 | Jones | |
| 7,617,820 | B2 | 11/2009 | Jones | |
| 7,624,723 | B2 | 12/2009 | Gardner, Jr. et al. | |
| 7,640,925 | B2 | 1/2010 | Jones | |
| 7,640,926 | B2 | 1/2010 | Jones | |
| 7,686,005 | B2 | 3/2010 | Adams | |
| 7,886,731 | B2 * | 2/2011 | Masse | 124/73 |
| 8,191,543 | B2 | 6/2012 | Masse | |
| 8,336,532 | B2 * | 12/2012 | Masse | 124/75 |
| 8,413,644 | B2 * | 4/2013 | Masse | 124/76 |
| 8,505,525 | B2 * | 8/2013 | Dobbins et al. | 124/71 |
| 8,739,770 | B2 | 6/2014 | Masse | |
| 2001/0042543 | A1 * | 11/2001 | Perrone | 124/77 |
| 2002/0088449 | A1 | 7/2002 | Perrone | |
| 2002/0096164 | A1 | 7/2002 | Perrone | |
| 2002/0170551 | A1 | 11/2002 | Kotsiopoulos et al. | |
| 2003/0024520 | A1 | 2/2003 | Dobbins | |
| 2003/0024521 | A1 | 2/2003 | Smith et al. | |
| 2003/0047174 | A1 | 3/2003 | Tiberius et al. | |
| 2003/0047175 | A1 | 3/2003 | Farrell | |
| 2003/0079731 | A1 | 5/2003 | Dobbins | |
| 2003/0226555 | A1 | 12/2003 | Reible | |
| 2004/0255923 | A1 | 12/2004 | Carnall et al. | |
| 2005/0115551 | A1 | 6/2005 | Carnall et al. | |
| 2005/0121014 | A1 | 6/2005 | Monks et al. | |
| 2005/0194558 | A1 | 9/2005 | Carnall et al. | |
| 2005/0235976 | A1 | 10/2005 | Carnall | |
| 2006/0011186 | A1 | 1/2006 | Jones et al. | |
| 2006/0011187 | A1 | 1/2006 | Gardner et al. | |
| 2006/0011188 | A1 | 1/2006 | Jones | |
| 2006/0090739 | A1 | 5/2006 | Jones | |
| 2006/0157043 | A1 | 7/2006 | Jones | |
| 2006/0162715 | A1 * | 7/2006 | Jones | 124/74 |
| 2006/0207586 | A1 | 9/2006 | Jones | |
| 2006/0207587 | A1 | 9/2006 | Jones et al. | |
| 2007/0068502 | A1 | 3/2007 | Jones et al. | |
| 2007/0186916 | A1 | 8/2007 | Jones | |
| 2007/0209649 | A1 | 9/2007 | Jones | |
| 2007/0209650 | A1 | 9/2007 | Jones | |
| 2009/0032003 | A1 | 2/2009 | Masse | |
| 2010/0154767 | A1 | 6/2010 | Masse | |
| 2013/0092141 | A1 * | 4/2013 | Masse | 124/77 |

FOREIGN PATENT DOCUMENTS

| | | |
|---|---|---|
| GB | 614740 | 12/1948 |
| GB | 1223675 | 3/1971 |
| GB | 2193797 | 2/1988 |
| GB | 2198818 | 6/1988 |
| GB | 2228067 | 8/1990 |

(56) References Cited

FOREIGN PATENT DOCUMENTS

| | | | |
|---|---|---|---|
| GB | 2258913 | A | 2/1993 |
| GB | 2313655 | A | 12/1997 |
| JP | 01-285798 | | 11/1989 |
| JP | 07-004892 | | 1/1995 |
| JP | 11-173792 | | 7/1999 |
| WO | 88/05895 | A1 | 8/1988 |
| WO | 98/13660 | A1 | 4/1998 |
| WO | 00/75594 | A1 | 12/2000 |

OTHER PUBLICATIONS

Dye Precision, Inc., "Proto Reflex Rail"—Reflex Rail Owner's Manual, copyright 2011 (32 pages).
Dye Precision, Inc., "NT11"—NT11 Owner's Manual, copyright 2011 (22 pages).
Dye Precision, Inc., "2013 DM Series"—2013 DM Series Owner's Manual, copyright 2012 (20 pages).
Mac Developments Pty. Ltd., "Drone DX"—Drone DX Model Owners Manual V1.00, copyright Dec. 2011, (14 pages).
Mac Developments Pty. Ltd., "Clone GT"—Clone GT Model Owners Manual V1.00, copyright 2012, (14 pages).
SuperNova from Air Star Owners Manual.
WARPIG—World and Regional Paintball Information Guide http:/ www.warpig.com/paintball/technical/paintguns/nova/novafaq.
shtml Air Star Nova FAQ Copyright 1999 by Bill Mills (5 pages).
Action Pursuit Games, Jan. 2001, pp. 86-92, Inside Air Star's SUPERNOVA ET by James R. "Mad Dog" Morgan, Sr.
Paintball Magazine, Feb. 2000, pp. 33-36, Staff Report E.T. Super Nova.
Paintball 2-Xtremes Magazine, Sep. 1999, pp. 30 and 94-95, Product Profile Air Star's SUPERNOVA E.T.
Paintball 2-Xtremes Magazine, Sep. 1999 (vol. 5 No. 9) Super Nova ET: Airstar Joins Electronics Race (5 pages).
Assault 80 Manual by War Machine, Inc., Copyright 2004 (8 pages).
MATRIX Owner's Manual by Dye Precision, Inc., Copyright 2003 (9 pages).
World and Regional Paintball Information Guide (WARPIG) AirTech, Jun. 2001 by Bill Mills (10 pages).
World and Regional Paintball Information Guide (WARPIG) Air Star Super Nova ET by Bill Mills, Copyright 1992-2006 (6 pages).
AirTech Matrix Operators Manual, undated (6 pages).

* cited by examiner

Side Sectional View

Side Sectional View

Side Sectional View

Side Sectional View

Rear Sectional View

Rear Sectional View

Front Sectional View

Rear Sectional View

Rear Sectional View

Top Sectional View

COMPRESSED GAS GUN

CROSS REFERENCE TO RELATED APPLICATIONS

This application is a continuation of U.S. patent application Ser. No. 13/488,067, filed Jun. 4, 2012, issuing as U.S. Pat. No. 8,739,770 on Jun. 3, 2014, which is a continuation of U.S. patent application Ser. No. 11/747,107, filed May 10, 2007, now U.S. Pat. No. 8,336,532 issued Dec. 25, 2012 and a continuation of U.S. patent application Ser. No. 11/654,721, filed Jan. 18, 2007, now U.S. Pat. No. 8,191,543 issued Jun. 5, 2012, both of which are continuations of U.S. patent application Ser. No. 10/656,307, filed Sep. 5, 2003, now U.S. Pat. No. 7,237,545, issued Jul. 3, 2007, which is a continuation-in-part of U.S. patent application Ser. No. 10/090,810, filed Mar. 6, 2002, now U.S. Pat. No. 6,708,685, issued Mar. 23, 2004, the entire contents of all of which are incorporated by reference as if fully set forth herein.

FIELD OF INVENTION

This invention relates, in general, to compressed gas-powered projectile accelerators, generally known as "air-guns," irrespective of the type of the projectile, gas employed, scale, or purpose of the device.

BACKGROUND

Compressed gas-powered projectile accelerators have been used extensively to propel a wide variety of projectiles. Typical applications include weaponry, hunting, target shooting, and recreational (non-lethal) combat. In recent years, a large degree of development and invention has centered around recreational combat, where air-guns are employed to launch non-lethal projectiles which simply mark, rather than significantly injure or damage the target. Between launching projectiles such air-guns are generally loaded and reset to fire when the trigger is pulled, generally referred to as "re-cocking" either by an additional manual action by the operator, or pneumatically, as part of each projectile-accelerating event or "cycle." These devices may be divided into two categories—those that are "non-regulated" or "inertially-regulated," and those that are "statically-regulated."

Non-regulated or inertially-regulated air-guns direct gas from a single storage reservoir, or set of reservoirs that are continuously connected without provision to maintain a static (zero-gas flow) pressure differential between them, to accelerate a projectile through and out of a tube or "barrel." The projectile velocity is typically controlled by mechanically or pneumatically controlling the open time of a valve isolating the source gas, which is determined by the inertia and typically spring force exerted on moving parts. Examples of manually re-cocked non-regulated or inertially-regulated projectile accelerators are the inventions of Perrone, U.S. Pat. No. 5,078,118; and Tippmann, U.S. Pat. No. 5,383,442. Examples of pneumatically re-cocked non-regulated or inertially-regulated projectile accelerators (this type of projectile accelerator being the most commonly used in recreational combat) are the inventions of Tippmann, U.S. Pat. No. 4,819,609; Sullivan, U.S. Pat. No. 5,257,614; Perrone, U.S. Pat. Nos. 5,349,939 and 5,634,456; and Dobbins et al., U.S. Pat. No. 5,497,758.

Statically-regulated air-guns transfer gas from a storage reservoir to an intermediate reservoir, through a valve which regulates pressure within the intermediate reservoir to a controlled design level, or "set pressure," providing sufficient gas remains within the storage reservoir with pressure in excess of the intermediate reservoir set pressure. This type of air-gun directs the controlled quantity of gas within said intermediate reservoir in such a way as to accelerate a projectile through and out of a barrel. Thus, for purposes of discussion, the operating sequence or "projectile accelerating cycle" or "cycle" can be divided into a first step where said intermediate reservoir automatically fills to the set pressure, and a second step, initiated by the operator, where the gas from said intermediate reservoir is directed to accelerate a projectile. The projectile velocity is typically controlled by controlling the intermediate reservoir set pressure. Examples of statically regulated projectile accelerators are the inventions of Milliman, U.S. Pat. No. 4,616,622.

More recently, electronics have been employed in both non-regulated and statically regulated air-guns to control actuation, timing and projectile velocity. Examples of electronic projectile accelerators are the inventions of Rice et al., U.S. Pat. No. 6,003,504; and Lotuaco, III, U.S. Pat. No. 6,065,460.

Problems with compressed gas powered guns known to be in the art, relating to maintenance, complexity, and reliability, are illustrated by the following partial list:

Sensitivity to liquid $CO_2$—The most common gas employed by air-guns is $CO_2$, which is typically stored in a mixed gas/liquid state. However, inadvertent feed of liquid $CO_2$ into the air-gun commonly causes malfunction in both non-regulated or inertially regulated air-guns and, particularly, statically-regulated air-guns, due to adverse effects of liquid $CO_2$ on valve and regulator seat materials. Cold weather exacerbates this problem, in that the saturated vapor pressure of $CO_2$ is lower at reduced temperatures, necessitating higher gas volume flows. Additionally, the dependency of the saturated vapor pressure of $CO_2$ on temperature results in the need for non-regulated or inertially regulated air-guns to be adjusted to compensate for changes in the temperature of the source gas, which would otherwise alter the velocity to which projectiles are accelerated.

Difficulty of disassembly—In many air-guns known to be in the art, interaction of the bolt with other mechanical components of the device complicates removal of the bolt, which is commonly required as part of cleaning and routine maintenance.

Double feeding—air-guns known to be in the art typically hold a projectile at the rear of the barrel between projectile accelerating cycles. In cases where the projectile is round, a special provision is required to prevent the projectile from prematurely rolling down the barrel. Typically, a lightly spring biased retention device is situated so as to obstruct passage of the projectile unless the projectile is thrust with enough force to overcome the spring bias and push the retention device out of the path of the projectile for sufficient duration for the projectile to pass. Alternatively, in some cases close tolerance fits between the projectile caliber and barrel bore are employed to frictionally prevent premature forward motion of the projectile. However, rapid acceleration of the air-gun associated with movement of the operator is often of sufficient force to overcome the spring bias of retention device, allowing the projectile to move forward, in turn allowing a second projectile to enter the barrel. When the air-gun is subsequently operated, either both projectiles are accelerated, but to lower velocity than would be for a single projectile, or, for fragile projectiles, one or both of the projectiles will fracture within the barrel.

Bleed up of pressure—Statically-regulated air-guns require a regulated seal between the source reservoir and intermediate reservoir which closes communication of gas between said reservoirs when the set pressure is reached. Because this typically leads to small closing force margins on the sealing surface, said seal commonly slowly leaks, causing the pressure within the intermediate reservoir to slowly increase or "bleed up" beyond the intended set pressure. When the air-gun is actuated, this causes the projectile to be accelerated to higher than the intended speed, which, with respect to recreational combat, endangers players.

Not practical for fully-automatic operation—Air-guns which have an automatic re-cock mechanism can potentially be designed so as accelerate a single projectile per actuation of the trigger, known as "semi-automatic" operation, or so that multiple projectiles are fired in succession when the trigger is actuated, known as "fully-automatic" operation. (Typically air-guns that are designed for fully-automatic operation are designed such that semi-automatic operation is also possible.) Most air-guns known to be in the art are conceptually unsuitable for fully-automatic operation in that there is no automated provision for the timing between cycles required for the feed of a new projectile into the barrel, this function being dependent upon the inability of the operator to actuate the trigger in excess of the rate at which new projectiles enter the barrel when operated semi-automatically. Air-guns known to be in the art which are capable of fully-automatic operation typically accommodate this timing either by inertial means, using the mass-induced resistance to motion of moving components, or by electronic means, where timing is accomplished by electric actuators operated by a control circuit, both methods adding considerable complexity.

Difficult manufacturability—Many air-guns known to be in the art, particularly those designed for fully automatic operation, are complex, requiring a large number of parts and typically the addition of electronic components.

Stiff or operator sensitive trigger pull—The trigger action of many non-electronic air-guns known to be in the art initiates the projectile accelerating cycle by releasing a latch obstructing the motion of a spring biased component. In many cases, since the spring bias must be quite strong to properly govern the projectile acceleration, the friction associated with the release of this latch results in an undesirably stiff trigger action. Additionally, this high friction contact results in wear of rubbing surfaces. Alternatively, in some cases, to reduce mechanical complexity and circumvent this problem, the trigger is designed such that its correct function is dependent upon the technique applied by the operator, resulting in malfunction if the operator only partially pulls the trigger through a minimum stroke.

High wear on striking parts—In many air-guns known to be in the art, particularly those designed for semi-automatic or fully-automatic operation, the travel of some of the moving parts is limited by relatively hard impact with a bumper. Additionally, in many cases, a valve is actuated by relatively hard impact from a slider. The components into which the impact energy is dissipated exhibit increased rates of wear. Further, wear of high impact surfaces in the conceptual design of many air-guns known to be in the art make them particularly un-adaptable to fully-automatic operation.

Contamination—Many of the air-guns known to be in the art require a perforation in the housing to accommodate the attachment of a lever or knob to allow the operator to perform a necessary manipulation of the internal components into a ready-to-fire configuration, generally known as "cocking." This perforation represents an entry point for dust, debris, and other contamination, which may interfere with operation.

In another aspect of the present invention, in lieu of direct connection of the valve passage and the chamber, the valve and chamber can be connected indirectly by being both connected to a distribution bus, or gas distribution passage, parallel to the bolt bore and valve passage, which simultaneous allows much greater flexibility of the overall configuration while providing a simple means of distributing gas to other functions such as allowing a simple interface with a passage directing gas to a jet that assists in the introduction of projectiles into the barrel. Additionally, this gas distribution passage provides a simple means of controlling flow to the jet by facilitating the incorporation of a throttling screw at the intersection with the passage communicating gas to the jet.

In another embodiment of the present invention, a valve locking feature is provided, whereby force is applied to hold the valve open during the filling of the intermediate reservoir, and then releases the valve body thereafter, reducing the amount of gas pressure required to hold the valve closed during completion of the projectile acceleration cycle. Additionally, because the valve opening force is supplemented by the locking force, the valve spring can be of light design, resulting in an ultra-light trigger pull. In addition, the valve slider diameter can be increased without increasing the spring force acting on the valve slider (with which, through friction, the trigger force scales), thereby allowing the use of larger, more robust seals. Both pneumatic and mechanical techniques to accomplish valve locking are herein described, which can be implemented individually or in combination.

It is desirable in many applications to minimize the length of projectile accelerator barrels. In another embodiment of the present invention, the bolt and breech are designed to allow the replacement a bumper with a stationary (not moving with the bolt) combined bumper and seal, thereby eliminating the need for the front bolt seal and allowing the shortening of the bolt and passage in which it slides, and thereby the overall device, by the length along which the seal slides. When not in operation, with no pressure applied within the chamber formed ahead of the step in the bolt diameter and corresponding step in the breech bore, the pressure of the bolt resting against the combined seal and bumper under the force of the bolt spring will maintain a ready seal between the bolt and breech, which will be sustained during operation as the pressure applied by the bolt is replaced by gas pressure, as the bolt moves rearward, sliding within the combined bumper and seal.

In many applications it is desirable for the first projectile to be fired as quickly as possible following a pull of the trigger, to minimize time for accidental perturbation of aiming and movement of the target during the time for the compressed gas-powered projectile accelerator action to be complete. Thus, it will be advantageous to have the capability to adjust the first cycle to be faster than subsequent cycles. A method to accomplish these is herein detailed, where a second throttling point at the upstream end of a chamber, in turn upstream of the flow control throttling screw, can be used to allow gas accumulated between cycles within the chamber to fill the intermediate chamber faster on the first cycle than subsequent cycles.

The present application provides several methods for the incorporation of a cocking mechanism into the compressed gas-powered projectile accelerator described therein. A novel approach, described herein, embodies a complete cocking system within a plug closing the rear of the valve bore, thereby allowing the cocking capability to contained as a discreet, self-contained module. Further, one embodiment disclosed herein comprises a single piece valve slider comprising of a rear section incorporating the gas seals of the valve and a front portion providing an open cavity partially containing the valve spring and a step by which the sear can latch the valve slider in a non-operating position between cycle. A modification to the valve to include a counter spring can, however, allow the valve slider to be divided into two separate pieces, one acting solely as a valve, and the other containing the velocity control spring and interacting with the sear. So doing simplifies manufacture, and allows the valve to be constructed as a separate module from the remainder of the housing, which is advantageous in allowing a wider range of materials (some of which being unsuitable for use on a larger section of the housing due to weight, but having desirable qualities for use on the valve housing).

One embodiment disclosed herein describes a "dynamically-regulated" compressed gas-powered projectile accelerator which fills an intermediate reservoir as an integral part of, and at the beginning of, each projectile accelerating cycle. The cycle is initiated by the operator, preferably by the action of a trigger, which causes the filling of the intermediate reservoir by compressed gas. The second step of the cycle where the projectile is accelerated is then automatically activated when the pressure reaches a design threshold. In so doing, the filling of the intermediate reservoir may be used not only to regulate the projectile velocity, but the time of each cycle, providing numerous advantages.

In one embodiment, a gas communicated into a chamber that applies pressure to the valve body (therein denoted the "valve slider") closes the valve when a design pressure reaches a sufficient level to overcome a spring biasing the valve to open. During venting of the gas into the barrel to accelerate the projectile, however, the device relies partially on the bolt inertia and pressure drop through the gas flow path into the barrel (through a hole or slot connecting to the breech and through the hollow bolt) to hold the valve closed until the firing cycle is complete, and an optional throttling screw is described to enable tuning of a flow restriction governing this pressure drop. This causes some loss of efficiency, in preventing full use of the gas to accelerate the projectile. While use of a stiff bolt spring can minimize the dependence upon the bolt inertia and flow frictional losses to hold the valve closed during venting, the added loading subjects adjoining components to additional wear.

Alternatively, dependence upon the bolt inertia and flow losses to hold the valve closed during venting can be avoided by the addition of a valve locking feature, which first applies force to hold the valve open during the filling of the intermediate reservoir, and then releases the valve body thereafter, reducing the amount of gas pressure required to hold the valve closed during completion of the projectile acceleration cycle. Additionally, because the valve opening force is now supplemented by the locking force, the valve spring can be of arbitrarily low stiffness, resulting in an ultra-light trigger pull. Further, the valve slider diameter can be increased without increasing the spring force acting on the valve slider (with which, through friction, the trigger force scales), thereby allowing the use of larger, more robust seals. Both pneumatic and mechanical techniques to accomplish valve locking are herein described, implementable individually or in combination.

In many applications it is desirable for the first projectile to be fired as quickly as possible following a pull of the trigger, to minimize time for accidental perturbation of aiming and movement of the target during the time for the compressed gas-powered projectile accelerator action to complete. A means for adjusting the cycle to a relatively slow rate, and, for adjusting the first cycle to be faster than subsequent cycles is herein detailed, where a second throttling point at the upstream end of a chamber, in turn upstream of the flow control throttling screw of the compressed gas-powered projectile accelerator, can be used to allow gas accumulated between cycles within the chamber to fill the intermediate chamber faster on the first cycle than subsequent cycles.

A unique cocking means is disclosed herein, embodying a complete cocking system within a plug closing the rear of the valve bore, thereby allowing the cocking capability to be added or removed as a discreet, self-contained module.

SUMMARY

While some compressed gas-powered projectile accelerators known in the art circumvent some of the above listed problems, all of these and other problems are mitigated or eliminated by the compressed gas-powered projectile accelerator of the present invention. The compressed gas-powered projectile accelerator of the present invention employs a "dynamically-regulated" cycle to avoid the problems associated with both non-regulated or inertially regulated air-guns and statically-regulated air-guns.

The term "dynamically regulated" refers to the fact that the compressed gas-powered projectile accelerator of the present invention, in contrast to air-guns known to be in the art, fills an intermediate reservoir as an integral part of, and at the beginning of, each projectile accelerating cycle. The cycle is initiated by the operator, preferably by the action of a trigger, which causes the filling of the intermediate reservoir by compressed gas. The second step of the cycle where the projectile is accelerated is then automatically activated when the pressure reaches a set pressure threshold. In so doing, the filling of the intermediate reservoir may be used not only to regulate the projectile velocity, but the time of each cycle, making fully automatic operation possible without necessity for inertial or electronic timing. Additionally, since the gas in the intermediate reservoir is used as soon as the pressure reaches the set pressure, the problem of potential bleed-up of the pressure in the intermediate reservoir is eliminated. For further illustration, the type of regulation employed by the compressed gas-powered projectile accelerator of the present invention may be contrasted with that employed by statically-regulated air-guns known to be in the art, where the intermediate reservoir is automatically filled to the set pressure, and the gas stored until the projectile accelerating step of the cycle is triggered by the operator.

This unique cycle additionally maximizes reliability and minimizes wear by allowing all sliding components to rotate freely and requiring no hard impact or high pressure sliding contact between components. The simplicity of assembly allows the housing of the compressed gas-powered projectile accelerator of the present invention to be made as a single piece and the few moving parts can be easily removed for inspection and cleaning.

In another embodiment of the present invention, an additional "gas distribution shaft" is provided, and a valve passage is connected to the gas distribution shaft instead of directly to the chamber. The gas distribution shaft then conducts gas into a passage leading to a chamber between the receiver and bolt diametrical steps, but also can be used to deliver gas at equal pressure to other locations to power additional functions, and can easily incorporate throttling points at either end to allow adjust these functions where throttling provides a desirable measure of control. Because the gas distribution passage makes gas available at any position along the length of the housing, gas delivery to any position along the housing length can be accomplished with minimal impact to geometry.

In another embodiment, gas can be directed to aid in chambering of projectiles by a vertical shaft connecting the gas distribution shaft to a jet in the ball feed assembly, and the geometry of the gas distribution shaft allows a throttling screw to be incorporated at the intersection of the vertical shaft and gas distribution shaft at minimal cost.

In another embodiment, gas can be directed into an annular chamber in the valve passage to firstly pneumatically lock the valve into an open position when a projectile acceleration cycle is initiated, and secondly unlock the valve when gas pressure is being released to accelerate the valve, thereby holding the valve open longer and allowing a greater fraction of the gas to be applied to the acceleration of the projectile before the valve reopens, initiating another projectile acceleration cycle. Alternatively, the same affect can be achieved by a mechanical valve locking cam.

In another embodiment, the bumper located ahead of the step in the bolt diameter can be designed to form a seal between the bolt and the receiver passage step, preferably being an appropriately sized o-ring, thereby eliminating the need for the front bolt o-ring and allowing the receiver passage to be shortened by the length through which the front bolt o-ring would ordinarily travel.

In another embodiment, a second throttling point at the upstream end of the source gas passage can be used to allow gas accumulated between cycles within the source gas passage to cause the chambers ahead of and behind the larger diameter section of the bolt to fill faster on the first cycle that subsequent cycles, thereby allowing the first cycle to be timed differently than subsequent cycles, the first cycle primarily being controlled by the throttling point closest to the valve passage, and subsequent cycles primarily being controlled by the more upstream throttle point.

In another embodiment, the ability to cock the compressed gas-powered projectile accelerator can be accomplished by the addition of a discreet cocking assembly, said cocking assembly being a self-contained component which can provide the optional capability to manually cock the unit without a cocking assembly having to be built into the valve or housing.

In another embodiment, a discreet valve module has been devised where the slider can be divided into two parts, and the valve made as a separate component from the main housing, facilitating manufacture, interfacing and fabrication of connecting passages, and use of alternate construction materials from the housing. The valve module can also incorporate a cocking feature to make an entirely self-contained, sealed valve/cocking assembly.

In another embodiment, an additional "gas distribution passage" is employed, and a valve passage connected to the gas distribution shaft rather than directly to said chamber. Said gas distribution passage then conducts gas into a passage leading to said chamber between the breech and bolt diametrical steps, but also can be used to deliver gas at equal pressure to other locations to power additional functions, and can easily incorporate throttling points at either end to allow adjustment of these functions where throttling provides a desirable measure of control. Because the gas distribution passage makes gas available at any position along the length of the housing, gas delivery to any position along the housing length can be accomplished with minimal impact to geometry as a specific example, gas can be directed to aid in chambering of projectiles by a vertical shaft connecting the gas distribution shaft to a jet in the ball feed assembly, and the geometry of the gas distribution shaft facilitates the incorporation of a throttling screw at the intersection of the vertical shaft and gas distribution passage.

In another embodiment, gas can be directed into an annular chamber in the valve passage to firstly pneumatically lock the valve into an open position when a projectile acceleration cycle is initiated, and secondly unlock the valve when gas pressure is being released to accelerate a projectile, thereby holding the valve open longer and allowing a greater fraction of the gas to be applied to the acceleration of the projectile before the valve reopens, initiating another projectile acceleration cycle. Alternatively, the same affect can be achieved by a mechanical valve locking cam.

In another embodiment, the bumper located ahead of the step in the bolt diameter can be designed to form a seal between the bolt and the breech wall, preferably being an appropriately sized o-ring, thereby eliminating the need for the front bolt seal and allowing the receiver passage to be shortened by the length through which the front bolt seal would ordinarily travel.

In another embodiment, a second throttling point at the upstream end of the source gas passage can be used to allow gas accumulated between cycles within the source gas passage to cause the chambers ahead of and behind the larger diameter section of the bolt to fill faster on the first cycle that subsequent cycles, thereby allowing the first cycle to be timed differently than subsequent cycles, the first cycle primarily being controlled by the throttling point closest to the valve passage, and subsequent cycles primarily being controlled by the more upstream throttle point.

In another embodiment, the ability to cock the compressed gas-powered projectile accelerator can be accomplished by the addition of a discreet cocking assembly, the cocking assembly being a self-contained component which can provide the optional capability to manually cock the unit without a cocking assembly having to be built into the valve or housing.

In another embodiment, a discreet valve module has been devised where the slider can be divided into two parts, and the valve made as a separate component from the main housing, facilitating manufacture, interfacing and fabrication of connecting passages, and use of alternate construction materials from the housing. The valve module can also incorporate a cocking feature to make an entirely self-contained, sealed valve/cocking assembly.

DETAILED DESCRIPTION OF THE PREFERRED EMBODIMENTS

Figure 1:
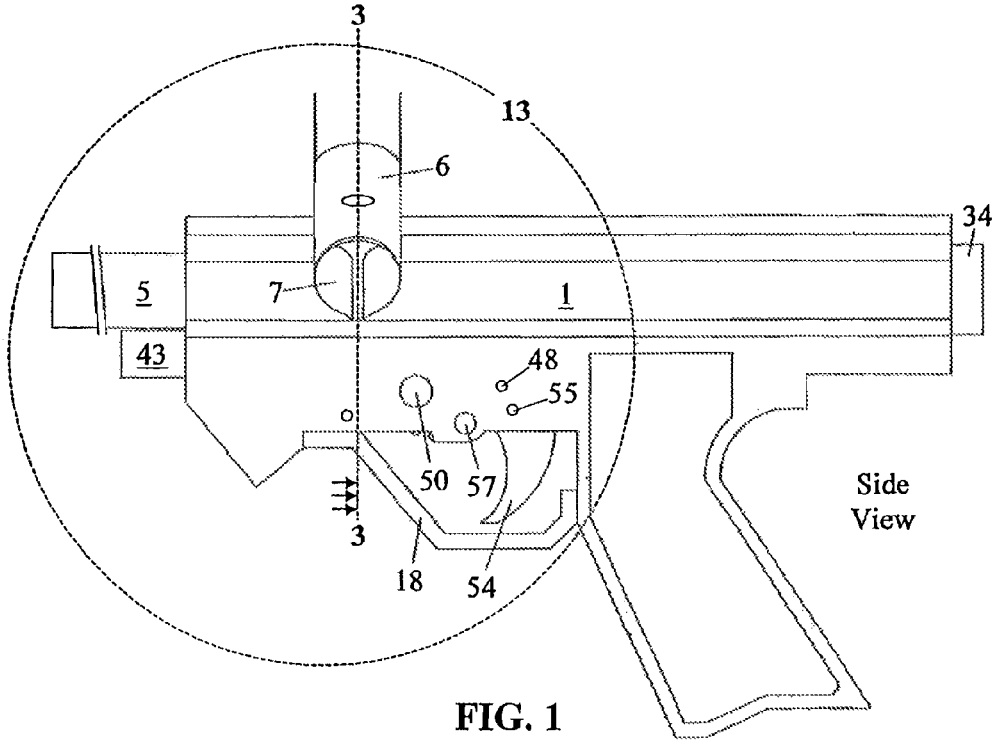
FIG. 1 is a view from the side of a compressed gas-powered projectile accelerator made according to the present invention.
Figure 2:
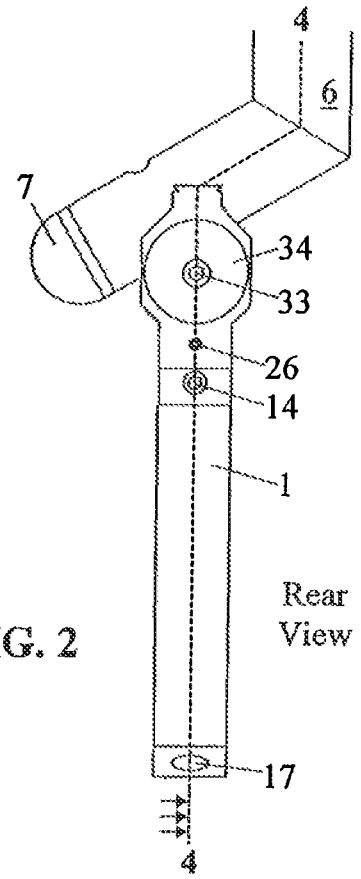
FIG. 2 is a view from the rear of a compressed gas-powered projectile accelerator made according to the present invention.

A preferred embodiment of a compressed gas-powered projectile accelerator of the present invention is here and in Figures disclosed. For clarity, within this document all reference to the top and bottom of the compressed gas-powered projectile accelerator will correspond to the accelerator as oriented in FIG. 1. Likewise, all reference to the front of said accelerator will correspond to the leftmost part of said accelerator as viewed in FIG. 1, and all reference to the rear of said accelerator will correspond to the rightmost part of said accelerator as viewed in FIG. 1. Referring to the Figures, the gas-powered accelerator of the present invention includes, generally:

A housing 1, preferably made of a single piece, shown in the Figures in the preferred shape of a pistol which is penetrated by hollow passages which contain the internal components.

Figure 4:
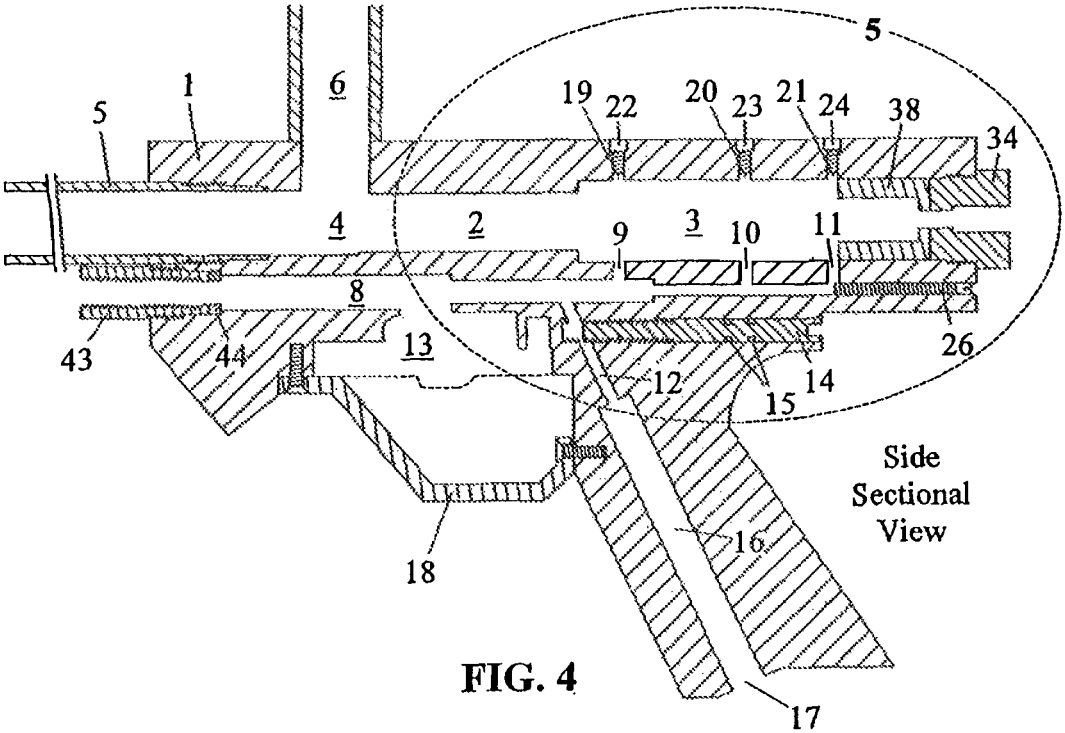
FIG. 4 is a sectional view from the side of a compressed gas-powered projectile accelerator made according to the present invention with internal components removed to show internal cavities and passages, taken along line 4-4 of FIG. 2.

A preferably cylindrical receiver passage 2 forms a breech 3 and barrel 4, the latter being preferably extended by the addition of a tubular member, hereafter denoted the "barrel extension" 5, which is preferably screwed into the housing 1 or otherwise removably attached. The barrel 4 is intersected by a projectile feed passage 6 into which projectiles are introduced from outside the housing 1. The projectile feed passage 6 may meet the barrel 4 at an angle but preferably may be at least partially vertically inclined to take advantage of gravity to bias projectiles to move into the barrel 4; conversely an alternate bias, such as a spring mechanism may be employed. The projectile feed passage 6 may connect such that its center axis intersects the center axis of the barrel 4, or, as shown in the examples in the Figures, the projectile feed passage 6 center axis can be offset from the center axis of the barrel 4, as long as the intersection forms a hole sufficiently sized for the passage of projectiles from the projectile feed passage 6 into the barrel 4. Also, the breech 3 diameter may optionally be slightly less than that of the barrel 4 immediately rearward of where the projectile feed passage 6 intersects the barrel 4 to help prevent projectiles from sliding or rolling rearward, as shown in FIG. 4. The examples shown in the Figures are designed to introduce spherical projectiles under the action of both gravity and suction, and includes a cap 7 at the end of the projectile feed passage 6 to prevent movement of projectiles beyond the entry point into the barrel 4. This "projectile feed passage cap" 7 can be designed to be rotatable, with a beveled surface at the point of contact with projectiles, such that in one orientation said projectile feed passage cap 7 will facilitate movement of projectiles into the barrel 4, but, when rotated 174 degrees will prevent movement of projectiles into the barrel 4.

Preferably parallel to the receiver passage 2 is a preferably cylindrical valve passage 8 of varying cross section which is connected to the breech 3 by a gas feed passage 9, a bolt rest-point passage 10, and a rear passage 11. The valve passage 8 is intersected by a source gas passage 12 and a trigger cavity 13, which is perforated in several places to allow extension of control components to the exterior of the housing 1. The source gas passage 12 is preferably valved, preferably by the use of a screw 14, the degree to which partially or completely blocks the source gas passage 12 depending on the depth to which the screw 14 has been adjusted into a partially threaded hole in the housing 1, intersecting the source gas passage 12. Alternatively, the gas feed passage 9 may be similarly valved instead of, or in addition to, the source gas passage 12 to control flow both between the source gas passage 12 and breech 3, and between the source gas passage 12 and valve passage 8. The screw 14 must form a seal with the hole in which it sits, preferably by the use of one or more o-rings in grooves 15. The source gas passage 12 will preferably include an expanded section 16 to minimize liquid entry and maximize consistency of entering gas by acting as a plenum. Gas is introduced through the source gas passage inlet 17 at the base of the housing 1, which may be designed to accept any high pressure fitting. A gas cylinder, which may be mounted to the housing 1, preferably to the base of the housing 1 in front of the optional trigger guard 18 illustrated in FIG. 1 or immediately to the rear of the source gas passage inlet 17, may be connected to said fitting, preferably by a flexible high pressure hose. The source gas passage 12 is depicted preferably integrated into the lower rear part of the housing 1 to facilitate manufacture of the housing 1 from a single piece of material, but it is to be appreciated that any orientation of the source gas passage 12, either within the housing 1 or an attachment made to the housing 1 of the compressed gas-powered projectile accelerator of the present invention, will not alter the inventive concepts and principles embodied therein.

Figure 5:
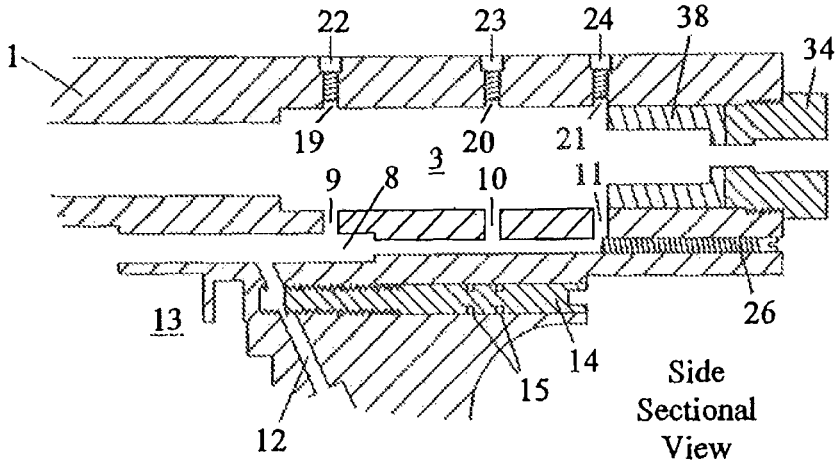
FIG. 5 is a sectional view from the side of upper rear portion of a compressed gas-powered projectile accelerator identified in FIG. 4 made according to the present invention shown enlarged, with internal components removed to show internal cavities and passages.
Figure 6:
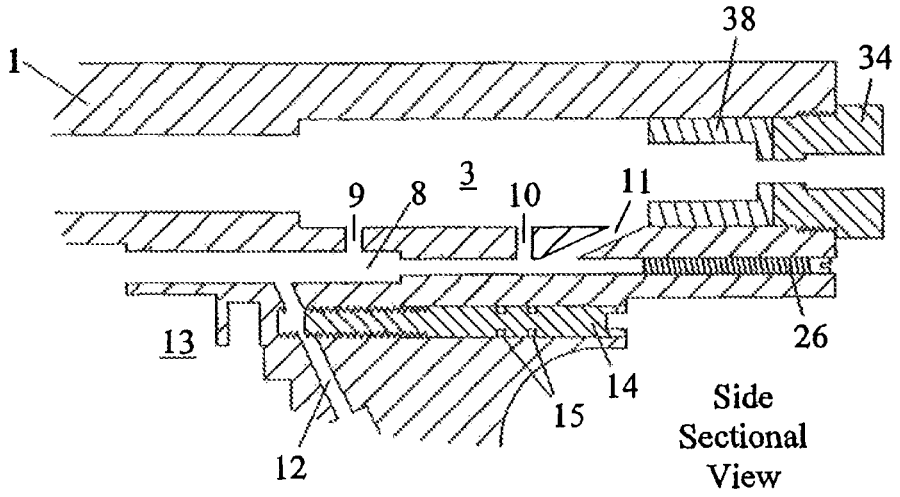
FIG. 6 is a sectional view from the side of upper rear portion of a compressed gas-powered projectile accelerator made according to the present invention shown enlarged where test/bleed ports have been eliminated by welding and strategic orientation of the rear passage, with internal components removed to show internal cavities and passages.
Figure 7:
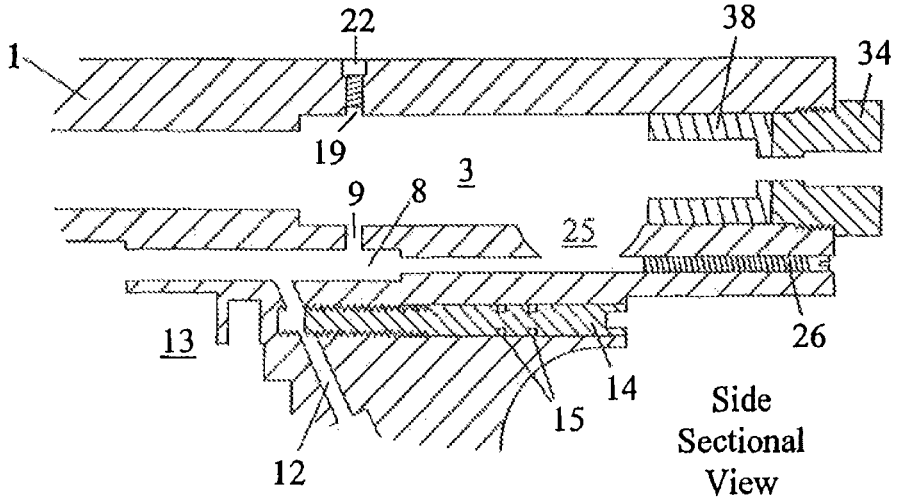
FIG. 7 is a sectional view from the side of upper rear portion of a compressed gas-powered projectile accelerator made according to the present invention shown enlarged where the bolt rest-point passage and rear passage have been replaced by a slot, eliminating corresponding perforations in the upper housing, with internal components removed to show internal cavities and passages.

A sectional view from the side of the housing with most internal components removed is shown in FIG. 4 for clarity. Optional test/bleed ports 19, 20, 21 are shown connecting the breech 3 to the outside of the housing 1, blocked by removable plugs 22, 23, 24 because they are formed as part of manufacture of the gas feed passage 9, bolt rest-point passage 10, and rear passage 11 of this preferred embodiment. Said ports 19, 20, 21 and plugs 22, 23, 24 are optional because they are not required for correct function of the projectile accelerator of the present invention. Said ports 19, 20, 21 may be eliminated from the design by a variety of means, such as the welding shut of said ports 19, 20, 21, use of special tooling, or by strategic routing of the gas feed passage 9, the bolt rest-point passage 10, and/or, in particular, the rear passage 11 which may be oriented such that it may be drilled either from the rear of the breech 3 or from the bottom. The breech 3 is shown enlarged in FIG. 5. In FIG. 6 the breech 3 is shown in detail with the front test/bleed port 19 and middle test/bleed port 20 eliminated by welding and rear passage 11 oriented such that it may be manufactured without additional perforation of the breech 3 or need of special tooling such as a small right-angle drill. A third option is shown in FIG. 7 where the bolt rest-point passage 10, and rear passage 11 are replaced by a single slot 25, eliminating the corresponding perforations at the top of the breech 3.

Passages 9, 10, 11 and/or bleed/test ports 19, 20, 21 may be individually optionally valved to control gas flow, preferably by the use of screws, the degree to which partially or completely block the passage or passages 9, 10, and/or 11, and/or bleed/test ports 19, 20, and/or 21, depending on the depth to which the screws have been adjusted into threaded holes appropriately made in the housing 1, intersecting the passage or passages 9, 10, and/or 11 and/or ports 19, 20, and/or 21. The preferred embodiment depicted in the Figures herein includes an exemplary valve screw 26 at the junction between the rear passage 11 and valve passage 8.

Figure 8:
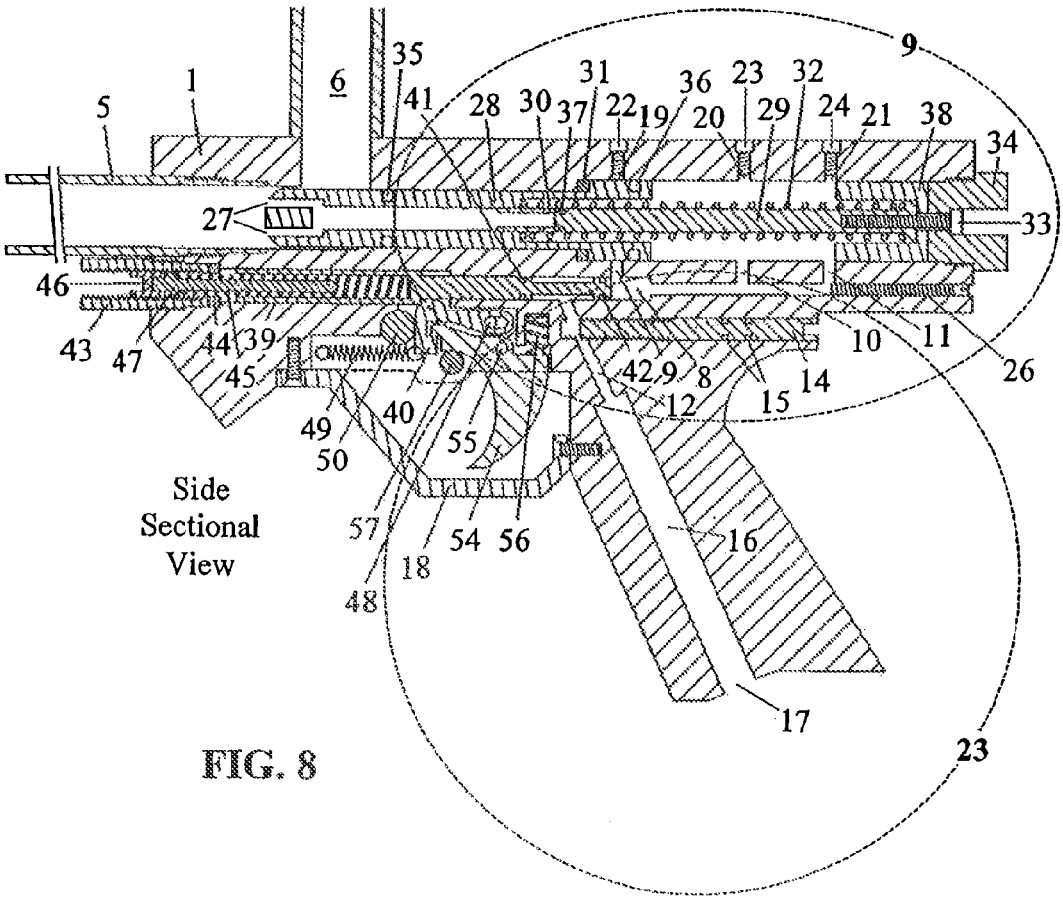
FIG. 8 is a sectional view from the side of a compressed gas-powered projectile accelerator made according to the present invention.
Figure 9:
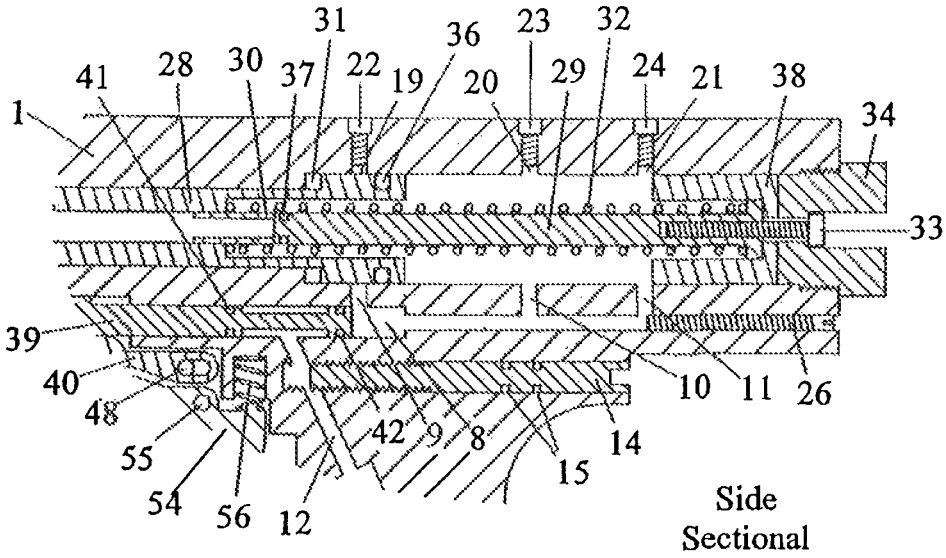
FIG. 9 is a sectional view from the side of the upper rear portion of a compressed gas-powered projectile accelerator identified in FIG. 9 made according to the present invention shown in detail with purge holes in the spring guide.
Figure 9A:
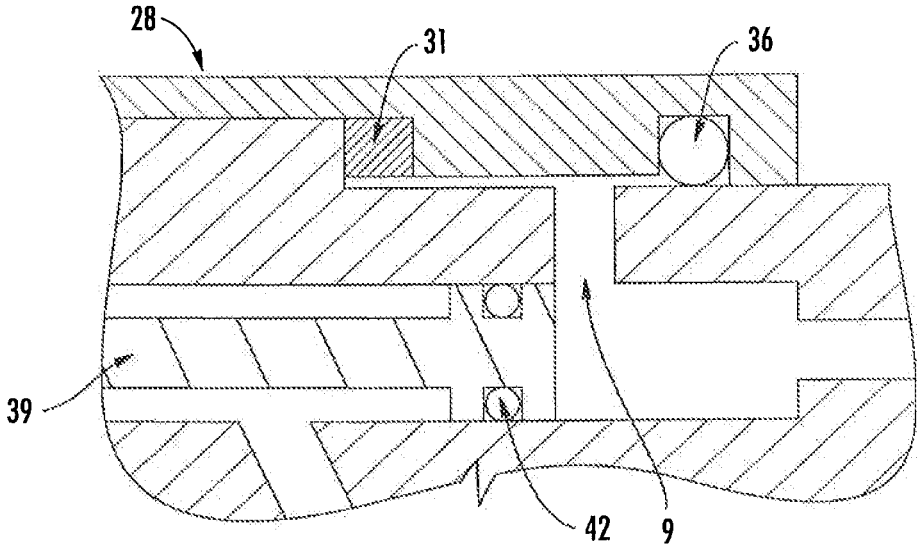
FIG. 9(A) is a detailed and enlarged view of the compressed gas-powered projectile accelerator shown in FIG. 9.

Referring now to FIG. 8, a hollow slider, having one or, as shown in FIG. 8, a plurality of holes 27 on the front surface, matching the shape of the barrel 4 and breech 3, preferably free to rotate about a central axis parallel to the receiver passage 2 to minimize wear, and preferably made of a single piece, generally referred to as a bolt 28, can slide within the receiver passage 2 and around a preferably cylindrical spring-guide 29, which has a hollow space at the forward end which communicates with said forward end a plurality of holes about its circumference which allow compressed gas to pass through the bolt 28 and will hence be denoted "purge holes" 30. A preferably elastic bumper or "bolt bumper" 31 is attached to the bolt 28 at a point where the bolt 28 changes diameter, limiting its forward travel and easing shock in the event of malfunction. (The projectile accelerator of the present invention can be designed such that the bolt 28 does not experience high impact against the housing 1.) A spring or "bolt spring" 32 surrounds the spring-guide 29, which is attached, preferably by a screw 33 to a removable breech cap 34, which closes the rear of the breech 3, preferably by being screwed into the housing 1. The bolt 28 and spring guide 29 are shown with preferable o-ring/groove type gas seals 35, 36, 37, although the type of sealing required at these locations is arbitrary. A preferably cylindrical elastic bumper 38 which protects the bolt 28 and breech cap 34 in the event of malfunction is held in place between the spring guide 29 and breech cap 34, partially surrounding the bolt spring 32 and spring guide 29. The breech cap 34, bumper 38, spring guide 29, bolt spring 32, and rear part of the bolt 28 and housing 1 are shown in detail in FIG. 9. FIG. 9(A) is an enlarged and detailed view of the bolt 28, bumper 38, bolt sprint 32, bolt rear seal 36, gas feed passage 9, and valve slider 39, of the present invention.

Figure 10:
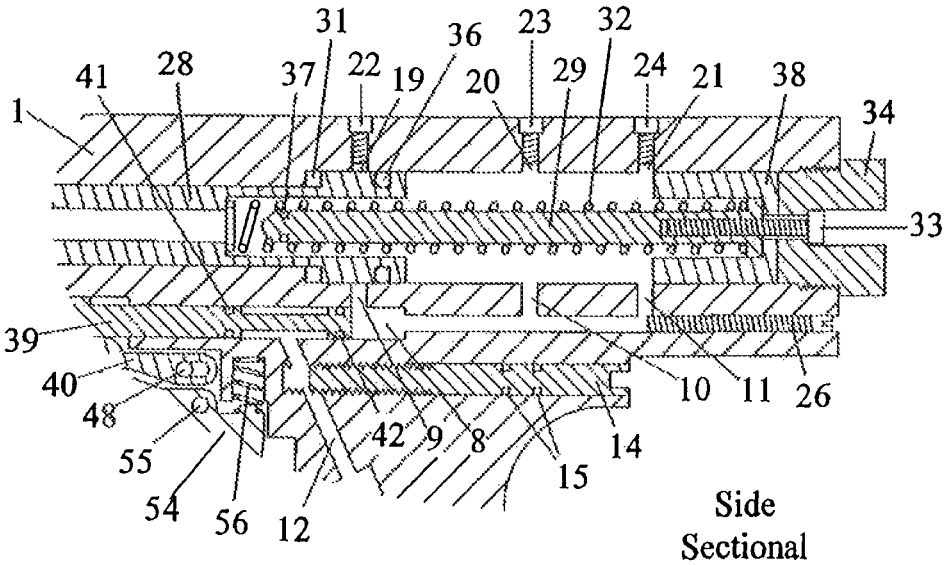
FIG. 10 is a sectional view from the side of the upper rear portion of a compressed gas-powered projectile accelerator made according to the present invention shown in detail with a truncated spring guide eliminating need for purge holes.
Figure 11:
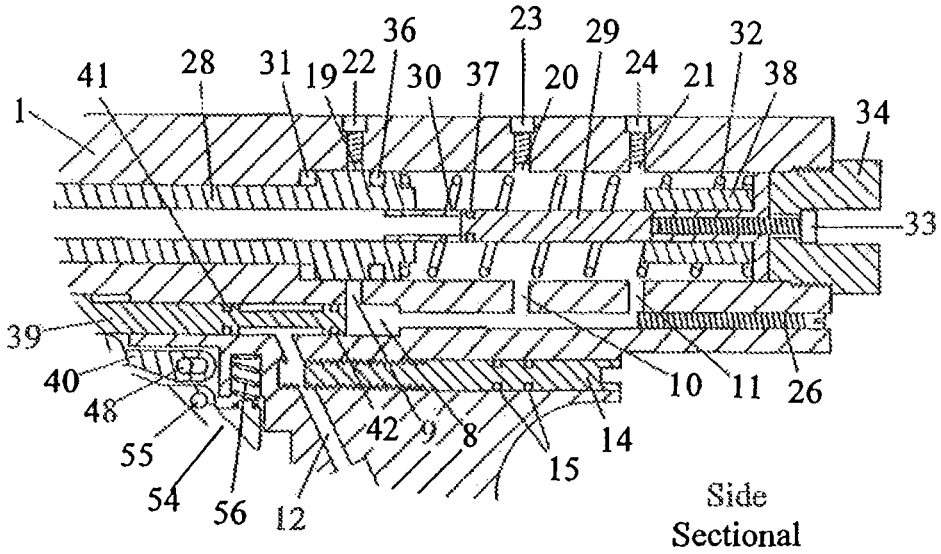
FIG. 11 is a sectional view from the side of the upper rear portion of a compressed gas-powered projectile accelerator made according to the present invention shown in detail with purge holes in the spring guide and an enlarged bolt spring.
Figure 12:
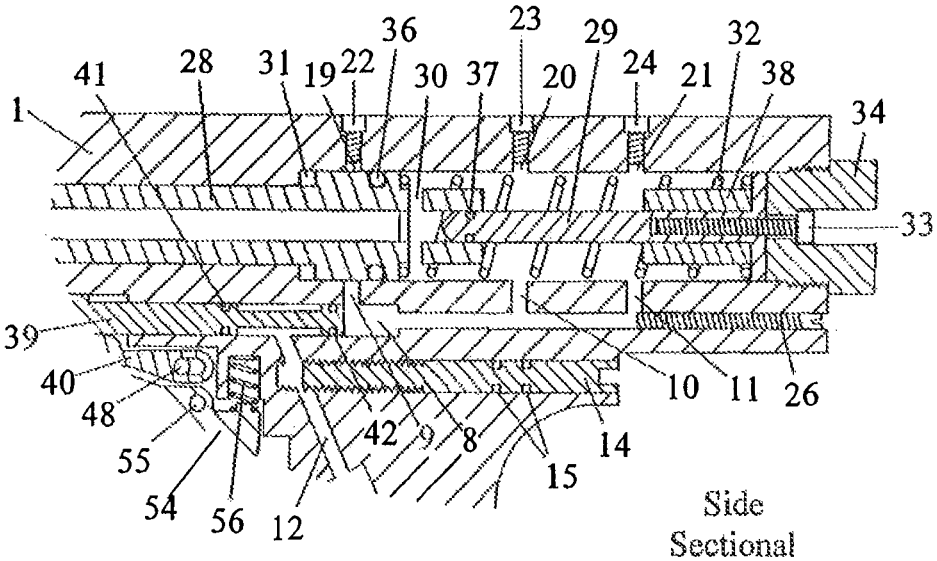
FIG. 12 is a sectional view from the side of the upper rear portion of a compressed gas-powered projectile accelerator made according to the present invention shown in detail with a truncated spring guide, an enlarged bolt spring, and purge holes in the bolt instead of the spring guide.
Figure 13:
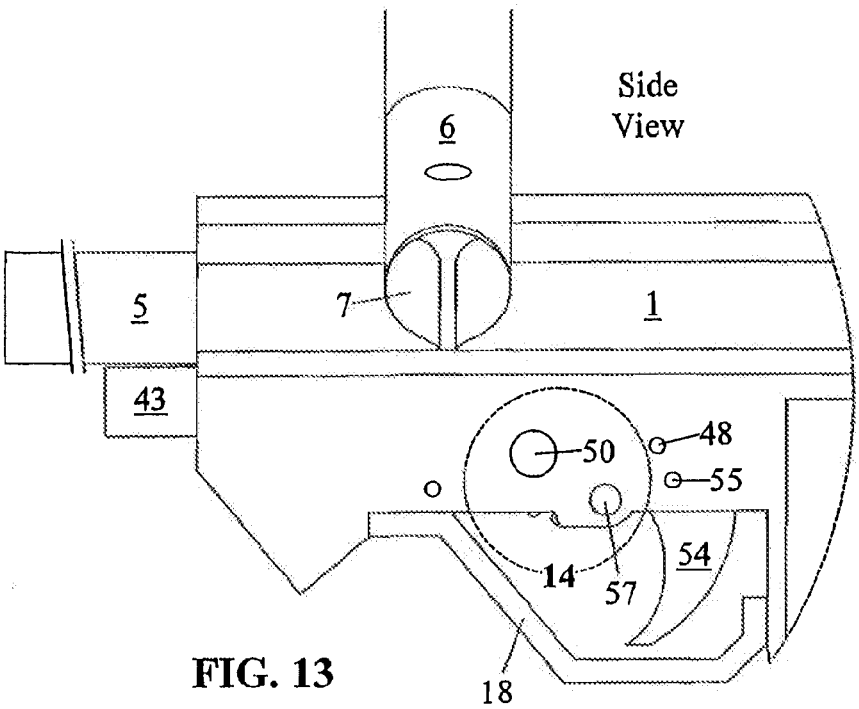
FIG. 13 is a view from the side of the front portion of a compressed gas-powered projectile accelerator made according to the present invention shown in detail.

Alternate configurations of these components are shown in detail in FIG. 10, where instead of having a hollow space at the forward end and purge holes 30, the spring guide 29 is truncated to allow the passage of gas through the bolt 28; FIG. 11, where the bolt spring 32 diameter is in detail to reduce wear on the spring guide o-ring 37 (or other seal type) and the bumper 38 resides partly inside the bolt spring 32; and FIG. 12, where the spring guide 29 is again truncated and the purge holes 30 are incorporated into the rear part of the bolt 28.

A partially hollow slider or "valve slider" 39 matching the shape of the valve passage 8 as shown in FIG. 8, preferably free to rotate about its axis parallel to the receiver passage 2 to minimize wear, particularly from contact with the sear 40 described below, can slide within the valve passage 8. The valve slider 39 forms seals with the valve passage 8 at two points—where single o-ring/groove type seals 41, 42 are shown for illustration, but multiple o-rings or any other appropriate type of seal may be used; e.g. use of a flexible material such as polytetrafluoroethylene at these points to form surface-to-surface seals in lieu of o-rings can potentially reduce wear on these seals 41, 42.

Figure 14:
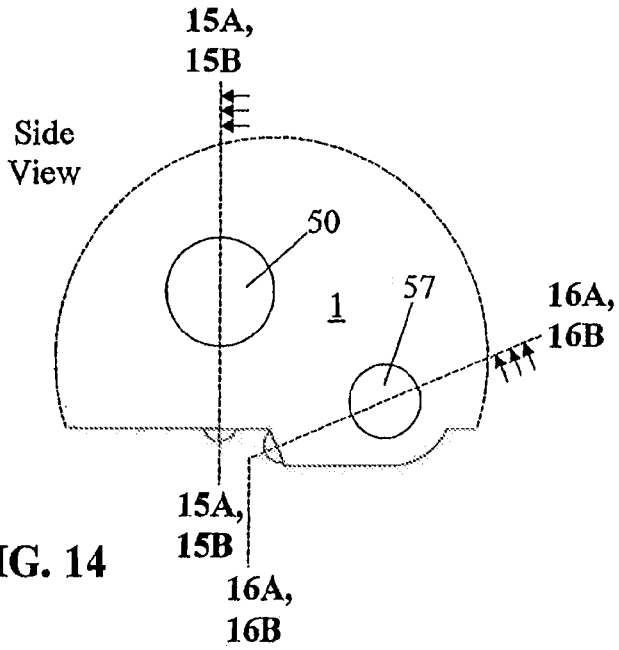
FIG. 14 is a view from the side of the region identified in FIG. 13 in the vicinity of the trigger of a compressed gas-powered projectile accelerator made according to the present invention shown in detail.
Figure 15A:
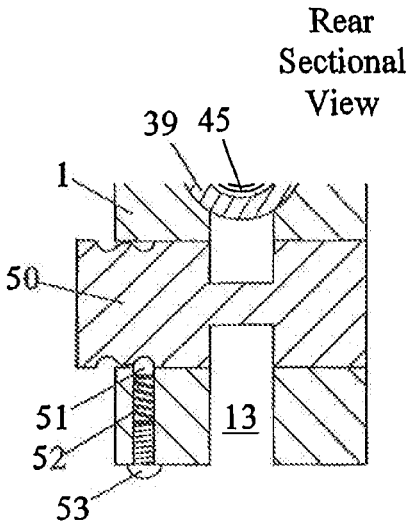
FIGS. 15A and 15B are sectional views from the rear of the region taken along lines 15A-15A and 15B-15B identified in FIG. 14 in the vicinity of the trigger of a compressed gas-powered projectile accelerator made according to the present invention showing the mode-selector cam in the semi-automatic and fully-automatic positions, respectively, with ball and spring retention assembly, shown in detail.
Figure 15B:
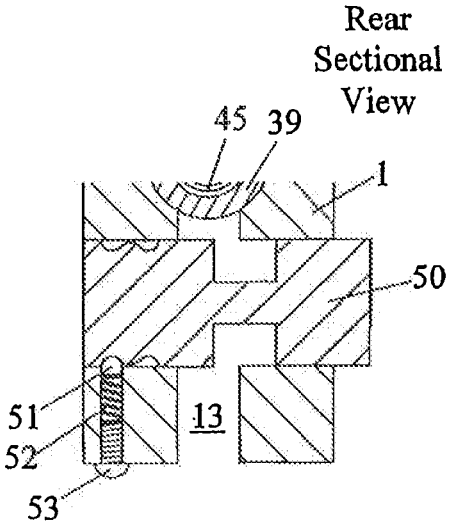

A preferably removable hollow valve passage cap 43, preferably screwed into the housing 1, traps an optional bumper or "valve bumper" 44 which protects the valve passage cap 43 from wear by contact with the valve slider 39 and vice-versa. A spring or "valve spring" 45 within the valve passage 8, which may be accepted partially within the valve slider 39, and valve passage cap 43, pushes against the valve slider 39 and against a screw 46 preferably threaded inside of the valve passage cap 43, the position of which may be adjusted to increase or decrease tension in the spring 45, thereby adjusting the operating pressure of the cycle and magnitude of projectile acceleration. An optional internal guide 47 for the valve spring can be added. The valve slider 39 can be held in a forward "cocked" position by a sear 40, which can rotate about and slide on a pivot 48. A spring 49 maintains a bias for the sear 40 to slide forward and rotate toward the valve slider 39. Sliding travel of the sear 40 can be limited by means of a preferably cylindrical sliding cam or "mode selector cam" 50 of varying diameter shown in detail in FIGS. 14, 15A, and 15B, the positions corresponding to semi-automatic and fully-automatic being shown in FIGS. 15A and 15B, respectively. Position of the mode selector cam 50 is maintained and its travel limited by the ball 51 and spring 52 arrangement shown, which are retained within the housing 1 by the screw 53 shown.

Figure 16A:
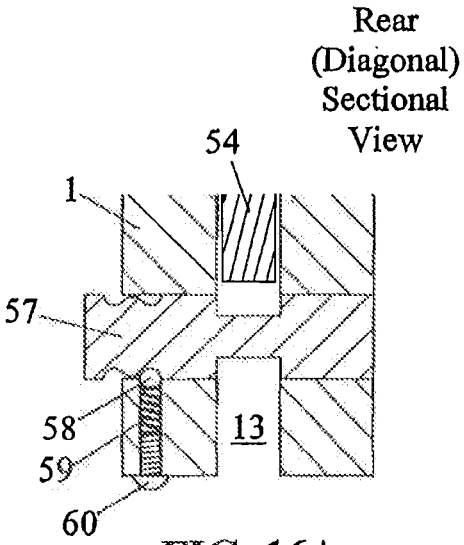
FIGS. 16A and 16B are sectional views of the region taken along lines 16A-16A and 16B-16B identified in FIG. 14 in the vicinity of the trigger of a compressed gas-powered projectile accelerator made according to the present invention, as viewed diagonally from the lower rear, showing the safety cam in the non-firing and firing positions, respectively, with ball and spring retention assembly, shown in detail.
Figure 16B:
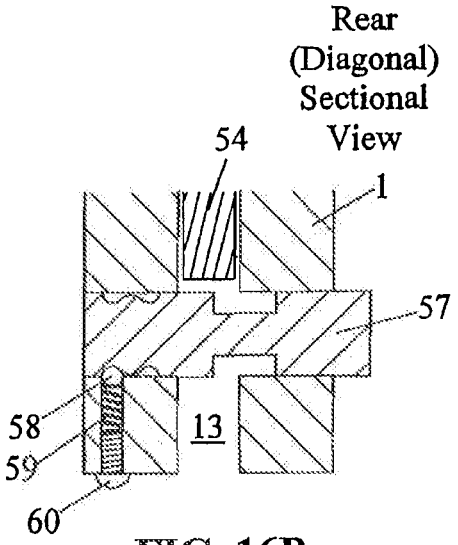

A lever or "trigger" 54 which rotates on a pivot 55 can press upon the sear 40, inducing rotation of the sear 40. A bias of the trigger 54 to rotate toward the sear 40 (clockwise in FIG. 8) is maintained by spring 56. Rotation of the trigger 54 can be limited by means of a preferably cylindrical sliding cam or "safety cam" 57 of varying diameter shown in detail in FIGS. 14, 16A, and 16B, the firing and non-firing positions being shown in FIGS. 16A and 16B, respectively. Position of the safety cam 57 is maintained and its travel limited by the ball 58 and spring 59 arrangement shown, which are preferably retained within the housing 1 by the screw 60 shown.

Figure 17A:
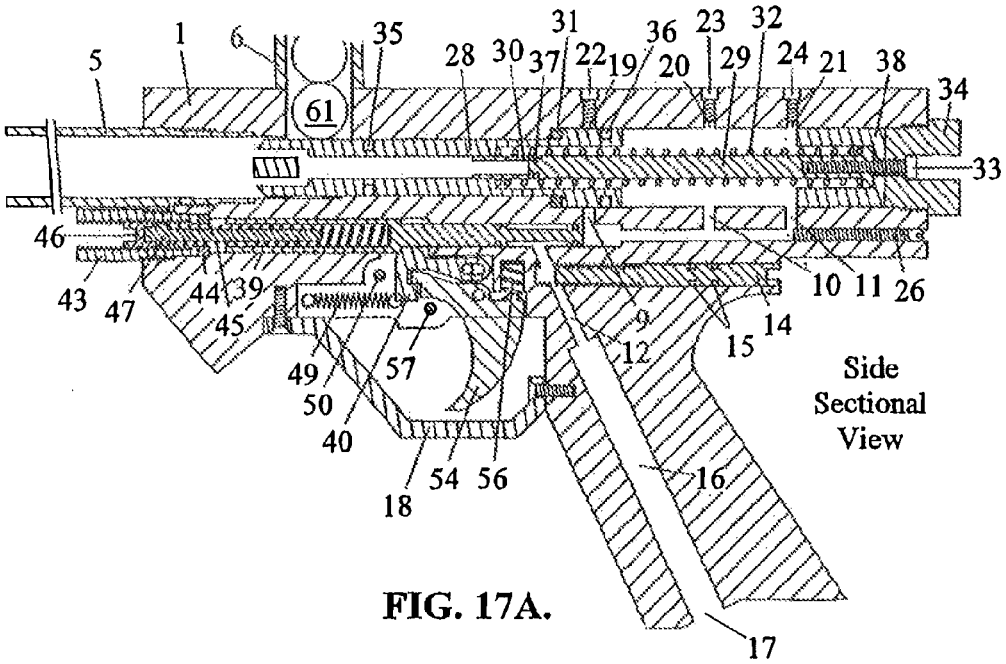
FIGS. 17A-I are sectional views from the side of a compressed gas-powered projectile accelerator made according to the present invention, illustrating semi-automatic operation.

Semi-Automatic Operation of the Compressed Gas-Powered Projectile Accelerator of the Present Invention is Here Described:

The preferred ready-to-operate configuration for semi-automatic operation is shown in FIG. 17A, with the valve slider 39 in its cocked position, resting against the sear 40, which, under the pressure of the valve spring 45 translated through the valve slider 39, rests in its rearmost position. The safety cam 57 is positioned to allow the trigger 54 to rotate freely. The mode selector cam 50 is positioned so as to not restrict the forward travel of the sear 40. The smaller diameters of the safety cam 57 and mode selector cam 50 are shown in this cross section, as said smaller diameters represent the portions of these components interacting with the trigger 54 and sear 40, respectively. A projectile 61 is positioned to enter the barrel 4. The illustrated projectile is a spherical projectile 61 as an example. The projectile 61 is prevented from entering the barrel 4 by interference with the bolt 28.

Figure 17B:
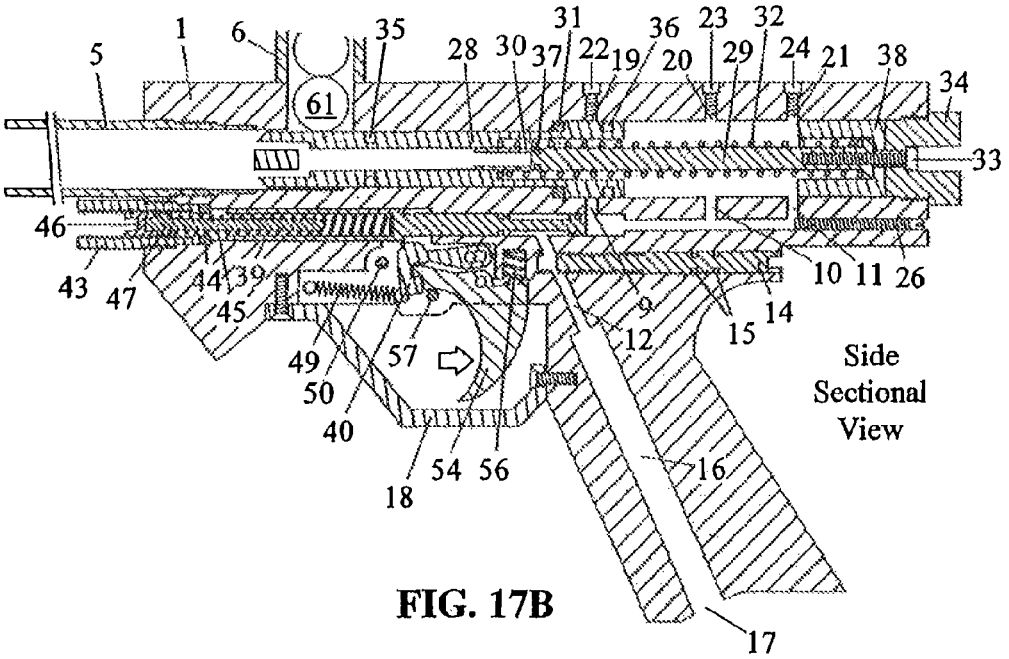

The trigger 54 is then pulled rearward, pulling the sear 40 downward, disengaging it from the valve slider 39, as shown in FIG. 17B.

Figure 17C:
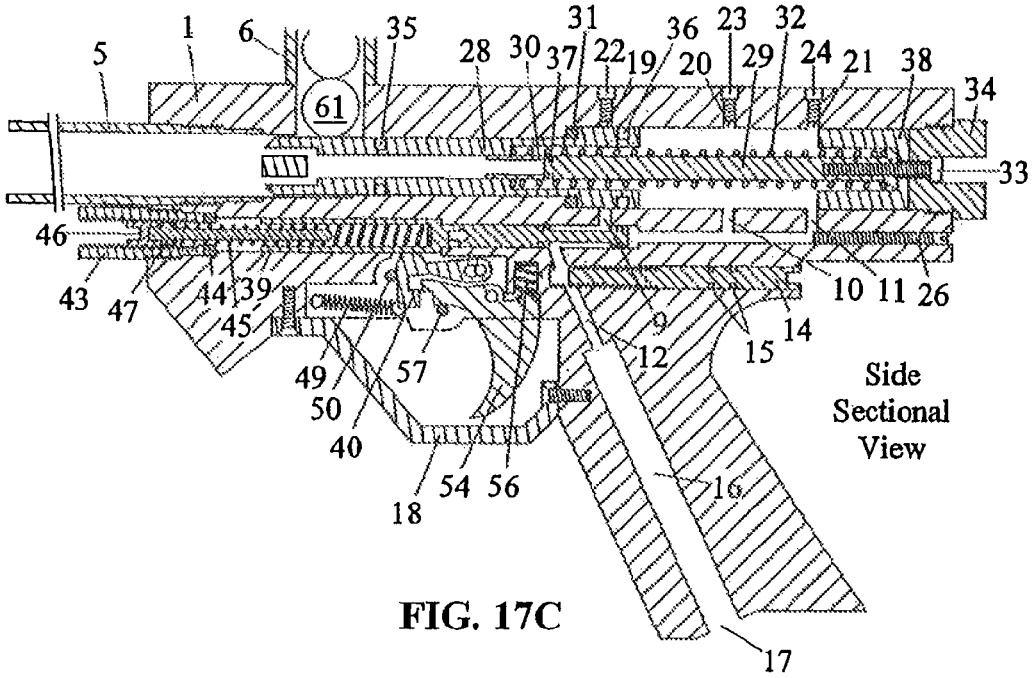

Shown in FIG. 17C, under the force applied by the valve spring 45, the valve slider 39 then slides rearward, until it is stopped preferably by mechanical interference with the changing diameter of the valve passage 8, allowing gas to flow through the gas feed passage 9 into the region of the breech 3 ahead of the bolt rear seal 36. Simultaneously, the sear 40 is caused to slide forward and rotate (clockwise in the drawing) by the sear spring 49, coming to rest against the valve slider 39, being now disengaged from the trigger 54.

Figure 17D:
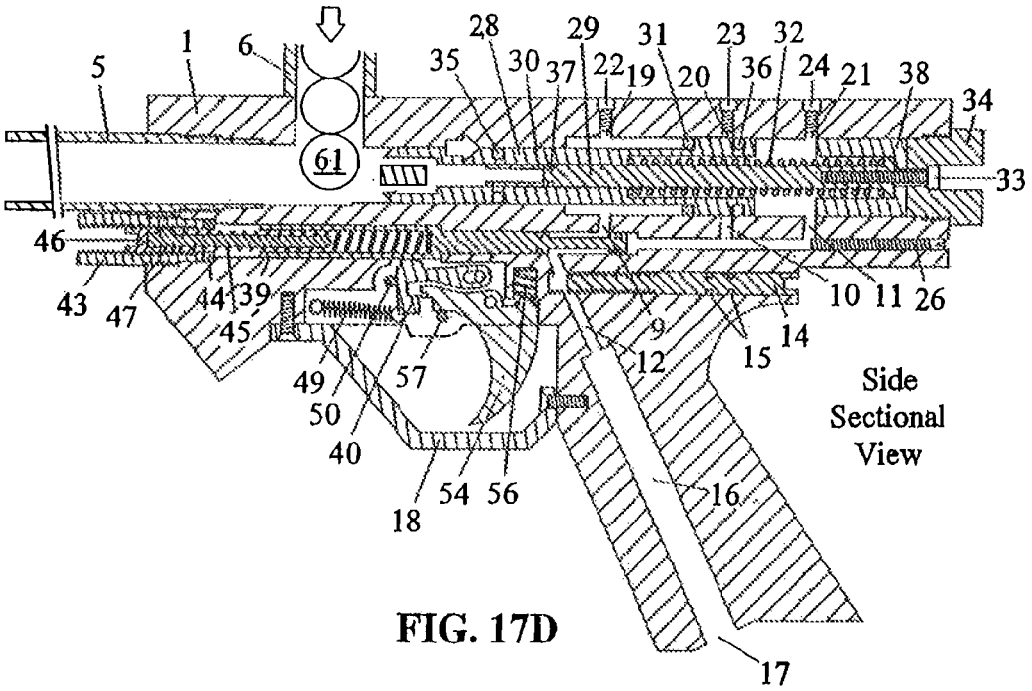

Shown in FIG. 17D, the pressure of the gas causes the bolt 28 to slide rearward, until the bolt rear seal 36 passes the front edge of bolt rest-point passage 10, opening a flow path, and allowing gas into the bolt rest-point passage 10, valve passage 8 rearward of the valve slider 39, rear passage 11, and region of the breech 3 to the rear of the bolt 28. The externally applied bias of the projectile 61 to enter the barrel 4, here assumed to be gravity as an example, acts to push a projectile 61 into the barrel 4, aided by the suction induced by the motion of the bolt 28. Additional projectiles in the projectile feed passage 6 are blocked from entering the barrel 4 by the projectile 61 already in the barrel 4. The combined force of the bolt spring 32 and the pressure behind the bolt 28 bring the bolt 28 to rest, preferably without contacting the breech cap bumper 38 at the rear of the breech 3. The breech 3, valve passage 8 rearward of the valve slider 39, and all contiguous cavities not isolated by seals within the housing 1 may here be recognized as the intermediate reservoir discussed in the background of the invention. The bolt 28 will remain approximately at rest, where its position will only adjust slightly to allow more or less gas through the bolt rest-point passage 10 as required to maintain a balance of pressure and spring forces on it while the pressure continues to increase.

Figure 17E:
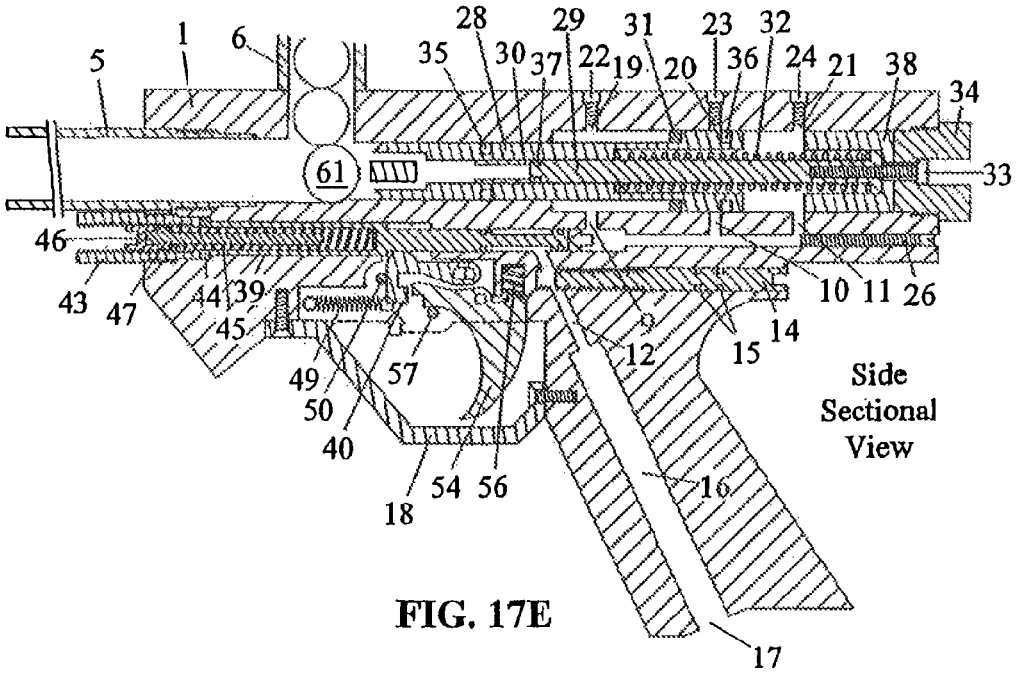

Shown in FIG. 17E, once the pressure in the valve passage 8 rearward of the valve slider 39 has increased sufficiently to overcome the force of the valve spring 45 on the valve slider 39, the valve slider 39 will be pushed forward until it contacts the valve bumper 44 if present, or valve passage cap 43 if no valve bumper 44 is present, thereby simultaneously stopping the flow of compressed gas from the source gas passage 12, and allowing the flow of gas from the region of the breech 3 ahead of the bolt rear seal 36 through the feed passage, into the valve passage 8 rearward of the valve slider 39, which is in communication with the region of the breech 3 behind the bolt 28. The sear 40, under the action of the sear spring 49, will rotate further (clockwise in the drawing) once the largest diameter section of the valve slider 39 has traveled sufficiently far forward to allow this, coming to rest against the portion of the valve slider 39 rearward of its said largest diameter section.

Figure 17F:
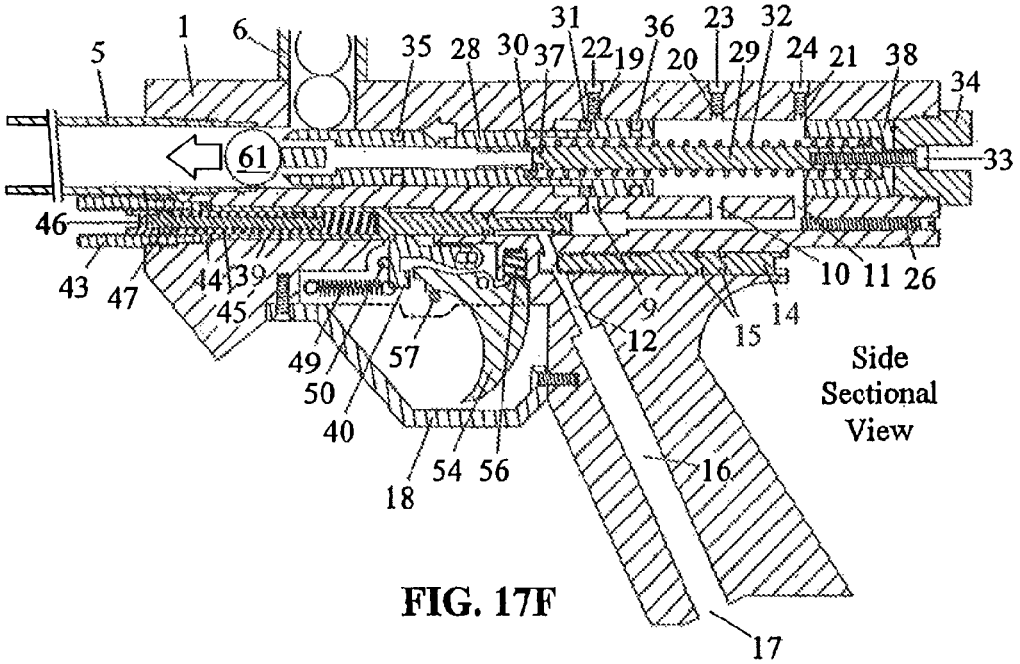

The bolt 28 is then driven forward by now unbalanced pressure and spring forces on its surface, pushing the projectile 61 forward in the barrel 4 and blocking the projectile feed passage 6, preventing the entry of additional projectiles. When the bolt 28 reaches the position shown in FIG. 17F, gas flows through the purge holes 30 in the spring guide 29, through the center of the bolt 28, and through the plurality of holes 27 on the front surface of the bolt 28, which distribute the force of the flowing gas into uniform communication with the rear surface of the projectile 61.

Figure 17G:
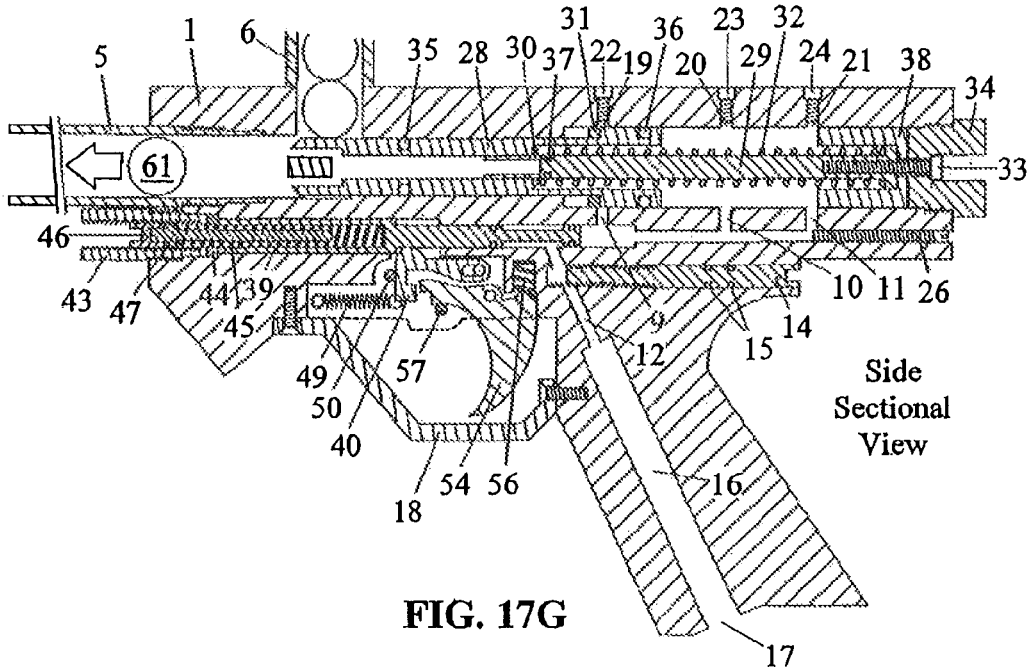
Figure 17H:
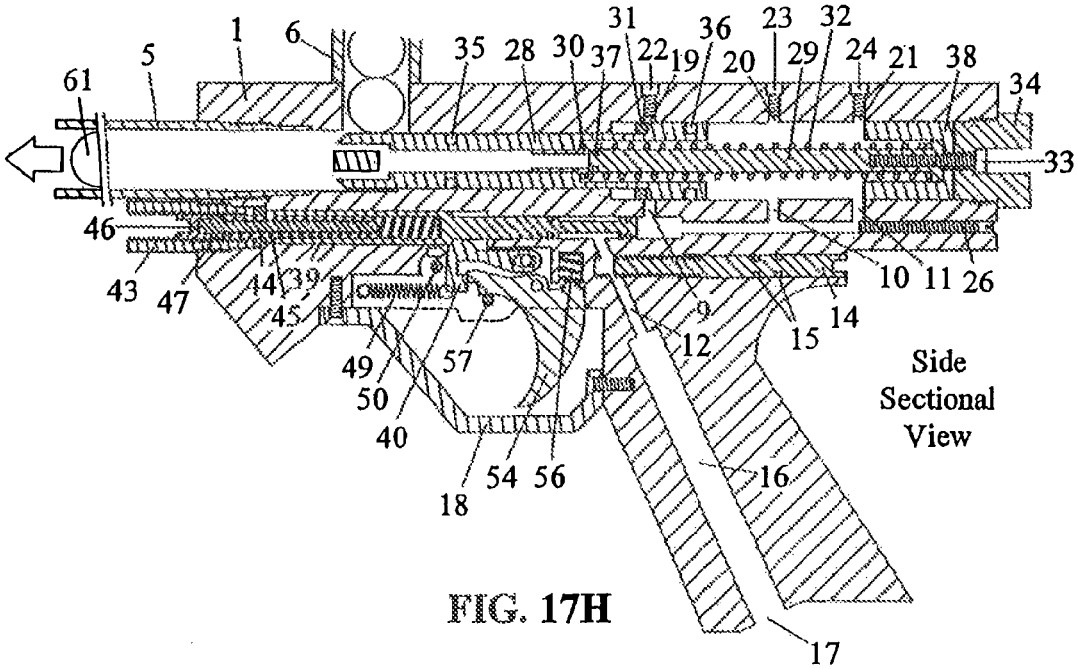

Shown in FIG. 17G and further in FIG. 17H, the action of the gas pressure on the projectile 61 will cause it to accelerate through and out of the barrel 4 and barrel extension 5, at which time the barrel, barrel extension 5, breech 3, valve passage 8 rearward of the valve slider 39, and all communicating passages which are not sealed will vent to atmosphere.

Shown in FIG. 17H, when the pressure within the valve passage 8 rearward of the valve slider 39 has been reduced to sufficiently low pressure such that the force induced on the valve slider 39 no longer exceeds that of the valve spring 45, the valve slider 39 will slide rearward until its motion is restricted by the sear 40. The sear 40 will rest against the front of the trigger 54, and may exert a (clockwise in drawing) torque helping to restore the trigger 54 to its resting position, depending on the design of the position of the trigger pivot 55 relative to the point of contact with the valve slider 39.

Figure 17I:
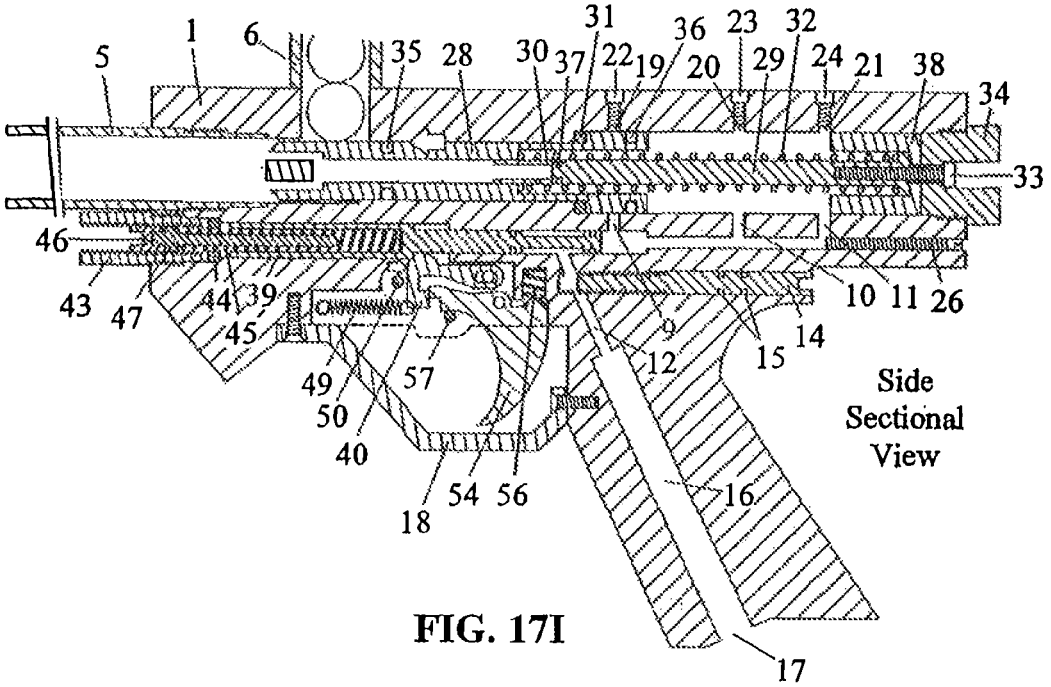

Under the action of the bolt spring 32, the bolt 28 will continue to move forward, compressing gas within the space ahead of the bolt rear seal 36 in so doing, and, allowing only a small gap by which the gas may escape into the valve passage 8, the bolt 28 will be decelerated, minimizing wear on the bolt bumper 31 and stopping in its preferred resting position, as shown in FIG. 17I.

When the trigger 54 is released, the action of the trigger spring 56, sear spring 49, and valve spring 45 will return the components to the preferred ready-to-fire configuration, shown in FIG. 17A.

Figure 18A:
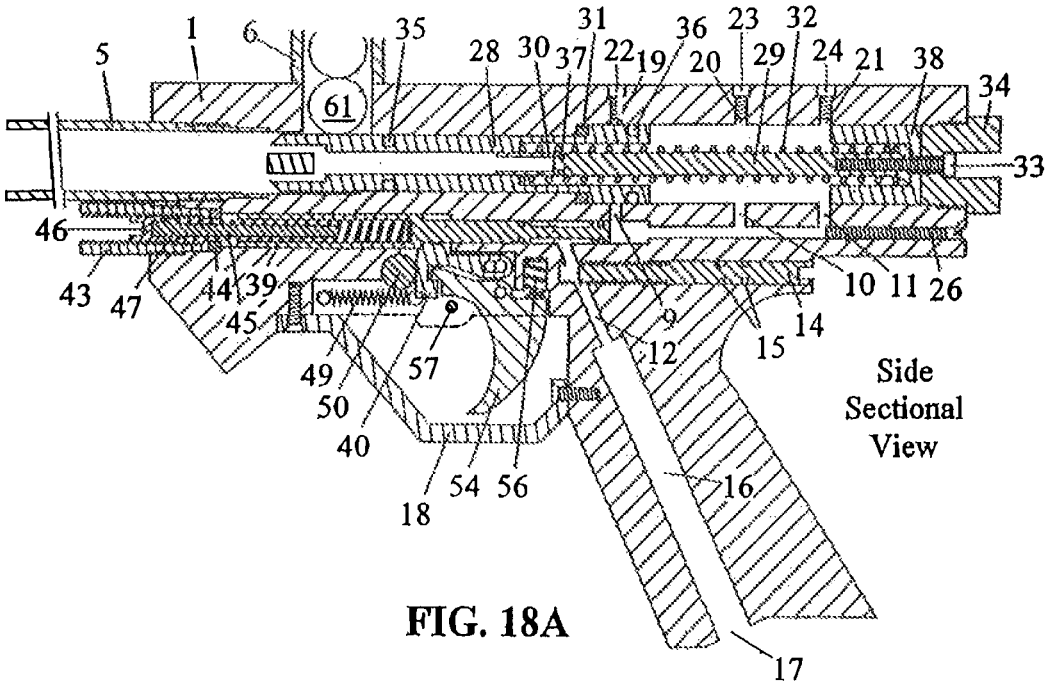
FIGS. 18A-H are sectional views from the side of a compressed gas-powered projectile accelerator made according to the present invention, illustrating fully-automatic operation.

Fully-Automatic Operation of the Compressed Gas-Powered Projectile Accelerator of the Present Invention is Here Described:

The preferred ready-to-operate configuration for fully-automatic operation is shown in FIG. 18A, with the valve slider 39 in its cocked position, resting against the sear 40, which, under the pressure of the valve spring 45 translated through the valve slider 39, rests in its rearmost position. The safety cam 57 is positioned to allow the trigger 54 to rotate freely. The mode selector cam 50 is positioned so as to restrict the forward travel of the sear 40. The smaller diameter of the safety cam 57 and larger diameter of the mode selector cam 50 are shown in this cross section, as said diameters represent the portions of these components interacting with the trigger 54 and sear 40, respectively. A projectile 61 with an arbitrary externally applied bias to enter the barrel 4, here a spherical projectile being used as an example, is prevented from entering the barrel 4 by interference with the bolt 28.

Figure 18B:
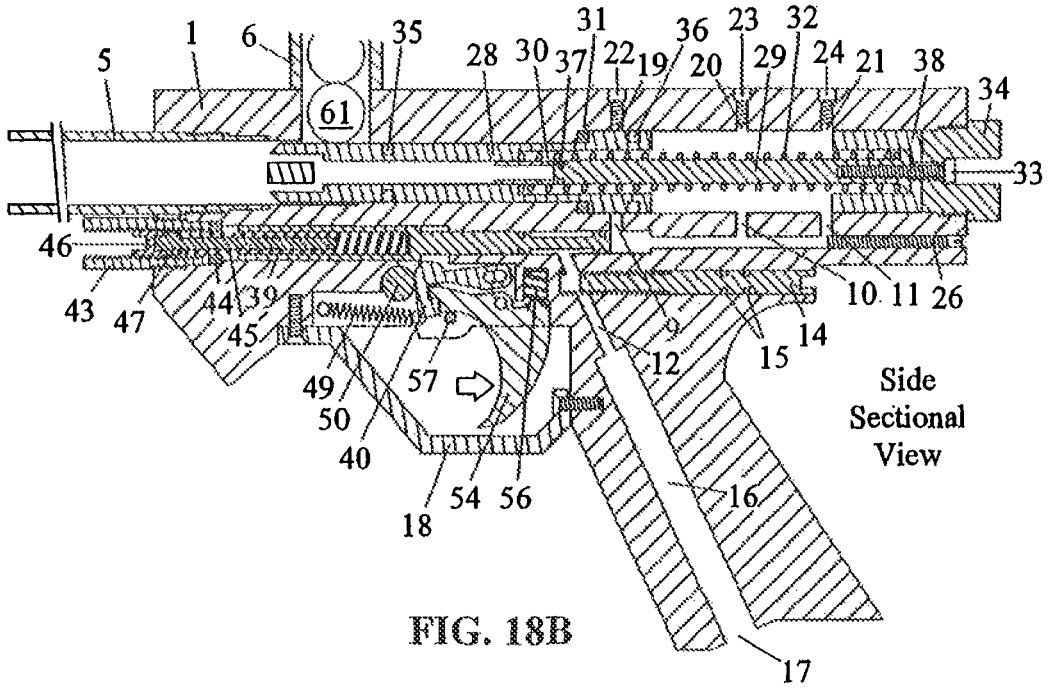

The trigger 54 is then pulled rearward, pulling the sear 40 downward, disengaging it from the valve slider 39, as shown in FIG. 18B.

Figure 18C:
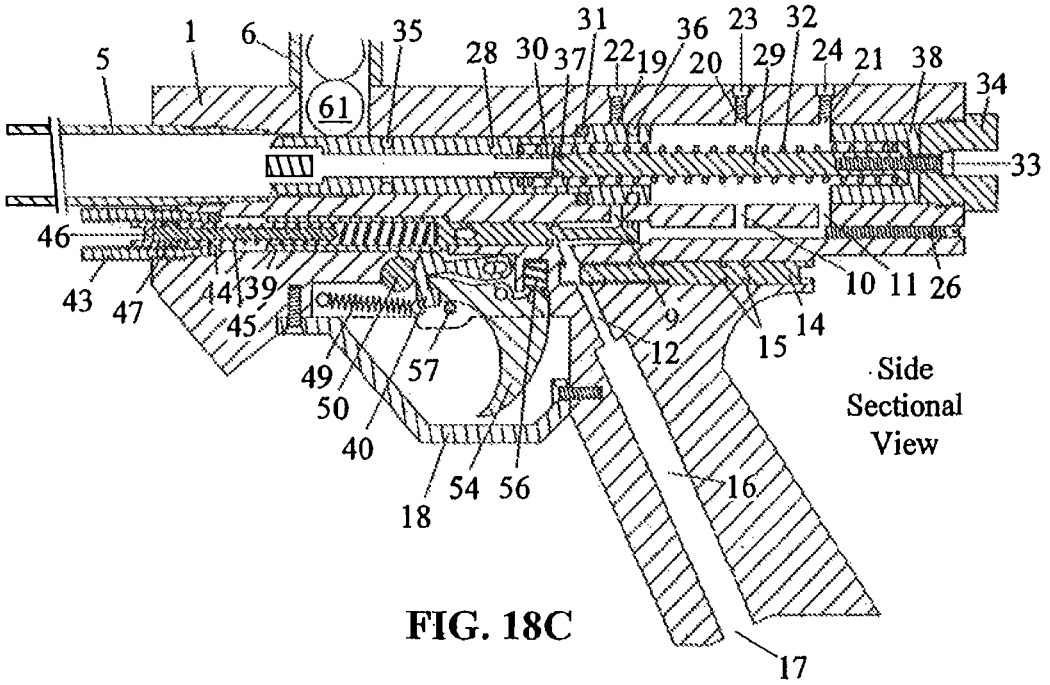

Shown in FIG. 18C, under the force applied by the valve spring 45, the valve slider 39 then slides rearward, until it is stopped preferably by mechanical interference with the changing diameter of the valve passage 8, allowing gas to flow through the gas feed passage 9 into the region of the breech 3 ahead of the bolt rear seal 36. The mode selector cam 50 prevents the sear 40 from sliding forward sufficiently far to disengage from the trigger 54.

Figure 18D:
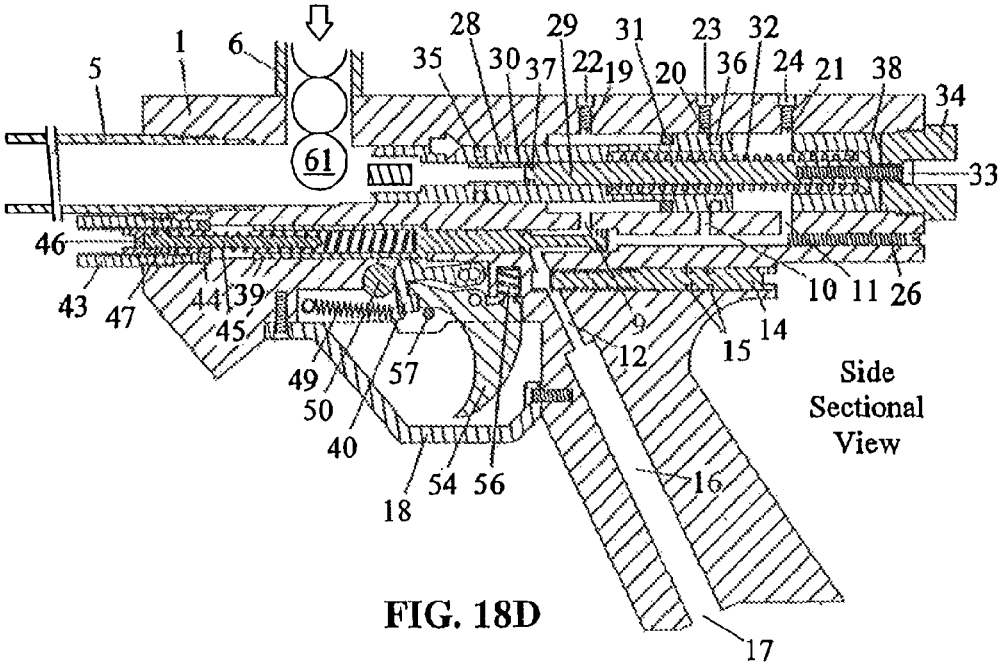

Shown in FIG. 18D, the pressure of the gas causes the bolt 28 to slide rearward, until the bolt rear seal 36 passes the front edge of the bolt rest-point passage 10, allowing gas into the bolt rest-point passage 10, valve passage 8 rearward of the valve slider 39, rear passage 11, and region of the breech 3 behind the bolt 28. The externally applied bias of the projectile 61 to enter the barrel 4, here assumed to be gravity as an example, acts to push a projectile 61 into the barrel 4, aided by the suction induced by the motion of the bolt 28. Additional projectiles in the projectile feed passage 6 are blocked from entering the barrel 4 by the projectile 61 already in the barrel 4. The combined force of the bolt spring 32 and the pressure behind the bolt 28 bring the bolt 28 to rest, preferably without contacting the breech cap bumper 38 at the rear of the breech 3. The breech 3, valve passage 8 rearward of the valve slider 39, and all contiguous cavities not isolated by seals within the housing 1 may here be recognized as the intermediate reservoir discussed in the background of the invention. The bolt 28 will remain approximately at rest, where its position will only adjust slightly to allow more or less gas through the bolt rest-point passage 10 as required to maintain a balance of pressure and spring forces on it while the pressure continues to increase.

Figure 18E:
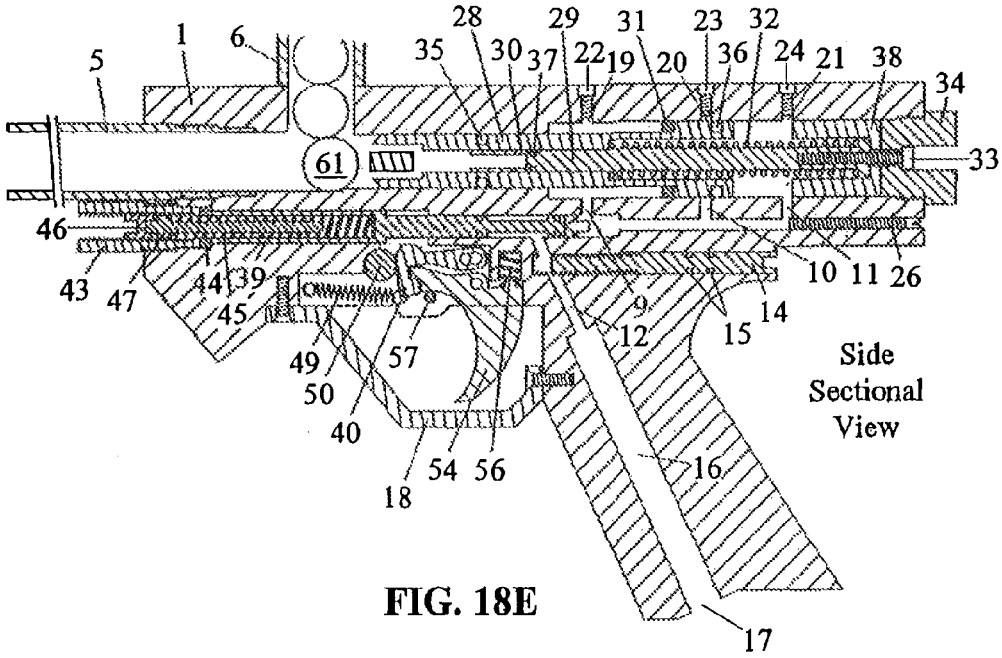

Shown in FIG. 18E, once the pressure in the valve passage 8 rearward of the valve slider 39 has increased sufficiently to overcome the force of the valve spring 45 on the valve slider 39, the valve slider 39 will be pushed forward until it contacts the valve bumper 44 if present, or valve passage cap 43 if no valve bumper 44 is present, thereby simultaneously stopping the flow of compressed gas from the source gas passage 12, and allowing the flow of gas from the region of the breech 3 ahead of the bolt rear seal 36 through the feed passage, into the valve passage 8 rearward of the valve slider 39, which is in communication with the region of the breech 3 behind the bolt 28.

Figure 18F:
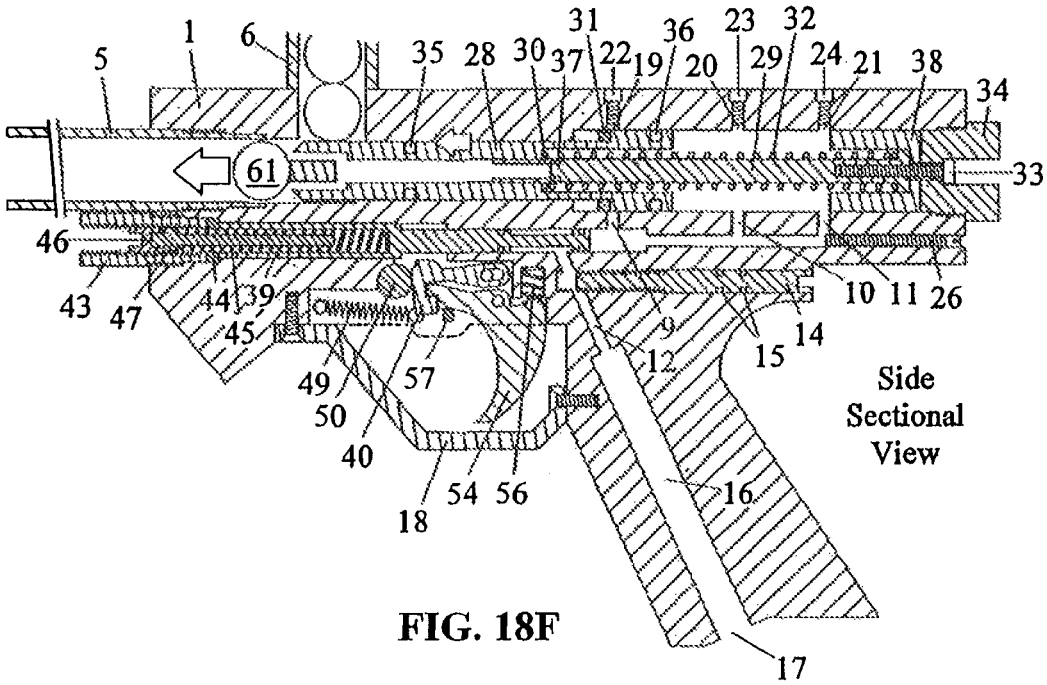

The bolt 28 is then driven forward by now unbalanced pressure and spring forces on its surface, pushing the projectile 61 forward in the barrel 4 and blocking the projectile feed passage 6, preventing the entry of additional projectiles. When the bolt 28 reaches the position shown in FIG. 18F, gas flows through the purge holes 30 in the spring guide 29, through the center of the bolt 28, and through the plurality of holes 27 on the front surface of the bolt 28, which distribute the force of the flowing gas into uniform communication with the rear surface of the projectile 61.

Figure 18G:
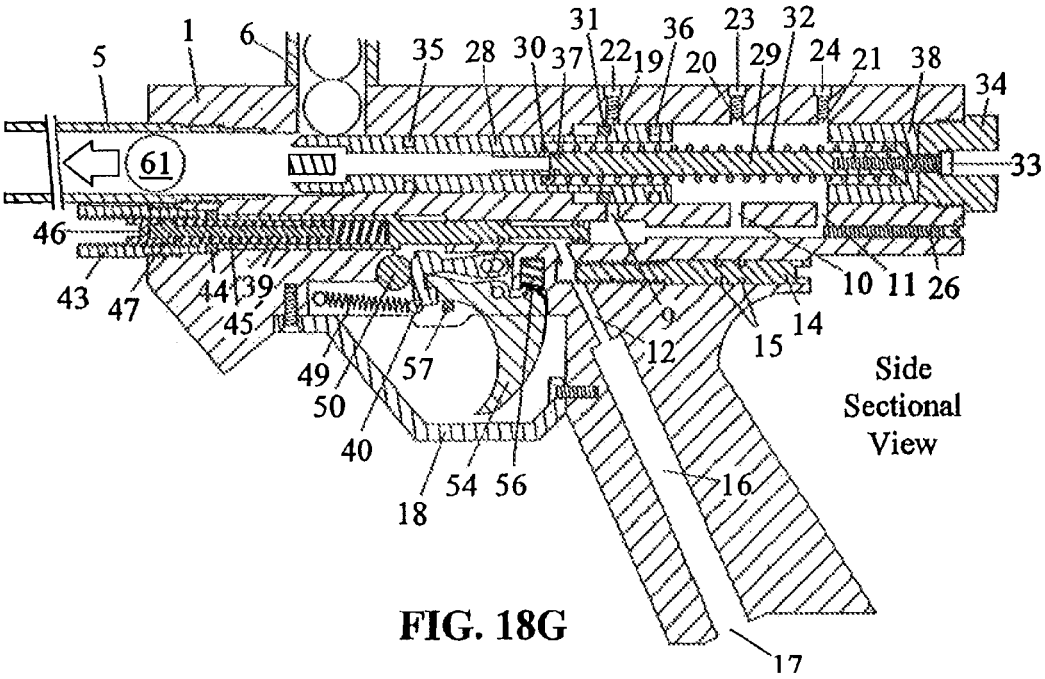
Figure 18H:
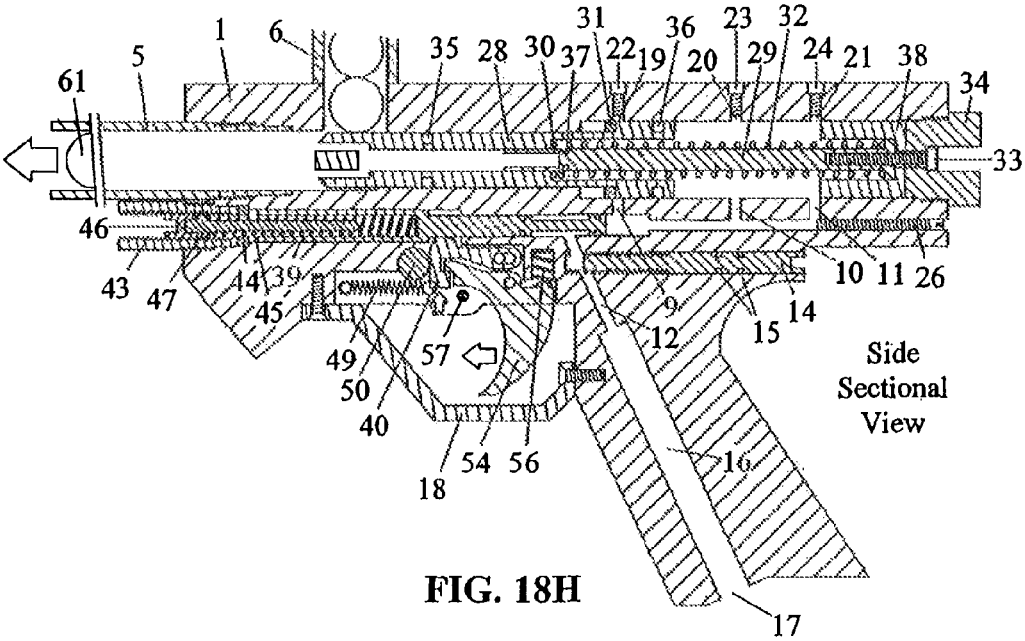

Shown in FIG. 18G and continued in FIG. 18H, the action of the gas pressure on the projectile 61 will cause it to accelerate through and out of the barrel 4 and barrel extension 5, at which time the barrel 4, barrel extension 5, breech 3, valve passage 8 rearward of the valve slider 39, and all communicating passages which are not sealed will vent to atmosphere.

When the pressure within the valve passage 8 rearward of the valve slider 39 has been reduced to sufficiently low pressure such that the force induced on the valve slider 39 no longer exceeds that of the valve spring 45, the valve slider 39 will begin to slide rearward. If the trigger 54 has not been allowed by the operator to move sufficiently far forward to allow the sear 40 to interfere with the rearward motion of the valve slider 39, the valve slider 39 will continue to move rearward as described in Step 3, and the cycle will begin to repeat, starting with Step 3. If the trigger 54 has been allowed by the operator to move sufficiently far forward to allow the sear 40 to interfere with the rearward motion of the valve slider 39, the valve slider 39 will push the sear 40 rearward into the preferred resting position and will come to rest against the sear 40 as shown in FIG. 18H, and the cycle will proceed to Step 9 below.

Under the action of the bolt spring 32, the bolt 28 will continue to move forward, compressing gas within the space ahead of the bolt rear seal 36 in so doing, and, allowing only a small gap by which the gas may escape into the valve passage 8, the bolt 28 will be decelerated, minimizing wear on the bolt bumper 31 and stopping in its preferred resting position, at which point all components will now be in their original ready-to-fire configuration, shown in FIG. 18A.

Cocking:

Whereas most compressed gas-powered projectile accelerators known to be in the art require a means of manual cocking, the compressed gas-powered projectile accelerator of the present invention will automatically cock when compressed gas, from a source mounted on any location on the housing 1 or other source, is introduced, preferably through a tube, attached to the source gas passage inlet 17. If the compressed gas-powered projectile accelerator of the present invention is un-cocked (i.e., the valve slider 39 is not resting against the sear 40, but further rearward under the action of the valve spring 45) when compressed gas is introduced through the source gas passage 12, said gas will flow through the source passage 12, valve passage 8, and gas feed passage 9 into the region of the breech 3 ahead of the bolt rear seal 36, and one of the semi-automatic or fully automatic cycles above described will ensue at Step 4, the particular cycle being determined by the position of the mode selector cam 50. The automatic cocking feature reduces potential contamination of the compressed gas-powered projectile accelerator of the present invention because said feature removes the necessity the additional perforation of the housing 1 to accommodate the connection of a means of manual cocking to internal components, which constitutes a common path by which dust and debris may enter the housing 1 of many compressed-gas powered projectile accelerators known to be in the art.

Figure 19:
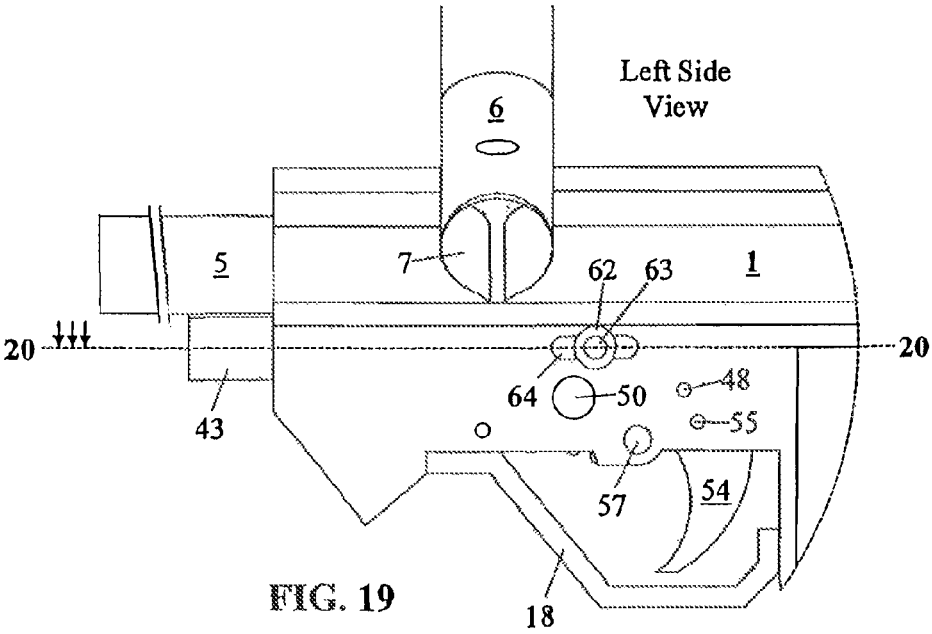
FIG. 19 is a view from the side of the front portion of a compressed gas-powered projectile accelerator made according to the present invention with the addition of a cocking knob, shown in detail.
Figure 20:
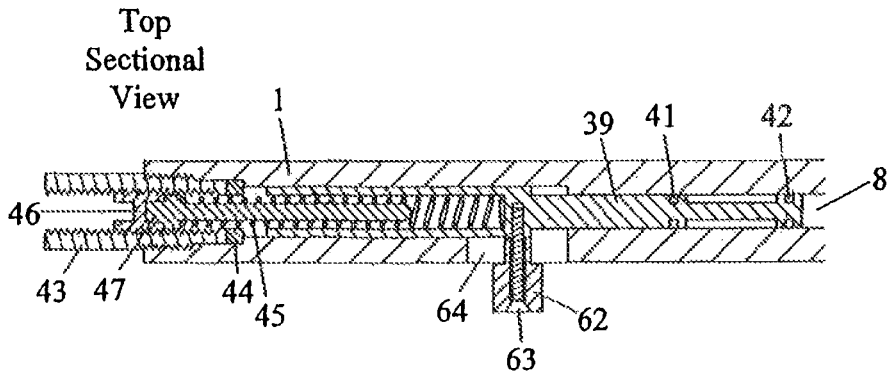
FIG. 20 is a sectional view from the top taken along line 20-20 of FIG. 19 of the front portion of a compressed gas-powered projectile accelerator made according to the present invention with the addition of a cocking knob, shown in detail.
Figure 21:
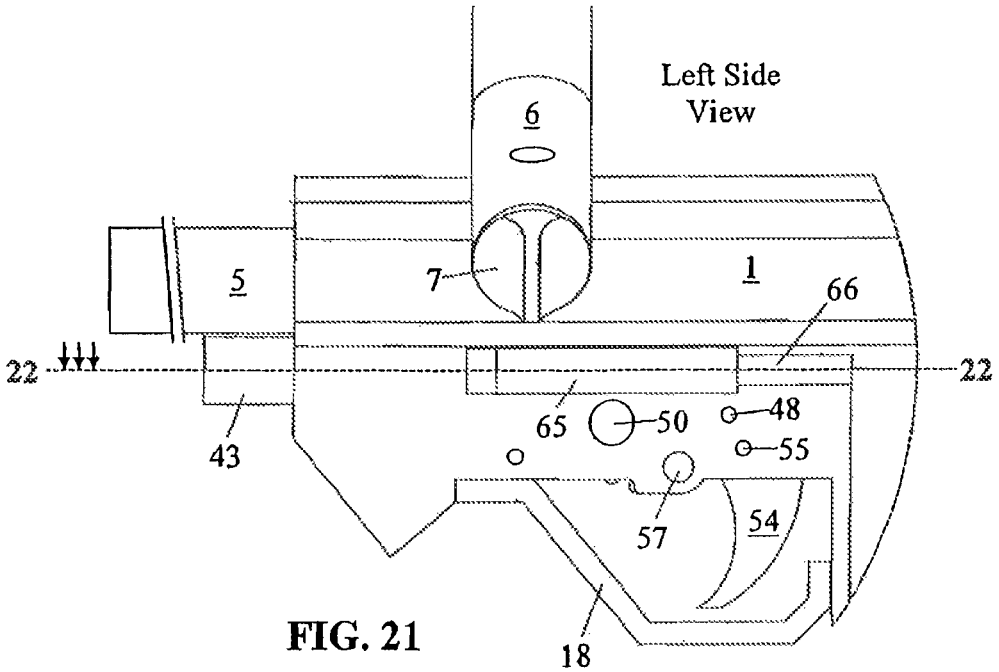
FIG. 21 is a view from the side of the front portion of a compressed gas-powered projectile accelerator made according to the present invention with the addition of a cocking manifold, slider, and spring assembly, shown in detail.
Figure 22:
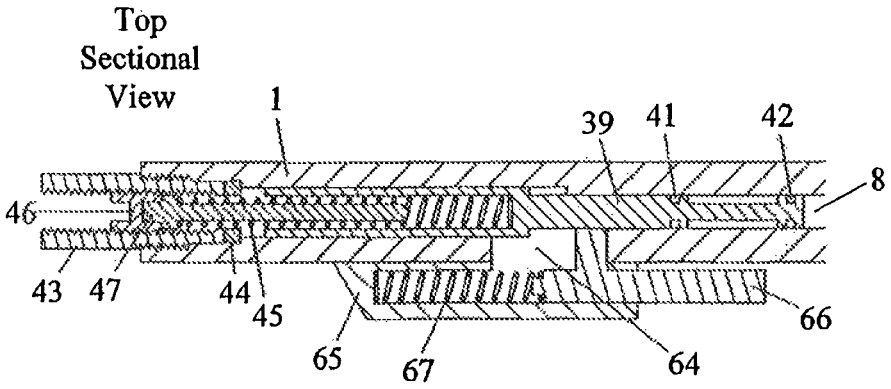
FIG. 22 is a sectional view from the top taken along line 22-22 of FIG. 21 of the front portion of a compressed gas-powered projectile accelerator made according to the present invention with the addition of a cocking manifold, slider, and spring assembly, shown in detail.

A means of manual cocking may be employed, but should be considered optional to the compressed gas-powered projectile accelerator of the present invention, as the addition of a means of manual cocking will allow the operator to bring the compressed gas-powered projectile accelerator of the present invention into a cocked state without cycling, and, more specifically, silently, without the audible report that will be associated with allowing the compressed gas-powered projectile accelerator of the present invention to automatically cock by completing a cycle. The simplest method of applying a manual cocking mechanism to the compressed gas-powered projectile accelerator of the present invention is shown in detail in FIGS. 19 and 20, where a knob 62 is attached, preferably by a screw 63, to the valve slider 39, which protrudes through a slot 64 in the housing 1. However, because the presence of the slot 64 decreases the resistance to contamination and the cocking knob 62 increases wear on the valve slider 39 by not allowing it to freely rotate with respect to points of intermittent contact with the sear 40, a preferred option is shown in FIGS. 21 and 22, where a manifold 65 attached to the housing 1 holds a cocking slider 66 which penetrates the housing 1 through a slot 64 such that the pushing forward of said cocking slider 66 will cause the valve slider 39 to move forward into a cocked position. The cocking slider manifold 65 obstructs the path of debris into the slot 64 in the housing 1. A spring 67 biases the cocking slider 66 to remain out of the path of the valve slider 39 during operation.

The two examples provided are intended to be illustrative as it is to be appreciated that there are numerous methods by which a means of manual cocking (such as the addition of any appendage to the valve slider 39 which may be manipulated from the housing 1 exterior, particularly by protrusion from the front or rear of the valve passage 8) may be incorporated into the projectile accelerator of the present invention without altering the inventive concepts and principles embodied therein.

Figure 23:
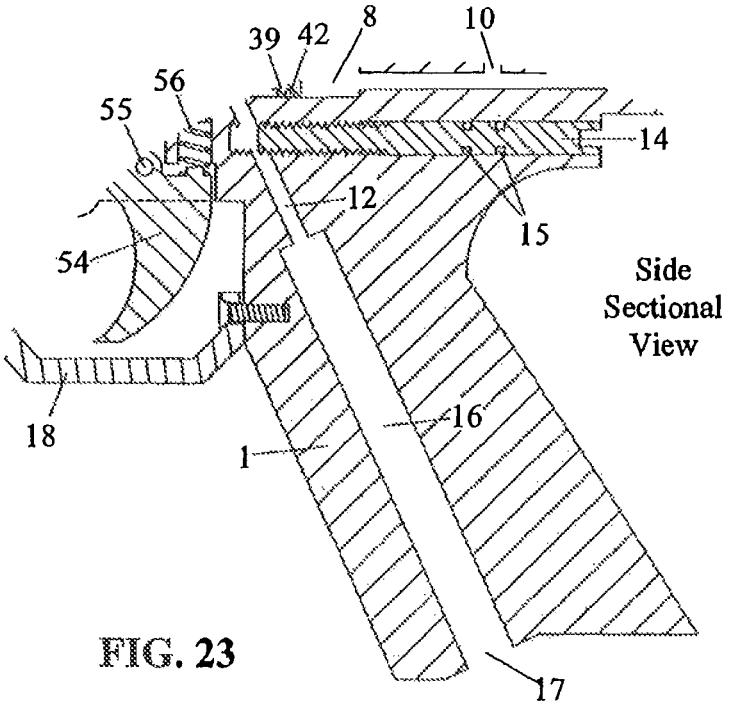
FIG. 23 is a sectional view from the side of the region identified in FIG. 8 in the vicinity of the source gas passage of a compressed gas-powered projectile accelerator made according to the present invention, shown in detail.

Expansion Chamber or Second Regulator in Source Gas Passage 12:

One distinct advantage of this preferred embodiment of the compressed gas-powered projectile accelerator of the present invention is that, because the housing 1 can preferably made from a single piece of material, a feed gas conditioning device can easily be incorporated into the housing 1, preferably inserted into the expanded section of the source gas passage 16, shown in detail in FIG. 23, whereas for compressed gas-powered projectile accelerators known to be in the art, such devices are typically contained in separate housings which are typically either screwed into or welded to the primary housing.

Figure 24:
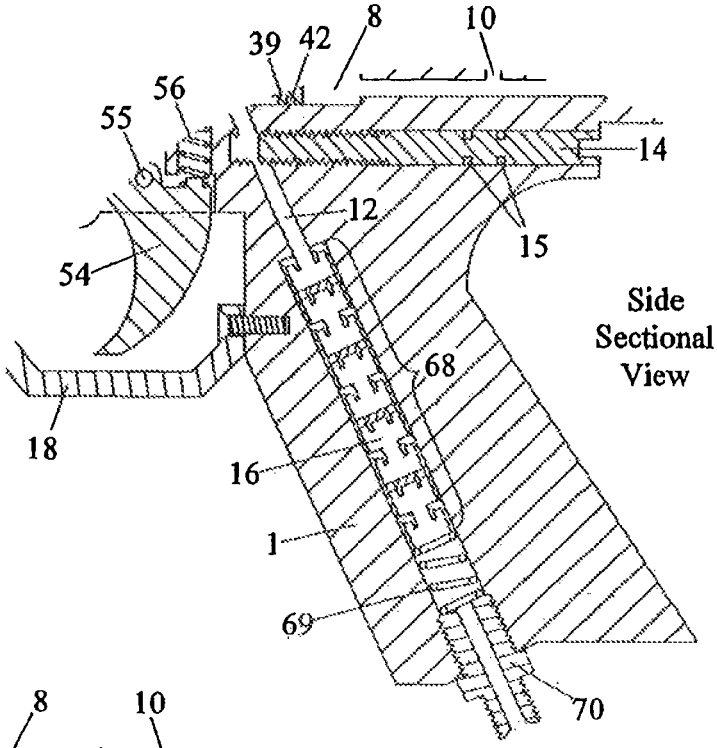
FIG. 24 is a sectional view from the side of the region in the vicinity of the source gas passage of a compressed gas-powered projectile accelerator made according to the present invention with baffle inserts inside the source gas passage, shown in detail.

In FIG. 24 the source gas passage 12 of the compressed gas-powered projectile accelerator of the present invention is shown in detail with the option of baffle inserts 68 within the expanded section of the source gas passage 16 to reduce the potential for liquid to enter the valve passage 8. A spring 69 placed between the lowest baffle insert and a fitting 70 installed at the source gas passage inlet 17 acts to retain the baffle inserts 68 in position.

Figure 25:
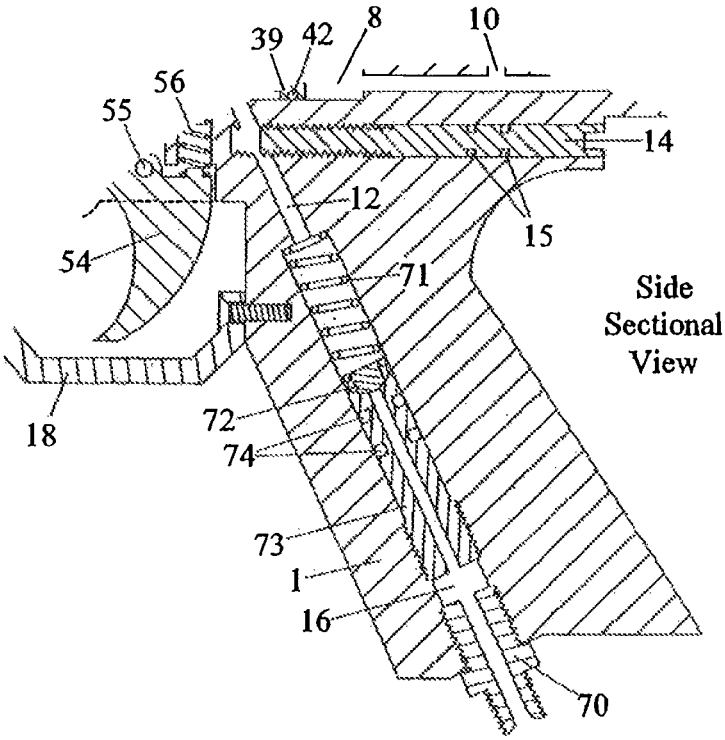
FIG. 25 is a sectional view from the side of the region in the vicinity of the source gas passage of a compressed gas-powered projectile accelerator made according to the present invention with regulator components inserted inside the source gas passage, shown in detail.
Figure 26:
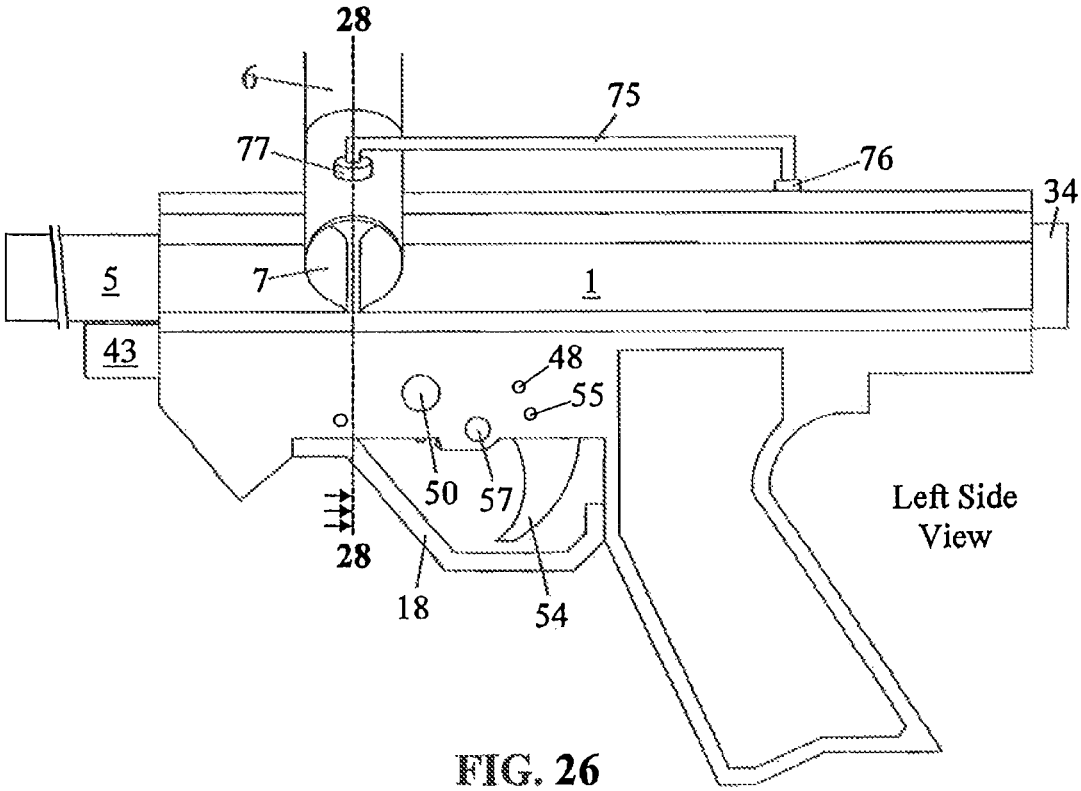
FIG. 26 is a view from the side of a compressed gas-powered projectile accelerator made according to the present invention with an pneumatically assisted feed system.
Figure 27:
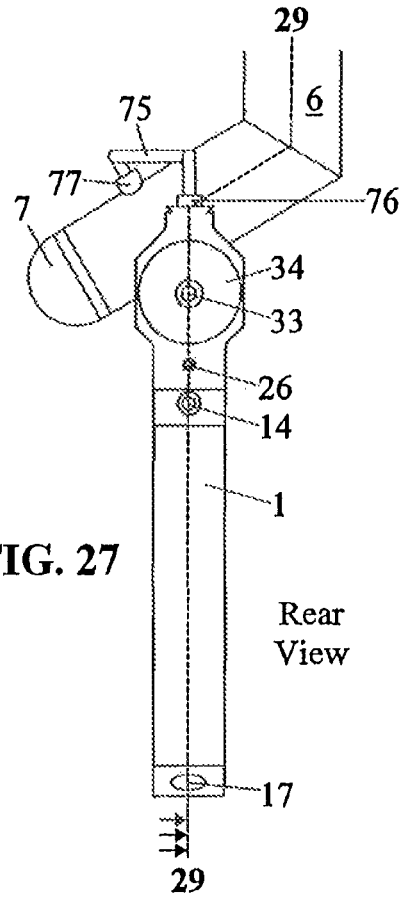
FIG. 27 is a view from the rear of a compressed gas-powered projectile accelerator made according to the present invention with a pneumatically assisted feed system.
Figure 28:
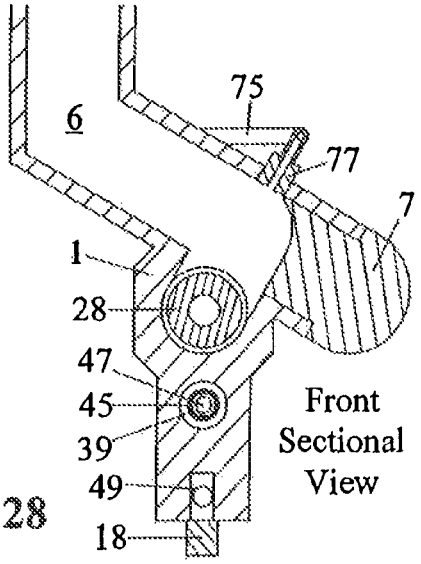
FIG. 28 is a sectional view from the front taken along line 28-28 of FIG. 26 of a compressed gas-powered projectile accelerator made according to the present invention with a pneumatically assisted feed system.
Figure 29:
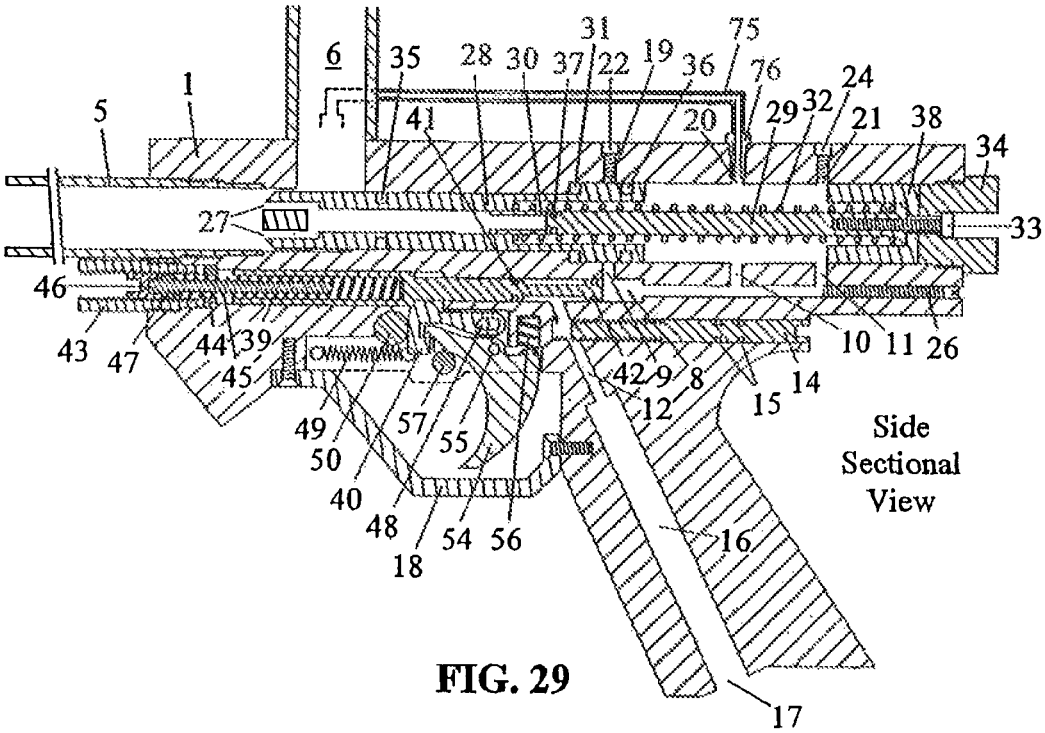
FIG. 29 is a sectional view from the side taken along line 29-29 in FIG. 27 of a compressed gas-powered projectile accelerator made according to the present invention with a pneumatically assisted feed system.

In FIG. 25 the source gas passage 12 of the compressed gas-powered projectile accelerator of the present invention is shown with the option of an additional feed gas regulator inserted into the expanded section of the source gas passage 16, where a spring 71 pushes a preferably cylindrical and preferably beveled slider 72, perforated with a plurality of holes, against a matching seat 73, which is sealed against the wall of the expanded section of the source gas passage 16 by arbitrary means, and exemplified by o-ring/groove type seals 74 in FIG. 25. The position of the seat 73 is maintained by threads engaging the wall of the expanded section of the source gas passage 16, which is correspondingly threaded, and rotation of the seat 73 (which has a hexagonally shaped groove designed to match a standard hexagonal key wrench), causing it to thread more or less deeply into the expanded section of the source gas passage 16, allows adjustment of the spring 71 tension, thereby adjusting the equilibrium downstream (spring 71 side) pressure.

Pneumatically Assisted Feed:

In FIGS. 26-29 the compressed gas-powered projectile accelerator of the present invention with the option of an added pneumatic feed-assist tube 75 which re-directs a preferably small portion of gas from the breech 3 to increase the bias of projectiles to enter the barrel 4 is shown used in conjunction with a gravitationally induced bias. The pneumatic feed-assist tube 75 can increase the rate of entry of projectiles into the barrel 4, allowing the cycle to be adjusted to higher rates than is possible without the addition of said pneumatic feed-assist tube 75. The pneumatic feed-assist tube 75 may be attached in such a way to communicate with any point in any passage within the compressed gas-powered projectile accelerator of the present invention, the shown preferred position being exemplary, and may optionally be incorporated as an additional passage within the housing. The amount of gas which is redirected can be metered by the internal cross-sectional area of the pneumatic feed-assist tube 75 and/or connecting fittings 76, 77, and/or by optional adjustable valving integrated into the pneumatic feed-assist tube 75 and/or connecting fittings 76, 77 (not shown for clarity).

Alternate Bolt Resting Positions:

While the preferred embodiment of the compressed gas-powered projectile accelerator of the present invention has been shown depicting the preferred resting position of the bolt 28 in its most forward travel position because this takes advantage of the bolt 28 to prevent the entry of more than one projectile into the barrel 4 between cycles, it is to be appreciated that small changes in the configuration of the bolt 28, bumpers 31, 38, and bolt spring 32 can cause the bolt 28 to rest in a different location between cycles without changing the basic operation of the compressed gas-powered projectile accelerator of the present invention. If the bolt spring 32 is placed in front of the larger diameter section of the bolt 28, instead of behind as in FIG. 3, the bolt 28 will be biased to rest against the breech cap bumper 38 at the rear of the breech 3 between cycles. Alternatively, a combination of springs, one ahead and one behind the larger diameter section of the bolt 28, may be used to bias the bolt 28 toward any resting position between cycles, depending on the length and relative stiffness of the two springs. Changes in the resting position of the bolt 28 will alter the initial motion of the bolt 28 which in all cases will move the bolt 28 toward the position described in Step 4 of both the semi-automatic and fully-automatic cycle descriptions with the bolt rear seal 36 just behind the front edge of the bolt rest-point passage 10. Correspondingly, at the end of the last cycle, the bolt 28 will return to the altered rest position rather than the rest position described in the preferred embodiment. In all other respects, both semi-automatic and fully-automatic operation will be identical to as above described. If the bolt 28 is retained at rest in a position that does not prevent projectiles from entering the barrel 4 between cycles, some provision must be included to prevent projectiles from prematurely moving down the barrel 4. This may be accomplished frictionally, by a close fit of projectiles to the barrel 4 diameter, or by the addition of a conventional spring biased retention device which physically blocks premature forward motion of projectiles in the barrel 4.

Figure 30:
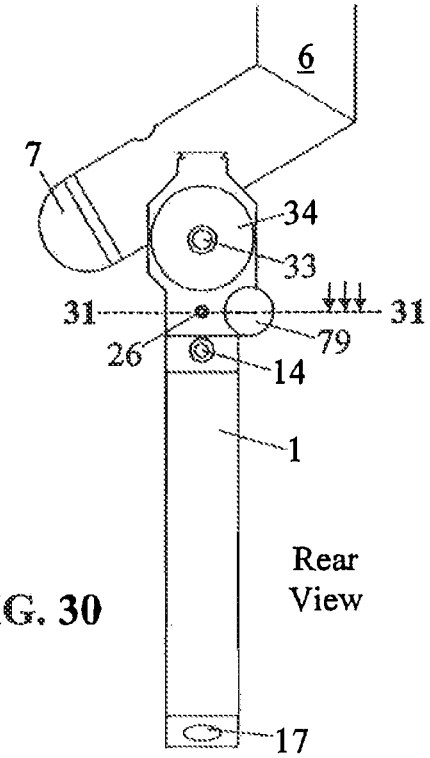
FIG. 30 is a view from the rear of a compressed gas-powered projectile accelerator made according to the present invention with a variable volume chamber connected to the valve passage.
Figure 31:
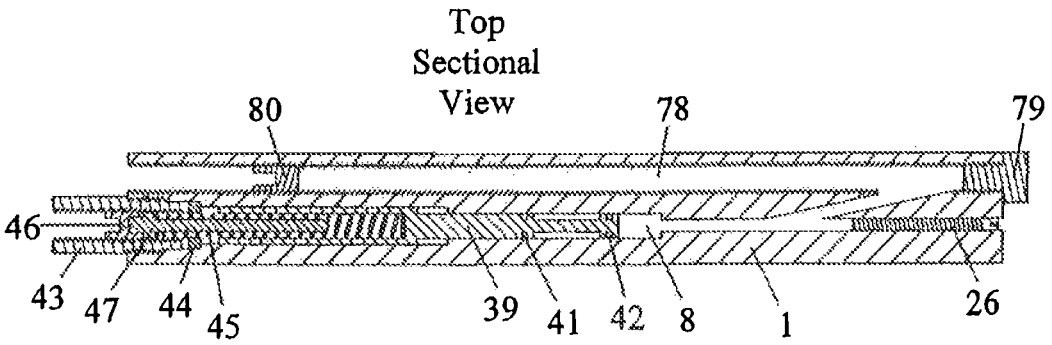
FIG. 31 is a sectional view from the top taken along line 31-31 of FIG. 30 of a compressed gas-powered projectile accelerator made according to the present invention with a variable volume chamber connected to the valve passage.

Additional Cavities:

It is to be appreciated that the operating characteristics of the compressed gas-powered projectile accelerator of the present invention may be altered by the addition of supplementary cavities, either within the housing or attachments made to the housing, contiguous in any place with any of the internal passages of the apparatus without altering the inventive concepts and principles embodied therein. These cavities may be of fixed or variable volume. (Operating characteristics can be altered by changing the cavity volume.) An example of a compressed gas-powered projectile accelerator made according to the present invention with the addition of a variable volume is illustrated in FIGS. 30 and 31, where a threaded passage 78, parallel and connected to the valve passage 8, is closed at the rear by a threaded plug 79, and at the front by a screw 80, the position of which may be adjusted within the threaded passage 78 to vary the volume. In particular, the threaded passage 78 as shown in FIGS. 30 and 31 may be connected to the valve passage 8, as shown, or, alternatively, to the gas feed passage 9, so that the gas volume may be varied in order to change the amount of acceleration applied to projectiles in lieu of, or in addition to, other means to control the same, already and to be further described.

Figure 32:
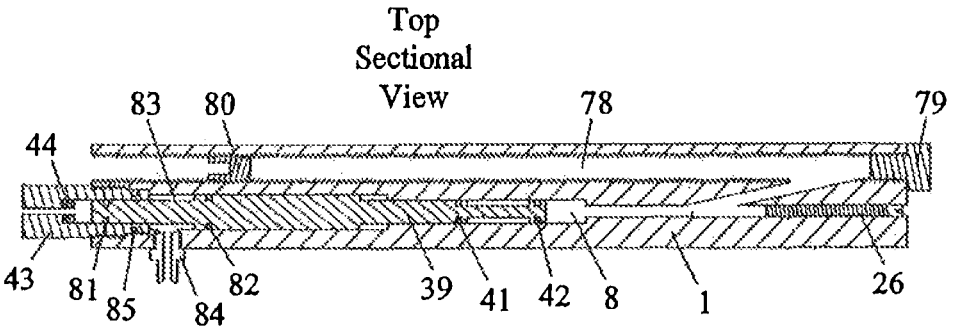
FIG. 32 is a sectional view from the top of a compressed gas-powered projectile accelerator made according to the present invention with a variable volume chamber connected to the valve passage and with the valve slider spring replaced by a pneumatic piston.

Pneumatic Valve Slider Bias:

It is to be appreciated that the operating characteristics of the compressed gas-powered projectile accelerator of the present invention may be altered such that the bias of the valve slider 39 is induced by the pressure of compressed gas, rather than by a valve spring 45, without altering the inventive concepts and principles embodied therein, as shown in FIG. 32, where the compressed gas-powered projectile accelerator made according to the present invention is shown in FIG. 31 with the valve spring 45 omitted and the valve slider 39 geometry modified with an extension and pair of preferably o-ring type seals 81, 82 to allow the valve slider 39 to be pneumatically biased to move rearward when compressed gas is introduced into the volume 83 between the seals 81, 82. FIG. 32 depicts gas communication into this volume 83 to be through a fitting 84 threaded into a hole through the housing 1 as an example, but the routing of gas, preferably from the source connected to the source gas passage 12, is arbitrary. The changes in the valve slider 39 geometry allow the valve slider bumper 44 to be placed inside the valve passage cap 43, which is shown with a preferable o-ring type seal 85 to prevent gas leakage. Projectile velocity may be controlled either by regulation by arbitrary means (e.g., by a regulator within the expanded portion of the gas feed passage 16, previously described, provided the gas is tapped downstream of the regulator) of the pressure in the volume 83 between of the valve slider seals 81, 82, or by an adjustable volume, as previously described. Operation is as previously described except that the bias for the valve slider 39 to move rearward is provided by the pressure of gas within the volume 83 between of the valve slider seals 81, 82 rather than by a spring.

Figure 33:
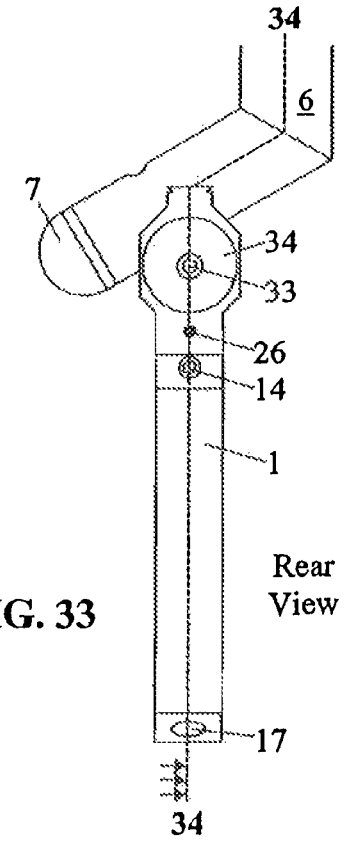
FIG. 33 is a view from the rear of an electronic compressed gas-powered projectile accelerator made according to the present invention.
Figure 34:
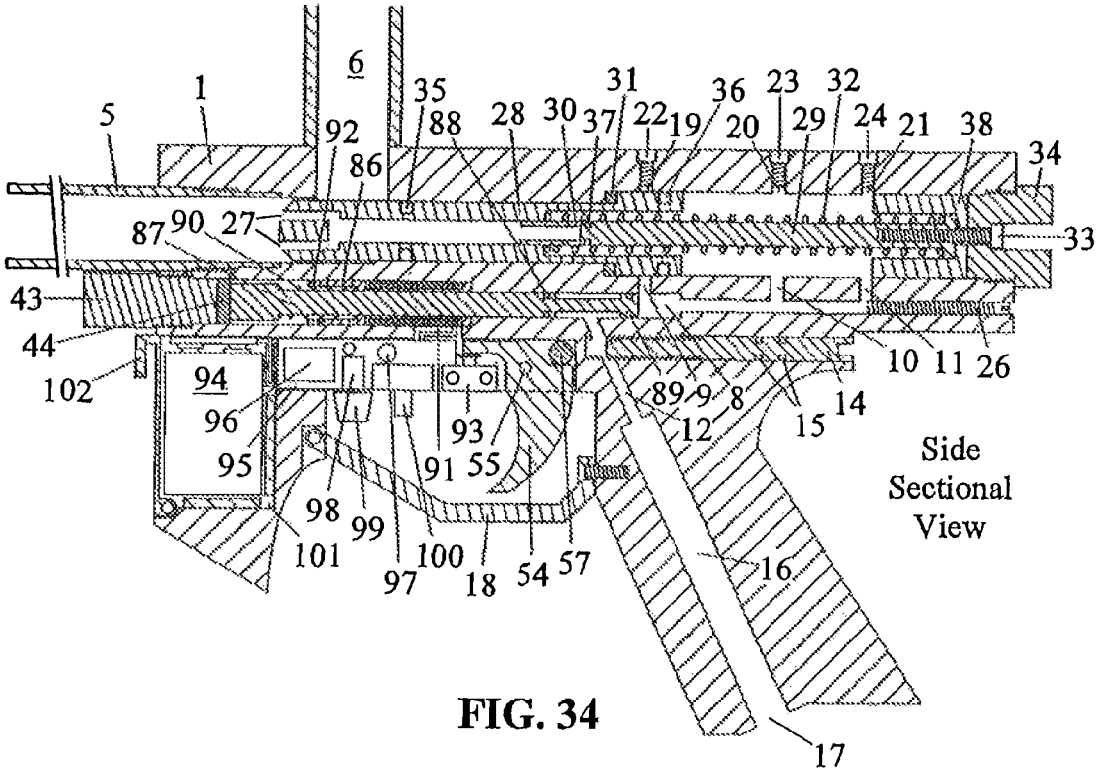
FIG. 34 is a sectional view from the side taken along line 34-34 of FIG. 33 of an electronic compressed gas-powered projectile accelerator made according to the present invention.

Electronic Embodiment of the Compressed Gas-Powered Projectile Accelerator of the Present Invention:

It is to be appreciated that the operating characteristics of the compressed gas-powered projectile accelerator of the present invention may be altered by the replacement of the valve and internal trigger mechanism components shown in the non-electronic preferred embodiment with electronic components without altering the inventive concepts and principles embodied therein, as shown in FIGS. 33 and 34. In FIG. 34, the valve and internal trigger mechanism components are shown replaced by a spring biased (toward the closed position) solenoid valve, consisting of a valve body 86, valve slider 87 with seals 88, 89 (similar to the valve slider 39 in the non-electronic preferred embodiment), spring 90, coil 91, and bumper 92; electronic switch 93; battery 94 (or other power source); and control circuit 95; where the opening force applied to the solenoid valve slider 87 by the coil 91 when energized by the control circuit 95 can be designed such that the pressure within the valve passage 8 rearward of the solenoid valve slider 87 will force the valve into the un-actuated position at the design set pressure, thus simultaneously terminating flow from the source gas passage 12 into the region of the breech 3 ahead of the larger diameter section of the bolt 28 and initiating flow from said region within the breech 3 ahead of the larger diameter section of the bolt 28 into the valve passage 8 rearward of the solenoid valve slider 87 and into the region of the breech 3 behind the bolt 28, simulating the behavior of the mechanical system already described. The set pressure can be adjusted by adjusting the current in the solenoid valve coil 91, thereby adjusting the projectile acceleration rate. Because velocity control is electronic, no velocity adjustment screw 46 need be incorporated into the valve passage cap 43, and the valve passage cap 43 and corresponding bumper 44 need not be hollow. The control circuit 95, preferably consists of an integrated circuit 96 which performs the cycle control logic, an amplifier 97, a means of controlling valve coil 91 current, e.g. a variable resistor 98 with a "velocity control dial" 99 protruding to the exterior, and a multi-position switch 100 which can be used to disable the trigger 54 (one switch position), or select between semi-automatic (second switch position) and fully-automatic (third switch position) operation when the trigger 54 is pulled. With the exception of components replaced by the electronic control circuit 95 and solenoid valve components 86, 87, 88, 89, 90, 91, 92, operation is identical to the non-electronic preferred embodiment (where the solenoid valve slider 87 performs the same role as the valve slider 39 in the non-electronic preferred embodiment). The battery 94 is shown preferably contained within a padded compartment 101 in the housing 1 with a preferably hinged door 102 to allow replacement. An optional mechanical safety cam 57, identical to that employed on the non-electronic preferred embodiment of the compressed gas-powered projectile accelerator of the present invention, but differently located, is also shown in FIG. 34.

Figure 35:
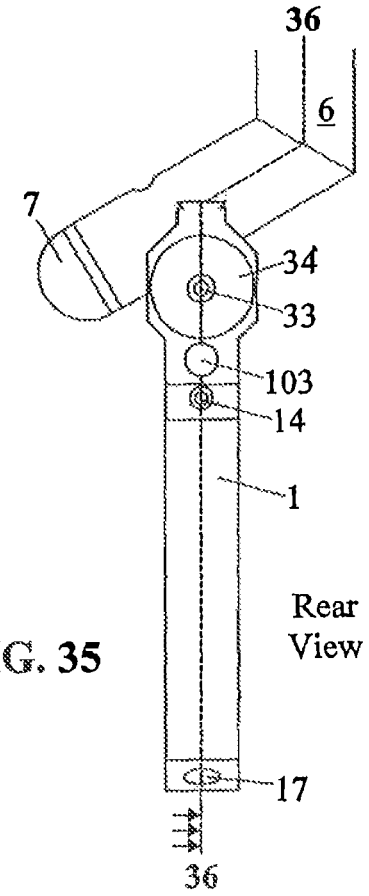
FIG. 35 is a view from the rear of an electronic compressed gas-powered projectile accelerator made according to the present invention with a pressure transducer connected to the rear of the valve passage.
Figure 36:
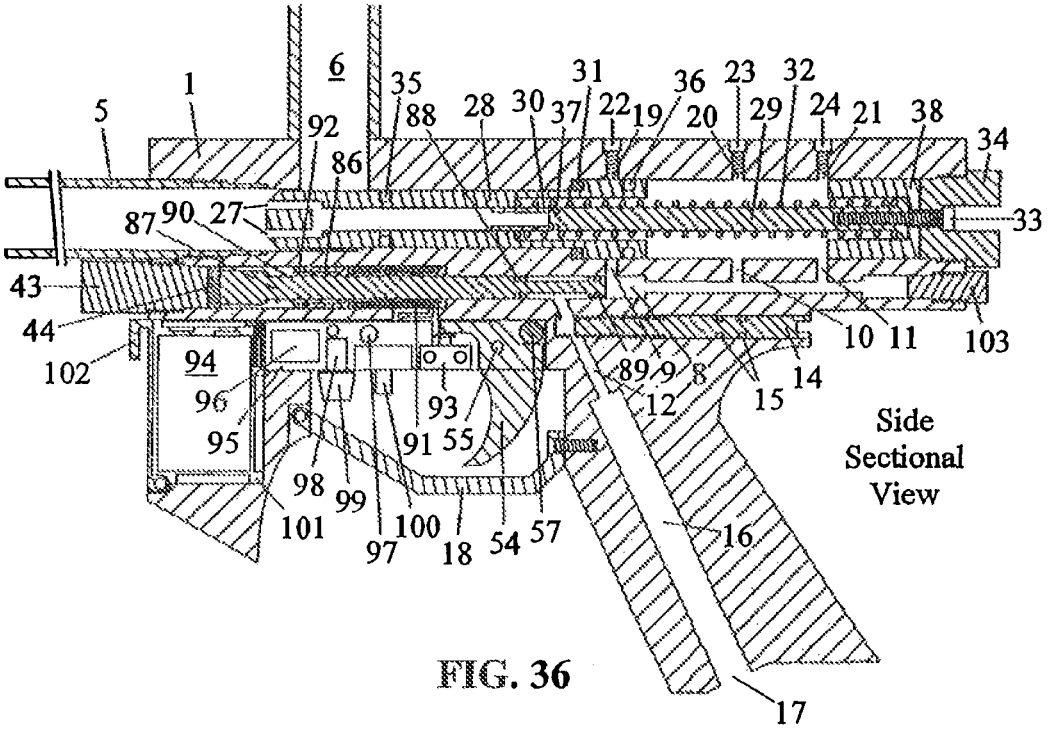
FIG. 36 is a sectional view from the side taken along line 36-36 of FIG. 35 of an electronic compressed gas-powered projectile accelerator made according to the present invention with a pressure transducer connected to the rear of the valve passage.

Alternatively, rather than relying upon the mechanical action of pressure within the valve passage 8 rearward of the solenoid valve slider 87 to push the solenoid valve slider 87 into the closed position, the solenoid valve coil 91 can be de-energized when the set pressure is reached, which can be determined based on timing, or by a signal supplied to the control circuit 95 by a pressure transducer 103 (or other electronic pressure sensor), which can be positioned in communication with the gas behind the solenoid valve slider 87 or in the breech 3 either ahead of or behind the largest diameter section of the bolt 28 (i.e. the intermediate reservoir), as shown in FIGS. 35 and 36, (through wires connecting the pressure sensor 103 to the control circuit 95, the geometry of which are arbitrary and not shown in the Figures for clarity). In these cases, the velocity control dial 99 does not adjust the solenoid valve coil 91 current, but rather the timing, in the case of a timed circuit, or either the signal level from the pressure sensor 103 at which the control circuit 95 de-actuates the solenoid valve coil 91 or the said pressure sensor 103 signal, thereby accomplishing the same effect.

It is also to be appreciated that additional, optional controls can be incorporated into the control circuit 95 of the preferred electronic embodiment of the compressed gas-powered projectile accelerator of the present invention without altering the inventive concepts and principles embodied therein, such as additional switch 100 positions controlling additional operating modes where the projectile accelerator accelerates finite numbers of projectiles, greater than one, generally known as "burst modes" when the trigger 54 is pulled, as compared to semi-automatic operation, where a single projectile is accelerated per trigger 54 pull, and fully-automatic operation, where projectile acceleration cycles continue successively as long as the trigger 54 remains pulled rearward. Additionally, the timing between cycles can be electronically controlled, and said timing can be made adjustable by the inclusion of an additional control dial in the control circuit 95.

Figure 37:
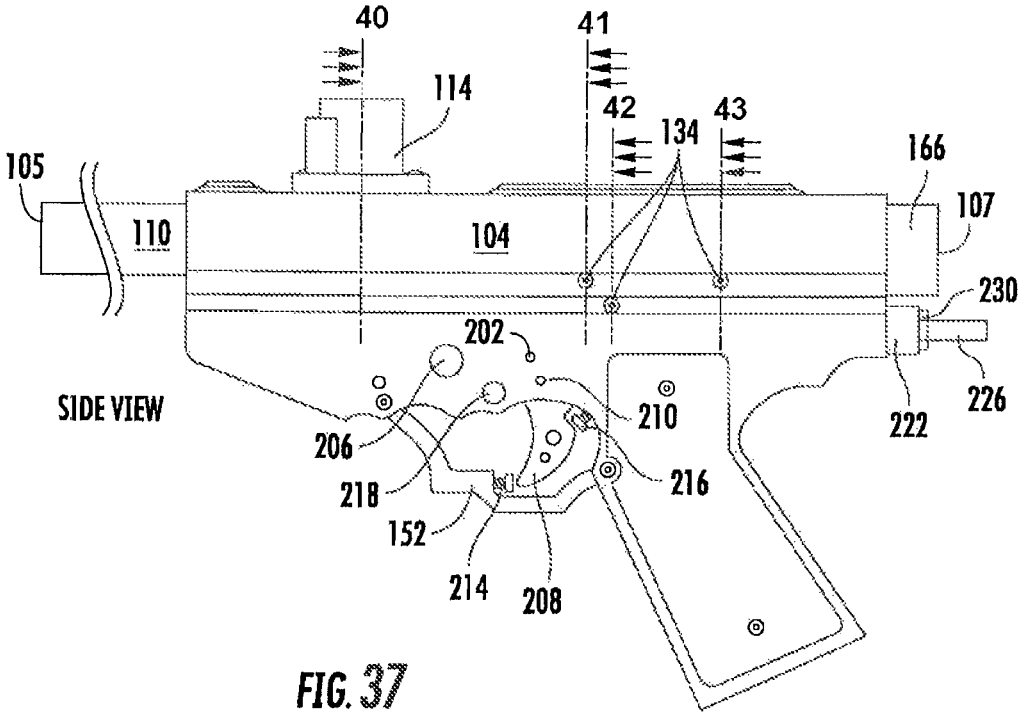
FIG. 37 is a view from the side of an additional embodiment of the compressed gas-powered projectile accelerator of the present invention.
Figure 38:
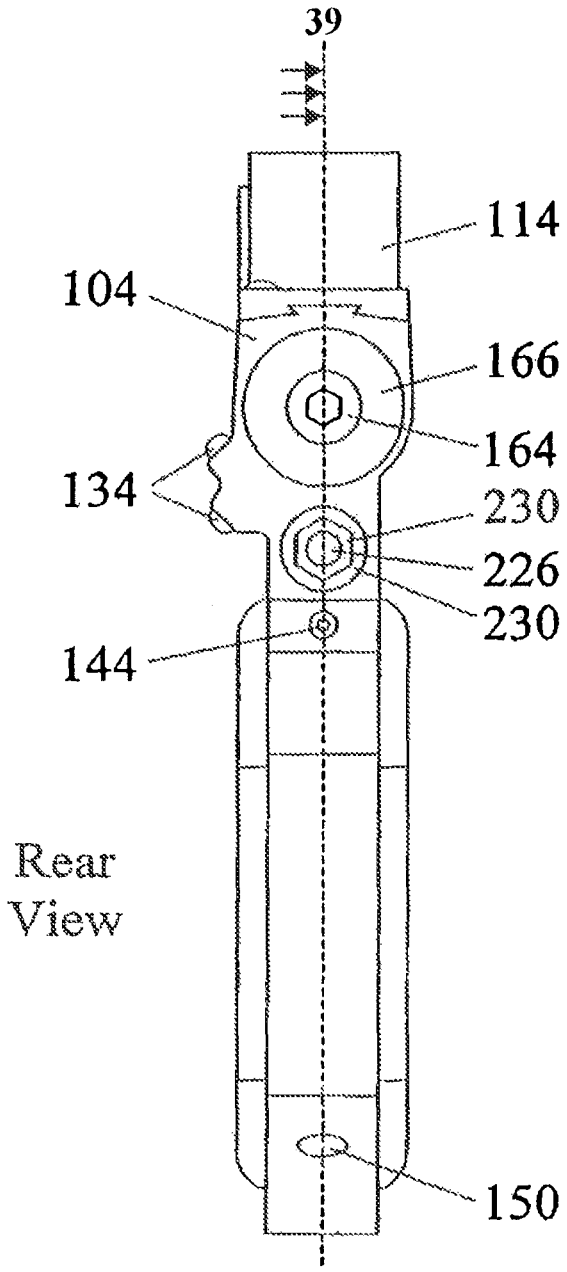
FIG. 38 is a view from the rear of the compressed gas-powered projectile accelerator of the present invention shown in FIG. 37.
Figure 39:
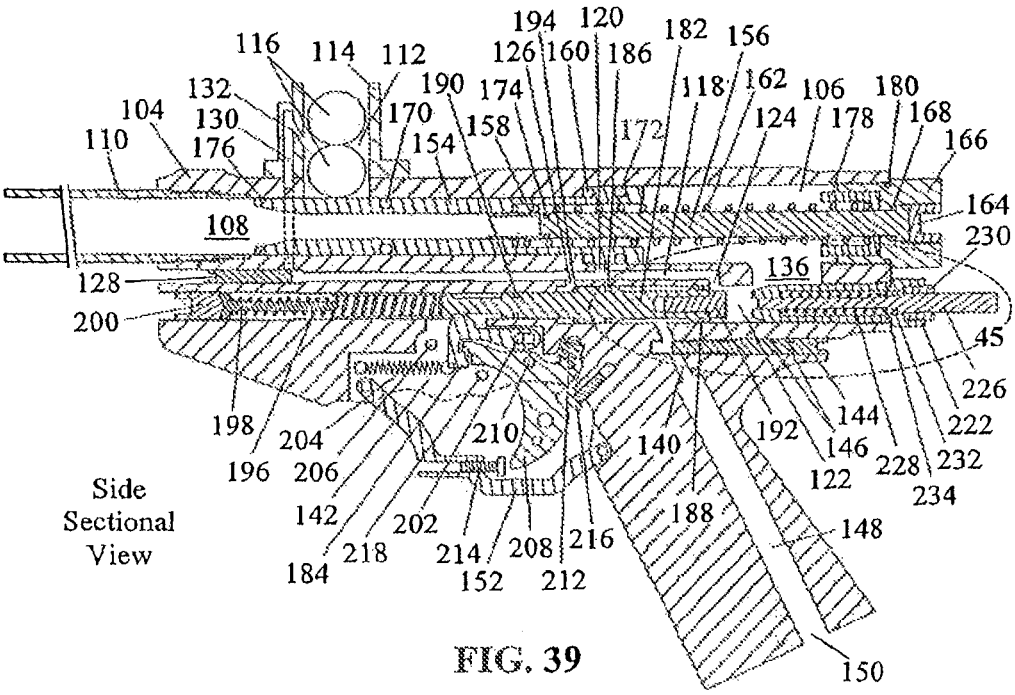
FIG. 39 is a sectional view from the side taken along line 3-3 of FIG. 38 of a compressed gas-powered projectile accelerator made with improvements of the present invention.

In another embodiment of the present invention, shown in FIGS. 37, 38 and 39, a housing 104 has a forward end 105 shown to the left in the Figures and a rear end 107 shown to the right in the Figures. A preferably cylindrical passage forms a breech 106 contiguous with a barrel 108. The breech may have a narrow diameter forward portion adjacent the forward end of the housing, and an expanded diameter rear portion adjacent the rear end of the housing, as shown in FIG. 39.

Figure 40:
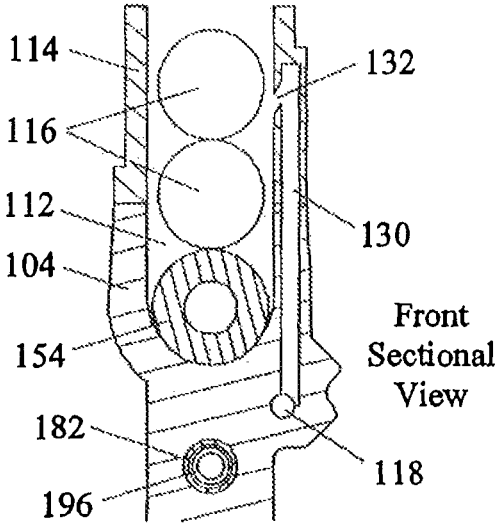
FIG. 40 is a sectional view from the front taken along line 40 of FIG. 37 of a compressed gas-powered projectile accelerator made with improvements of the present invention in the vicinity of the intersection of the feed-assist shaft and gas distribution shaft, shown to advantage.
Figure 41:
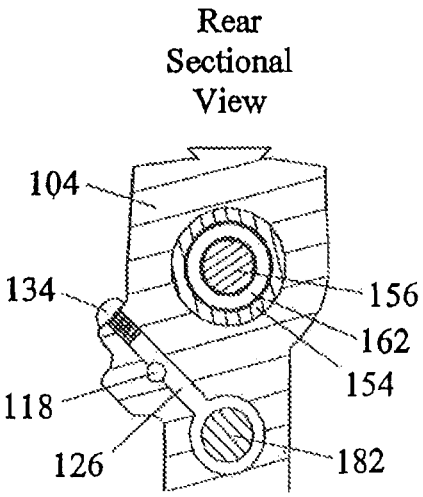
FIG. 41 is a sectional view from the rear taken along line 41 of FIG. 37 of a compressed gas-powered projectile accelerator made with improvements of the present invention in the vicinity of the valve locking shaft, shown to advantage.
Figure 42:
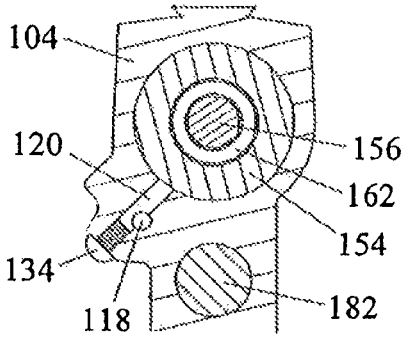
FIG. 42 is a sectional view from the rear taken along line 42 of FIG. 37 of a compressed gas-powered projectile accelerator made with improvements of the present invention in the vicinity of the upper gas feed passage, shown to advantage.
Figure 43:
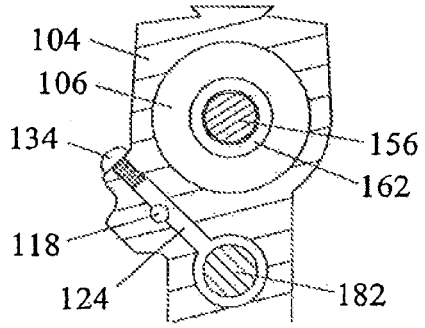
FIG. 43 is a sectional view from the rear taken along line 43 of FIG. 37 of a compressed gas-powered projectile accelerator made with improvements of the present invention in the vicinity of the lower gas feed passage, shown to advantage.

The barrel 108 may be extended by the addition of a barrel extension 110, which is preferably a tubular member threaded or otherwise attached into/onto barrel 108 at the front of the housing 104. The barrel 108 is in communication with a projectile feed passage 112, which may be defined in part by a projectile feed manifold 114 and further extending within the housing 104. Projectiles 116 are introduced into the breech 106 via the projectile feed passage 112. The projectile feed passage 112 may meet the barrel 108 at any angle whereby projectiles 116 can enter the breech 106, but preferably is at least partially vertically oriented with respect to the housing to take advantage of gravity to bias the projectiles 116 into the barrel 108. A means other than gravity may be employed to bias the projectiles into the housing, such as a spring mechanism. The projectile feed passage 112 may be connected such that its center axis intersects the center axis of the barrel 108, as shown in FIG. 40, or the projectile feed passage 112 center axis can be offset from the center axis of the barrel 108, as long as the intersection forms a hole sufficiently sized for the passage of projectiles 116 from the projectile feed passage 112 into the barrel 108.

Figure 3:
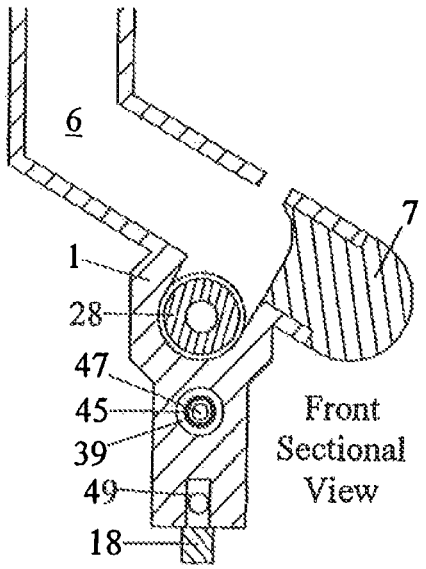
FIG. 3 is a sectional view from the front of a compressed gas-powered projectile accelerator made according to the present invention, taken along line 3-3 of FIG. 1.

Preferably parallel to the barrel 108 and breech 106 is a preferably cylindrical gas distribution passage 118, in communication with the breech 120 via an upper gas feed passage 120, and further in communication with a preferably cylindrical valve passage 122 by a lower gas feed passage 124 and valve locking shaft 126. The gas distribution passage 118 may be closed at the front of the housing 104 by a plug, or, as shown in FIGS. 3 and 4, by a throttling screw 128 optionally incorporating an o-ring/groove type seal around its outer edge (not shown).

A feed-assist shaft 130 extends upwardly into the projectile feed manifold 134, and connects with a feed-assist jet 132. Alternatively, the feed-assist shaft 130 can also be connected to the feed-assist jet 132 by a tube 138 routed externally to the projectile feed manifold 134. The throttling screw 128 controls gas flow between the gas distribution passage 118 and the feed assist shaft 130. More particularly, the degree to which the throttling screw 130 partially or completely blocks the intersection of a vertical feed-assist shaft 130 and the gas distribution passage 118 is dependent upon the depth to which the throttling screw 128 has been threaded into the gas distribution passage 118. Of course, if there is no desire to use the gas from the gas distribution passage 118 to assist feeding projectiles 116, the throttling screw 128, feed-assist shaft 130 and feed-assist jet 132 may be removed.

The gas distribution passage 118, feed-assist shaft 130, and feed-assist jet 132 are shown in the same plane as the barrel 108, breech 106, and valve passage 122 centerlines in FIG. 39 for simplicity of interpretation. However, it is preferred that these components be positioned away from the centerline of the housing 104 to facilitate a more compact arrangement and simplify the intersection of the feed-assist shaft 130 with the gas distribution passage 118 and feed-assist jet 132, by providing an envelope for a straight vertical path beside the barrel 108, as illustrated in FIGS. 40-43. This simplifies the manufacture of the connecting passages 124, 128, 130, as shown in FIG. 40, FIG. 41, FIG. 42, and FIG. 43, where the connecting passages 124, 128, 130 are shown drilled from the side of the housing 104 through test ports closed with plugs 134. The test ports closed with plugs 134 are optional because they are not required for correct function of the compressed gas-powered projectile accelerator, and may be eliminated from the design by a variety of means, such as closure by welding, use of special tooling to allow manufacture from the interior, etc.

Figure 44:
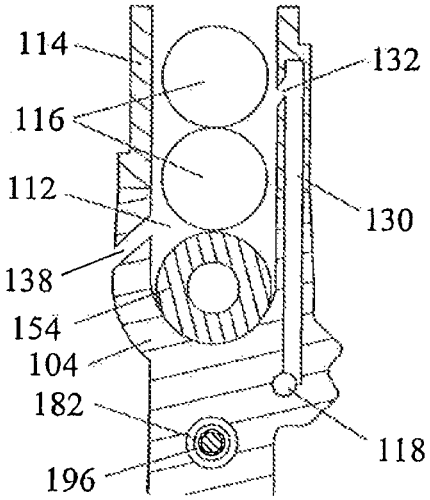
FIG. 44 is a sectional view from the front of a compressed gas-powered projectile accelerator made with improvements of the present invention in the vicinity of the intersection of the feed-assist shaft and gas distribution shaft showing an optional feed gas vent on one side of the barrel, shown to advantage.

Also for ease of understanding, the gas distribution passage 118 is not depicted extending to the rear of the housing 104 in FIG. 39. However, for manufacturing simplicity, provided that it is staggered so as to not intersect the bolt rest-point slot, discussed in further detail below, the gas distribution passage 118 may extend to the rear of the housing 104 and be either closed by a simple plug or a throttling screw applied to the intersection with the lower gas feed passage 124 in similar fashion to the intersection with the feed-assist shaft 130. The inclusion of one (as shown) or more optional ports 142 to vent feed-assist jet 132 gas once a projectile 116 is in the barrel 108 is illustrated in FIG. 44.

The valve passage 122 is also in communication with the breech 106 via a bolt rest-point slot 136. A source gas passage 140 is also in communication with the bolt rest-point slot 136. A trigger cavity 142 may also be in communication with the bolt rest-point slot 136. The trigger cavity 142 is perforated in several places to allow extension of control components to the exterior of the housing 104.

The source gas passage 140 is preferably valved, such as by means of a screw 144, the degree to which partially or completely blocks the source gas passage 140 depending upon the depth to which the screw 144 is threaded into the housing 104 so as to intersect the source gas passage 140. Alternatively, the lower gas feed passage 124 or upper gas feed passage 120, may be similarly valved instead of, or in addition to, the source gas passage 140 to control flow both between the source gas passage 140 and breech 106, and between the source gas passage 140 and valve passage 122. The screw 144 should form a seal with the hole in which it sits, preferably by the use of one or more o-rings in grooves 146.

The source gas passage 140 may include an expanded section 148 to minimize liquid entry and maximize consistency of entering gas by acting as a plenum. Gas is introduced through the source gas passage inlet 150 at the base of the housing 104, which may be designed to accept any high pressure fitting. A gas cylinder acting as a source of compressed gas (not shown), may be mounted to the housing 104, preferably to the base of the housing 104 in front of the optional trigger guard 152 illustrated in FIG. 39. Alternately, the gas cylinder may be mounted to the rear of the source gas passage inlet 150, and/or may be connected to said inlet 150 through a flexible high pressure hose. The source gas passage 140 is depicted as integrated into the lower rear part of the housing 104 to facilitate manufacture of the housing 104 from a single piece of material. However, it should be appreciated that any configurations of the source gas passage 140, whether within the housing 104 or as an attachment to the housing 104, may be substituted for the illustrated embodiment.

A hollow slider or bolt 154 is slidably disposed within the barrel. The bolt 154 preferably has a cylindrical shape that substantially mates with the cylindrical shape of the barrel 108. The bolt 154 is preferably rotatable within the barrel 108 and breech to minimize wear, and is preferably formed from a single piece. The bolt 154 is slidable within the barrel 108 and breech 106 between a forward or first position and a rearward or second position. The bolt 154 has an aperture therethrough for allowing the passage of gas. The bolt 154 may be adapted to move coaxially about a preferably cylindrical spring guide 156 which may be extended within the aperture of the bolt 154. The spring guide 156 has a hollow space at the forward end communicating with at least one or, as shown, a plurality of purge holes 158 about its circumference. A preferably resilient bolt bumper 160 is attached to the bolt 154 at a point where the bolt 154 changes diameter and meets a narrowed portion of the housing, limiting the bolts 154 forward travel and easing shock in the event of malfunction. The bolt bumper may be an o-ring as shown which acts both as a bumper and as a seal between the bolt 154 and the walls of the breech 106.

A bolt spring 162 surrounds the spring guide 156. The spring guide 156 is mounted to a removable breech cap 166. As illustrated, the spring guide 156 may be held in place by a cylindrical cavity in the cap 166 by means of a step in its diameter, and trapped by a screw 164. A spring guide bumper 168, such as an o-ring, may be placed between the end of spring guide 156 and the breech cap 166.

The bolt 154 and spring guide 156 are shown with o-ring/groove type gas seals 170, 172, 174, to prevent leakage. However, various types of seals may be substituted for the illustrated o-rings. Optionally, an additional o-ring/groove type gas seal 176 may be placed at the front tip of the bolt 154. A cylindrical resilient bumper 178 which may be mounted between the bolt 154 and breech cap 166, partially surrounding the bolt 154 and spring guide 156, to protect the bolt 154 and breech cap 166 in the event of malfunction. An o-ring/groove type gas seal 180 may be placed between the breech cap 166 and the wall of the breech to provide further sealing.

As shown in FIG. 39, a valve slider 182 with a first end adjacent the forward end of the housing, and a second end adjacent the rearward end of the housing, is slidable within the valve passage 122 from a first position adjacent the forward end of the housing, to a second position adjacent the rearward end of the housing. The valve slider may be partially hollow adjacent its first end and adapted for receiving a valve spring 196.

Figure 45:
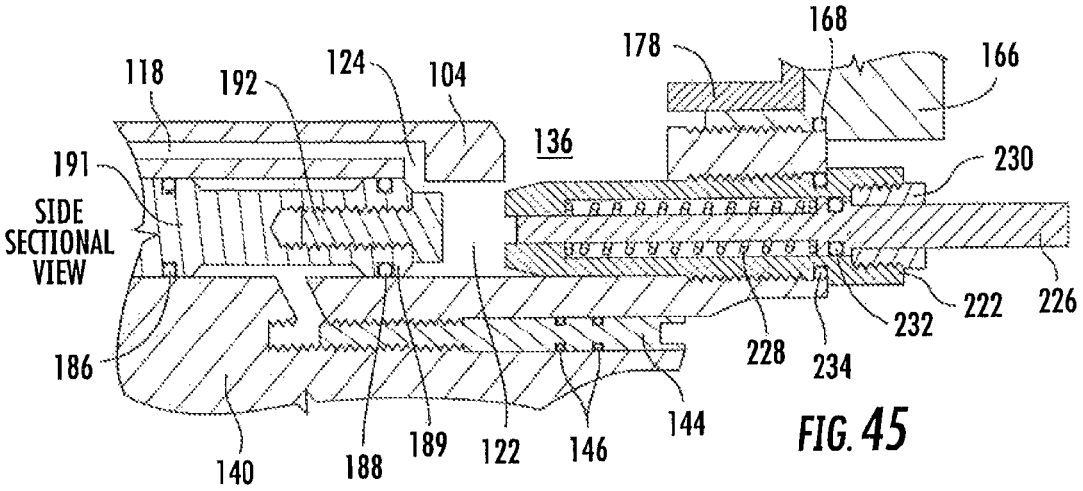
FIG. 45 is a sectional view from the side of the rear portion of the valve passage of a compressed gas-powered projectile accelerator identified in FIG. 39 made with improvements of the present invention, shown to advantage.

The valve slider may be formed having a first enlarged portion 189 adjacent the second end of the of the valve slider 182, and a second enlarged portion 191, forward of the first enlarged portion 189, as shown in detail in FIG. 45. In a preferred embodiment, the valve slider 182 forms or includes seals 186, 188, 190 with the valve passage 122 at a plurality of points. For example, in the Figures, three points are shown for illustration where single o-ring/groove type seals 186, 188, 190 provide sealing, but multiple o-rings or any other appropriate method of sealing may be used, for example, use of a flexible material such as polytetrafluoroethylene at the sealing points may be used to form surface-to-surface seals in lieu of o-rings, and can potentially reduce wear on the seals 186, 188, 190. An optional bumper 192 to minimize wear is shown threaded into a hole in the rear face of the valve slider 182 in FIG. 39, and a bumper 194, optionally an o-ring, is shown at a step in the valve slider 182 diameter to minimize wear and reduce noise due to interaction with the housing 104.

A valve spring 196 located adjacent the first end of the valve passage 122 and, preferably, partially within the valve slider 182. The valve spring is positioned between the valve slider 182 and a valve spring guide 198. The valve spring 196 biases the valve slider 182 toward its second position. The valve spring guide 198 may be held in place by a velocity adjustment screw 200 preferably threaded into the valve passage 122. The position of the screw may be adjusted to increase or decrease tension in the valve spring 196, thereby adjusting the operating pressure of the cycle and magnitude of projectile acceleration. The valve slider 182 may be held in its first position by a sear 184, which can rotate about and slide on a pivot 202. A sear spring 204 maintains a bias for the sear 184 to slide forward and rotate toward the valve slider 182. Sliding movement of the sear 184 can be limited by means of a preferably cylindrical mode selector cam 206 which can slide along an axis parallel to the rotational axes of the sear 184 as previously described.

A trigger 208, which rotates on a pivot 210, is adapted to press upon the sear 184, inducing rotation of the sear 184. A bias of the trigger 208 to rotate toward the sear 184 (clockwise in FIG. 39) is maintained by a spring 212. Forward travel of the trigger 208 may optionally be limited by an adjustable forward trigger adjustment screw 214, shown threaded into the trigger guard 152. Rearward travel of the trigger is optionally adjustably limited by an optional rear trigger adjustment screw 216, shown threaded into the housing 104. It is to be appreciated that a number of means may be employed to adjust the trigger 208 movement for the compressed gas-powered projectile accelerator of the present invention without altering the inventive concepts and principles embodied therein. Rotation of the trigger 208 can also be limited by means of a preferably cylindrical sliding safety cam 218 as previously described.

Figure 46:
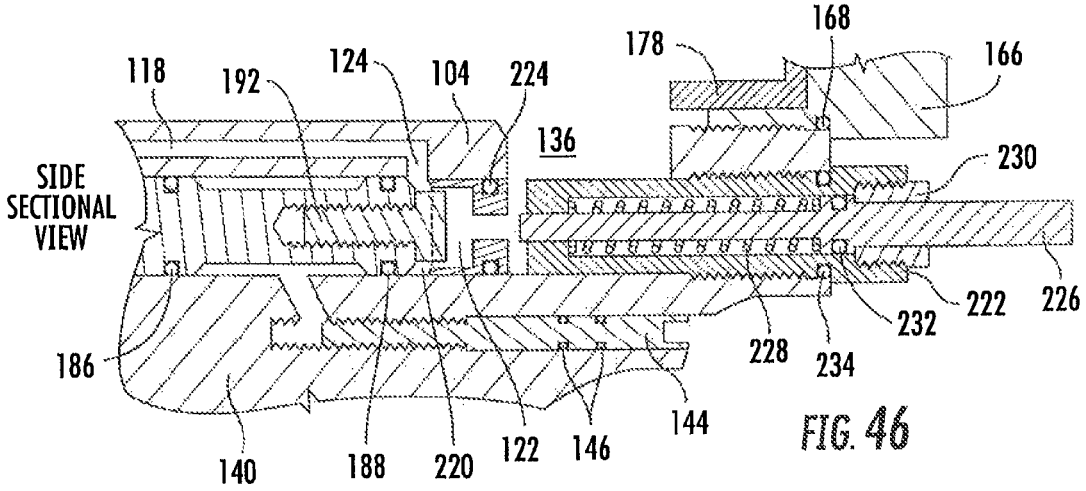
FIG. 46 is a sectional view from the side of the rear portion of the valve passage of a compressed gas-powered projectile accelerator made with improvements of the present invention, showing an annular enlargement of the valve passage at the lower feed passage intersection to advantage.
Figure 47:
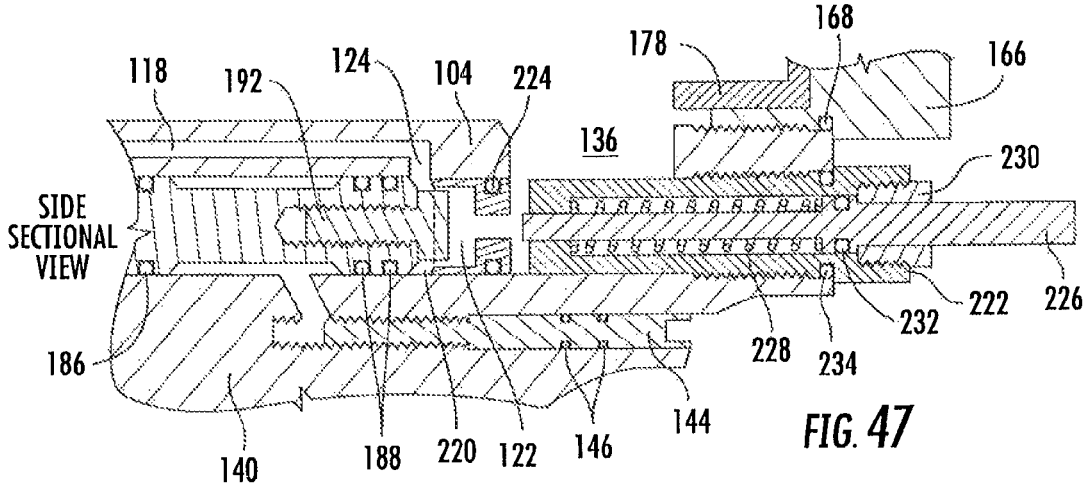
FIG. 47 is a sectional view from the side of the rear portion of the valve passage of a compressed gas-powered projectile accelerator made with improvements of the present invention, showing an annular enlargement of the valve passage at the lower feed passage intersection and dual o-ring seal to advantage.

It will be appreciated by one skilled in the art that the sliding of an o-ring/groove type rear valve slider seal 188, shown in detail in FIG. 45, past the intersection of the valve passage 122 with the lower gas feed passage 124 will cause wear on the seal 188, which may intermittently need replacement. One alternate configuration of the intersection between the valve passage 122 and lower gas feed passage 124 that is designed to reduce such wear is shown in FIG. 46. In this embodiment, the lower gas feed passage 124 intersects an enlarged portion 220 formed between a step in the valve passage 122 where the diameter of the valve passage changes, and an extension of the cocking assembly housing 222 (described below), is sealed to the wall of the valve passage 122 upstream of the bolt rest-point slot 136 by a preferably o-ring/groove type seal 224. This forces the rear valve slider seal 188 to release pressure from all parts of its perimeter simultaneously, thereby avoiding asymmetric extrusion of the valve slider seal 188 into the lower gas feed passage 124. Another configuration is shown in FIG. 47, where the rear valve seal 188 is comprised of a pair of o-rings, positioned such that the seal between the valve slider 182 and valve passage wall is made by a different o-ring on each side of the enlargement 220 of the valve passage 122. The o-ring is positioned such that exactly one is always in contact with the wall of the valve passage 122 on one side of the enlargement 220 of the valve passage 122 or the other, thereby minimizing the wear on each and eliminating the brief gas flow around the rear valve slider seal 188 that occurs when the seal 188 moves across the lower gas feed passage 124 or enlargement 220 of the valve passage 122, if present. In FIG. 46 and FIG. 47, the enlargement 220 of the valve passage 122 is shown formed by a gap between a step in the valve passage 122 bore and the discreet cocking assembly housing 222 (described below). However, it should be appreciated that the enlargement 220 could be formed between a step in the valve passage 122 bore and an alternate part, such as a plug, replacing the discreet cocking assembly housing 222, or as a feature in the valve passage 122 not involving a separate piece.

Discreet Cocking Module:

As described above, the compressed gas-powered projectile accelerator of the present invention will automatically cock when it is in an uncocked position when gas is supplied from a source of compressed gas to the source gas passage 140. It is also desirable to provide some means of manual cocking. This can be accomplished by the addition of a discrete assembly, shown in FIG. 39, comprised of a preferably cylindrical hollow body 224 containing a preferably cylindrical plunger 226 partially surrounded and biased to move rearwardly by a cocking spring 228. When not in use, the plunger 226 rests against and is contained within the cocking assembly housing 222 by interference with a hollow plug 230. The hollow plug 230 is preferably threaded into the rear of the cocking assembly housing 222. The hollow plug 230 has an inner diameter smaller than the largest section of the cocking plunger 226, and may be penetrated by a section of the plunger 226 which can slide within the hollow plug 230. The plunger 226 preferably forms a substantial seal with the body to minimized gas leakage. One suitable sealing mechanism is through use of an o-ring/groove type seal 232 located on the largest diameter section of the plunger 226. It is also preferable that an o-ring/groove type seal 234 be incorporated into the cocking assembly housing 222 to form a seal with the housing 104. Cocking is accomplished by depression of the portion of the cocking plunger 226 extending outward from the hollow plug 230. The force of the depression overcomes the biasing provided by the spring 244, thereby permitting the plunger 226 to push the valve slider 182 forward a sufficient distance to permit the sear 184 to engage the step in the valve slider 182 under the bias provided by the sear spring 246. When pressure is removed from the cocking plunger 226, the cocking spring 244 will bias the plunger 226 to its rearmost position, resting against the hollow plug 230, where it will not interfere with motion of the valve slider 182 during operation.

Semi-Automatic Operation of the Compressed Gas-Powered Projectile Accelerator:

The preferred ready-to-operate configuration for semi-automatic operation is shown in FIG. 39, with the valve slider 182 in its first or cocked position, resting against the sear 184, which, under the pressure of the valve spring 196 translated through the valve slider 182, rests in its rearmost position. For operation, the safety cam 218 is positioned to allow the trigger 208 to rotate freely. The mode selector cam 206 is positioned so as to not restrict the forward movement of the sear 184. The smaller diameters of the safety cam 218 and mode selector cam 206 are shown in this cross section, as said smaller diameters represent the portions of these components 218, 206 interacting with the trigger 208 and sear 184, respectively. A projectile 116 is prevented from entering the barrel 108 by interference with the bolt 154.

The trigger 208 is then pulled rearward, pulling the sear 184 downward, disengaging it from the valve slider 182. The valve slider 182 may then be biased rearwardly to its second position by the valve spring 196.

Under the force applied by the valve spring 196, the valve slider 182 then slides rearwardly to its second position. It may be stopped by contact of its rear bumper with the cocking assembly housing 222. When the valve slider 182 reaches its second position, it allows gas to enter the gas distribution passage 118 through the lower gas feed passage, flow through the gas distribution passage, and into the region of the breech 106 ahead of the bolt rear seal 172. Compressed gas will necessarily also flow into the region of the valve passage 122 forward of the second enlarged portion 191 of the valve slider 182 adding pressure force to hold the valve slider 182 rearward in addition to the valve spring 196 bias. Simultaneously, the sear 184 is caused to slide forward and rotate (shown clockwise in the drawing) by the sear spring 246, coming to rest against the valve slider 182 and, thus, disengaged from the trigger 208.

The pressure of the gas against the bolt rear seal 172 causes the bolt 154 to slide rearward, until the bolt rear seal 172 passes the front edge of the bolt rest-point slot 136, and reaches a preselected position, opening a flow path, and allowing compressed gas to pass into the bolt rest-point slot 136, the valve passage 122 rearward of the valve slider 182, and the region of the breech 106 behind the bolt 154. A projectile 116 may then enter the barrel 108, aided by gravity or some other force, and may be further aided by the suction induced by the motion of the bolt 154 rearward. Additional projectiles 116 in the projectile feed passage 112 are blocked from entering the barrel 108 by the projectile 116 already in the barrel 108. The combined force of the bolt spring 162 and the pressure behind the bolt 154 bring the bolt 154 to rest, preferably without contacting the breech cap bumper 248 at the rear of the breech 106. The bolt 154 will remain approximately at rest, where its position will only adjust slightly to allow more or less gas through the bolt rest-point slot 136 as required to maintain a balance of pressure and spring forces on it while the pressure continues to increase.

Once the pressure in the valve passage 122 rearward of the valve slider 182 has increased sufficiently to overcome the force of the valve spring 196 on the valve slider 182, the valve slider 182 will be pushed forward until the front valve slider bumper 250 contacts the step due to the change in diameter of the valve passage 122, thereby stopping the flow of compressed gas from the source gas passage 140, and allowing the flow of gas from the region of the breech 106 forward of the bolt rear seal 172 and the region of the valve passage 122 forward of the enlarged portion of the valve slider 182 into the valve passage 122 rearward of the valve slider 182, which is in communication with the region of the breech 106 rear of the bolt 154. The sear 184, under the action of the sear spring 246, will rotate further (clockwise in the drawing) once the smaller diameter section of the valve slider 182 has traveled sufficiently far forward to allow this, coming to rest against the smaller diameter section of the valve slider 182.

The bolt 154 is then driven forward by now unbalanced pressure and spring forces on its rear surface, pushing the bolt 154 and projectile 116 forward in the barrel 108 and blocking the projectile feed passage 112, preventing the entry of additional projectiles 116. When the bolt 154 has moved sufficiently far forward that the spring guide seal 174 enters the increased diameter hollow portion at the rear of the bolt 154, disengaging the spring guide seal 174 from the bolt 154 internal bore, gas flows through the purge holes 158 in the spring guide 156 and through the aperture of the bolt 154, to the rear surface of the projectile 116.

The action of the gas pressure on the projectile 116 will cause it to accelerate through and out of the barrel 108 and optional barrel extension 110, at which time the barrel 108, barrel extension 110, breech 106, valve passage 122 rearward of the valve slider 182, and all communicating passages which are not sealed will vent to atmosphere.

When the pressure within the valve passage 122 rearward of the valve slider 182 has been reduced to sufficiently low pressure such that the force induced on the valve slider 182 no longer exceeds that of the valve spring 196, the valve slider 182 will slide rearward until its 40 motion is restricted by the sear 184. The sear 184 will rest against the front of the trigger 208, and may exert a (clockwise in drawing) torque helping to restore the trigger 208 to its 53 resting position, depending on the design of the position of the trigger pivot 210 relative to the point of contact with the valve slider 182.

Under the action of the bolt spring 162, the bolt 154 will continue to move forward, compressing gas within the space ahead of the bolt rear seal 172 in so doing, and, since there is only a small gap by which the gas may escape into the upper gas feed passage 120, the bolt 154 will be decelerated, minimizing wear on the bolt bumper 160 and stopping in its preferred resting position.

When the trigger 208 is released, the action of the trigger spring 212, sear spring 204, and valve spring 196 will return the components to the preferred ready-to-fire configuration, as in Step 1 above.

Fully-Automatic Operation of the Compressed Gas-Powered Projectile Accelerator:

The preferred ready-to-operate configuration for fully-automatic operation is the same as described above for semi-automatic operation except that the mode selector cam 206 is positioned so as to restrict the forward travel of the sear 184, i.e. with the largest diameter section of the mode selector cam 206 interacting with the sear 184.

The trigger 208 is then pulled rearward, pulling the sear 184 downward, disengaging it from the valve slider 182.

Under the force applied by the valve spring 196, the valve slider 182 then slides rearward, until it is stopped by contact of its rear bumper with the cocking assembly housing 222, allowing gas to flow into the region of the breech 106 ahead of the bolt rear seal 172 and into the region of the valve passage 122 ahead of the enlarged portion of the valve slider 182 (adding pressure force to hold the valve slider 182 rearward in addition to the valve spring 196 bias). The mode selector cam 206 prevents the sear 184 from sliding forward sufficiently far to disengage from the trigger 208.

The pressure of the gas causes the bolt 154 to slide rearward, until the bolt rear seal 172 passes the front edge of the bolt rest-point slot 136, allowing gas into the bolt rest-point slot 136, valve passage 122 rearward of the valve slider 182, rear passage, and region of the breech 106 behind the bolt 154. The projectile 116 enters the barrel 108 either by gravity, a positive bias or a negative pressure, such as the suction induced by the motion of the bolt 154. Additional projectiles 116 in the projectile feed passage 112 are blocked from entering the barrel 108 by the projectile 116 already in the barrel 108. The combined force of the bolt spring 162 and the pressure behind the bolt 154 bring the bolt 154 to rest, preferably without contacting the breech cap bumper 248 at the rear of the breech 106. The bolt 154 will remain approximately at rest, where its position will only adjust slightly to allow more or less gas through the bolt rest-point slot 136 as required to maintain a balance of pressure and spring forces on it while the pressure continues to increase.

Once the pressure in the valve passage 122 rearward of the valve slider 182 has increased sufficiently to overcome the force of the valve spring 196 on the valve slider 182, the valve slider 182 will be pushed forward until the front valve slider bumper 250 contacts the step in the valve passage 122, thereby simultaneously stopping the flow of compressed gas from the source gas passage 140, and allowing the flow of gas from the region of the breech 106 ahead of the bolt rear seal 172 and the region of the valve passage 122 ahead of the enlarged portion of the valve slider 182 into the valve passage 122 rearward of the valve slider 182, which is in communication with the region of the breech 106 behind the bolt 154.

The bolt 154 is then driven forward by the now unbalanced pressure and spring forces acting on it, pushing the projectile 116 forward in the barrel 108 and blocking the projectile feed passage 112, preventing the entry of additional projectiles 116. When the bolt 154 has moved sufficiently far forward that the spring guide seal 36 enters the increased diameter hollow portion at the rear of the bolt 154, disengaging the spring guide seal 36 from the bolt 154 internal bore, gas flows through the purge holes 158 in the spring guide 156 and through the center of the bolt 154, into communication with the rear surface of the projectile 116.

The action of the gas pressure on the projectile 116 will cause it to accelerate through and out of the barrel 108 and barrel extension 4, at which time the barrel 108, barrel extension 4, breech 106, valve passage 122 rearward of the valve slider 182, and all communicating passages which are not sealed will vent to atmosphere.

When the pressure within the valve passage 122 rearward of the valve slider 182 has been reduced to sufficiently low pressure such that the force induced on the valve slider 182 no longer exceeds that of the valve spring 196, the valve slider 182 will begin to slide rearward again. If the trigger 208 has not been allowed by the operator to move sufficiently far forward to cause the sear 184 to interfere with the rearward motion of the valve slider 182, the valve slider 182 will continue to move rearward as described above, and the cycle will begin to repeat. If the trigger 208 has been allowed by the operator to move sufficiently far forward to allow the sear 184 to interfere with the rearward motion of the valve slider 182, the valve slider 182 will push the sear 184 rearward into the preferred resting position and will come to rest against the sear 184.

Under the action of the bolt spring 162, the bolt 154 will continue to move forward, compressing gas within the space ahead of the bolt rear seal 172 in so doing, and, since there is only a small gap by which the gas may escape into the upper gas feed passage 120, the bolt 154 will be decelerated, minimizing wear on the bolt bumper 160 and stopping in its preferred resting position, at which point all components will now be in their original ready-to-fire configuration.

Figure 48:
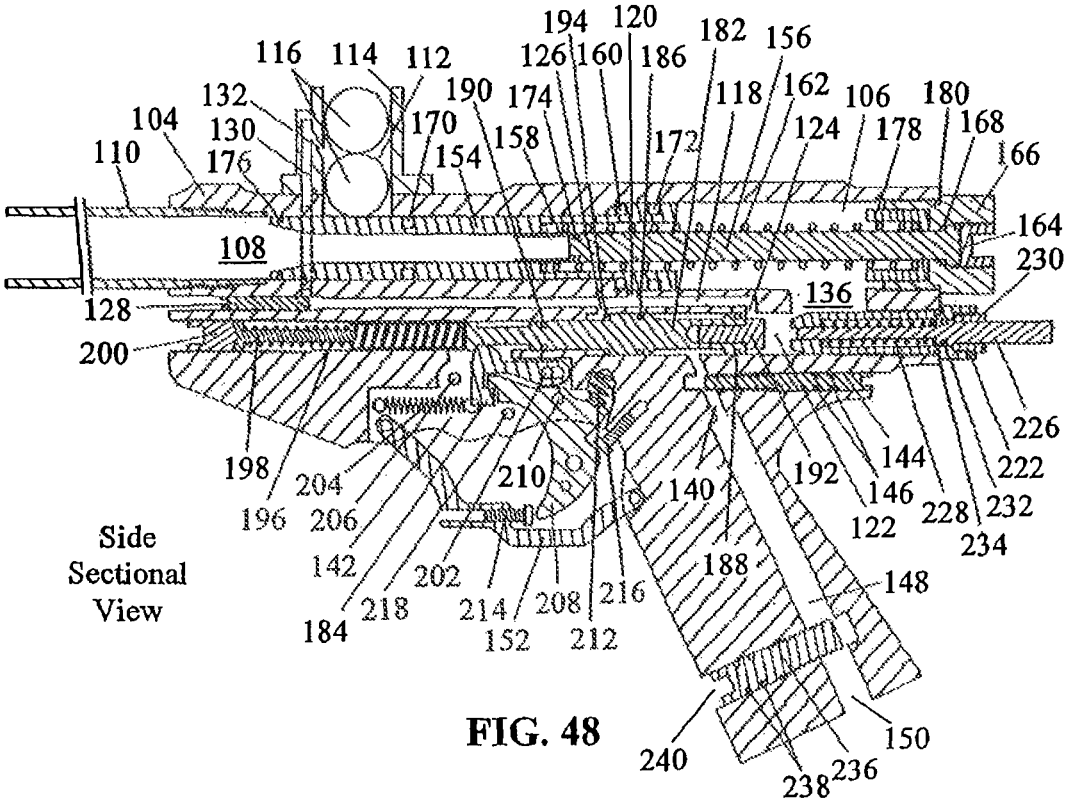
FIG. 48 is a sectional view from the side of a compressed gas-powered projectile accelerator made with improvements of the present invention with the addition of a second throttling screw in the source gas passage.

Pre-Chamber to Independently Adjust First Cycle Rate from Subsequent Cycles:

A second throttling point upstream expanded section of the source gas passage 148, can be formed by the addition of a throttling screw 236 with one or more preferably o-ring/groove type seals 238 about its diameter, threaded into a shaft 240 intersecting the source gas passage expanded section 148, such that the degree of occlusion of the source gas passage expanded section 148 is adjustable by the depth to which the throttling screw 236 has been threaded, as shown in FIG. 48. By adjusting the upstream throttling screw 236 to be more restrictive to the flow through the source gas passage expanded section 148 than the downstream screw 144, after the trigger 208 is pulled, gas flow past the downstream throttling screw 144 can be made to initially exceed that at the upstream throttling screw 236, but will gradually decrease to the same amount as the pressure within the portion of the source gas passage 140, 148 between the throttling screws 150, 236 drops, at which point the flow will remain at a steady rate determined by the most restrictive of the two throttling 150, 236 (set to be the upstream throttling screw 236 as before stated). Because this will cause the chambers ahead of and behind the enlarged diameter portion of the bolt 154 to fill more quickly at first, and then gradually more slowly, the cycle rate will be most rapid on the first cycle, and then will slow on subsequent cycles, the number of cycles required to achieve a steady cycle rate, being determined by the volume and set positions of the throttling 150, 236.

A preferred embodiment can be designed with the volume of the portion of the source gas passage 140, 148 between the throttling 150, 236 sized such that the downstream throttling screw 144 can be adjusted so that steady flow rate is established during the first cycle for a desired range of initial cycle times, thus allowing the position of the downstream throttling screw 144 to primarily adjust the time of the first cycle with all subsequent cycle times determined primarily by the position of the upstream screw 236. Alternatively, similar slowing of the cycle rate can be accomplished with the downstream throttling screw 144 adjusted to be equally or more restrictive than the upstream throttling screw 236; however, in such cases, the initial and ultimately achieved steady flow rates will be dependent on the positions of both throttling 150, 236, rather than the initial flow rate being primarily dependent upon the position of the downstream throttling screw 144 and the steady flow rate being primarily dependent upon the position of the upstream throttling screw 236.

Figure 49:
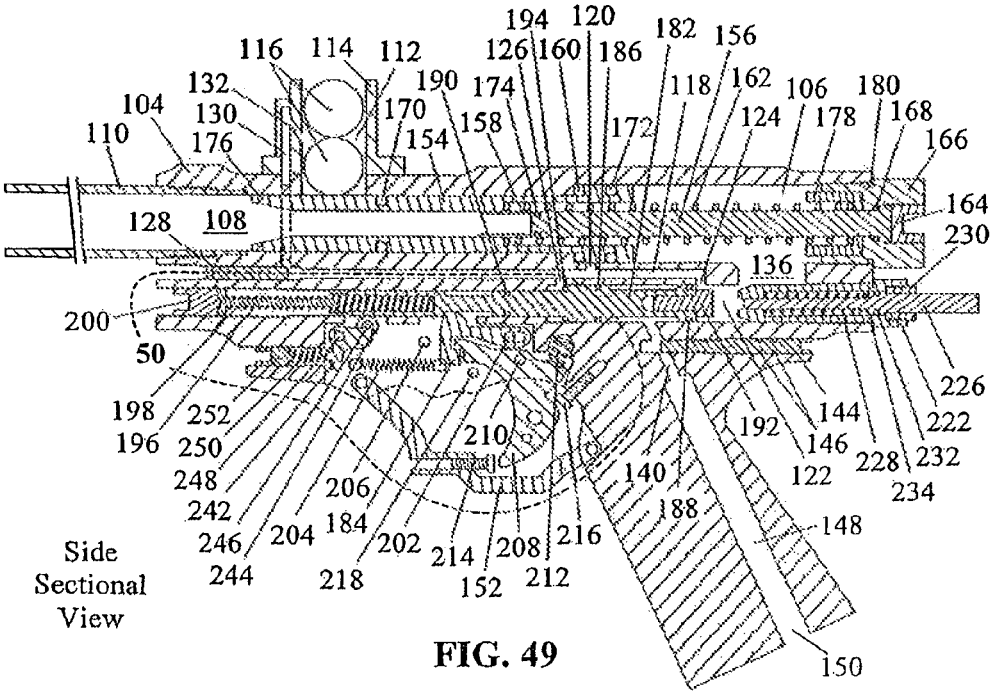
FIG. 49 is a sectional view from the side of a compressed gas-powered projectile accelerator made with improvements of the present invention, prior to operation, showing a valve locking cam in the non-locking position.
Figure 50:
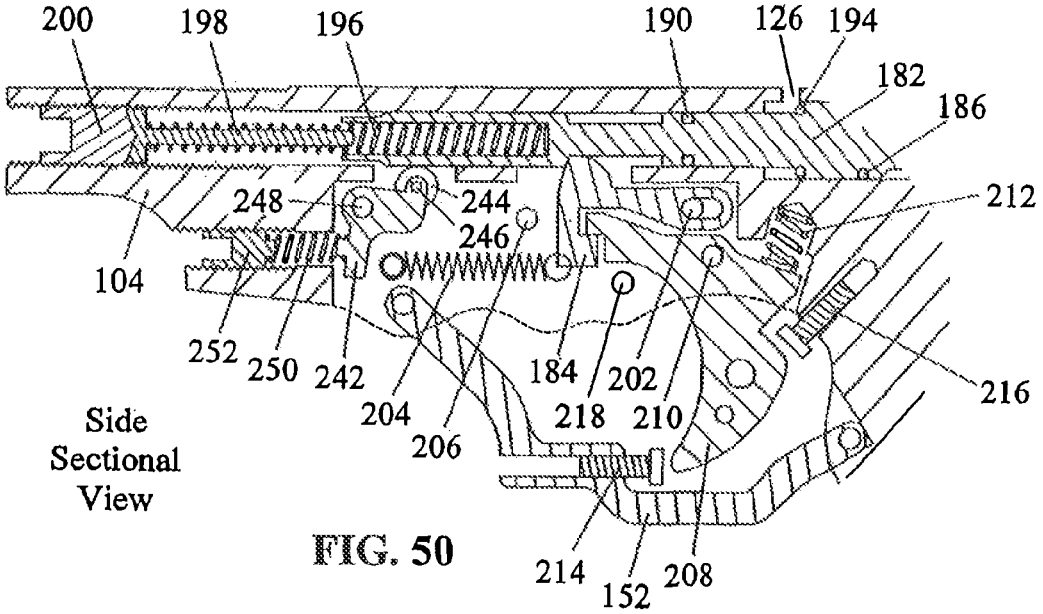
FIG. 50 is a sectional view from the side of the front portion of a compressed gas-powered projectile accelerator identified in FIG. 49 made with improvements of the present invention, prior to operation, showing a valve locking cam in the non-locking position, shown to advantage.
Figure 51:
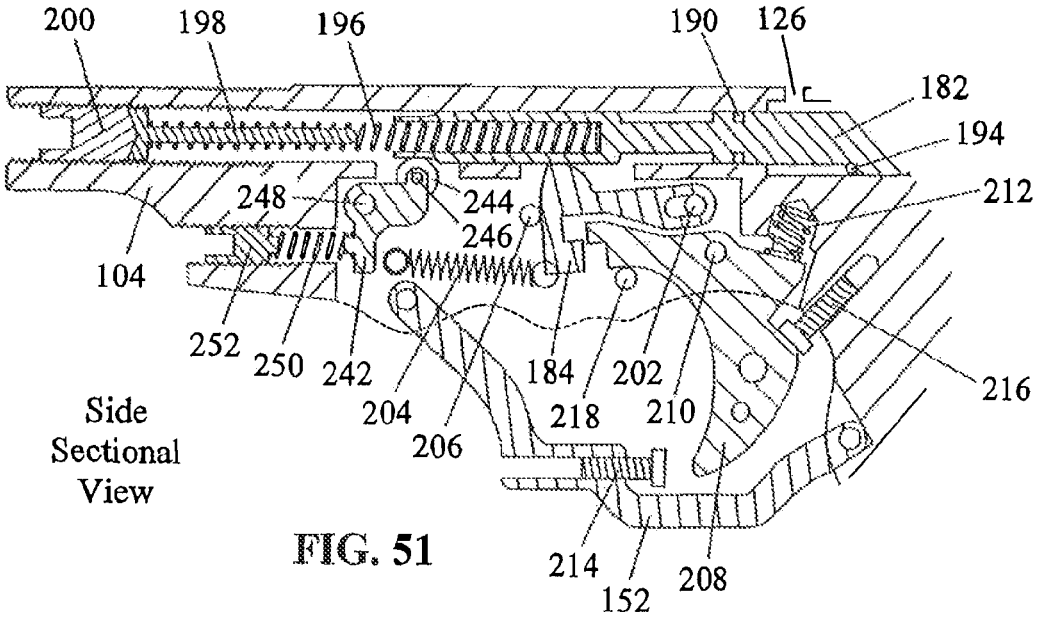
FIG. 51 is a sectional view from the side of the front portion of a compressed gas-powered projectile accelerator made with improvements of the present invention, during operation, showing a valve locking cam in a locking position, shown to advantage.

Mechanical Valve Locking:

A roller cam assembly, comprised of a rocker 242, preferably holding a wheel 244 and pin assembly 246 (but it is to be appreciated that the replacement of the wheel 244 and pin 246 with a geometrically similar protrusion of the rocker 242 will not alter the inventive concepts and principles embodied herein), biased to rotate about a pivot 248 toward the valve slider 182 by a roller cam spring 250, there engaging a detent in the valve slider 182 when in the rearmost position can be optionally included to mechanically increase the force required to push the valve slider 182 forward, as illustrated in FIG. 49 and shown in detail in FIG. 50 and FIG. 51. The roller cam assembly can be used in addition to, as shown, or in lieu of, the valve locking shaft 126 communicating gas ahead of the shoulder in the valve slider 182. During operation, for the valve slider 182 to begin to move forward, the gas must supply sufficient pressure force on the valve slider 182 not only to compress the valve spring 196, but to force the rocker to rotate against the roller cam spring 250 bias. Once the roller cam wheel 244 is fully disengaged from the detent in the valve slider 182, the pressure in the valve passage 122 will now exceed that necessary to continue the motion of the valve slider 182 toward and maintain the valve slider 182 in its foremost position, having to compress the roller cam spring 250 no further. The valve slider 182 will be maintained in its foremost position until the pressure in the valve passage 122 has dropped below that necessary for the valve spring 196 to again move the valve slider 182 rearward. The roller cam spring 250 pushes against, and is retained by a screw 252, which adjusts the tension in the roller cam spring 250 by the depth to which it is threaded into the housing 104. By changing the tension in the roller cam spring 250, the adjustment screw 252 can be used to adjust the amount of force required to push the valve slider 182 forward, thereby acting as an additional or substitute (to tensioning the valve spring 196) method of adjusting the set pressure of the compressed gas-powered projectile accelerator, thereby altering the projectile 116 velocity.

Figure 52:
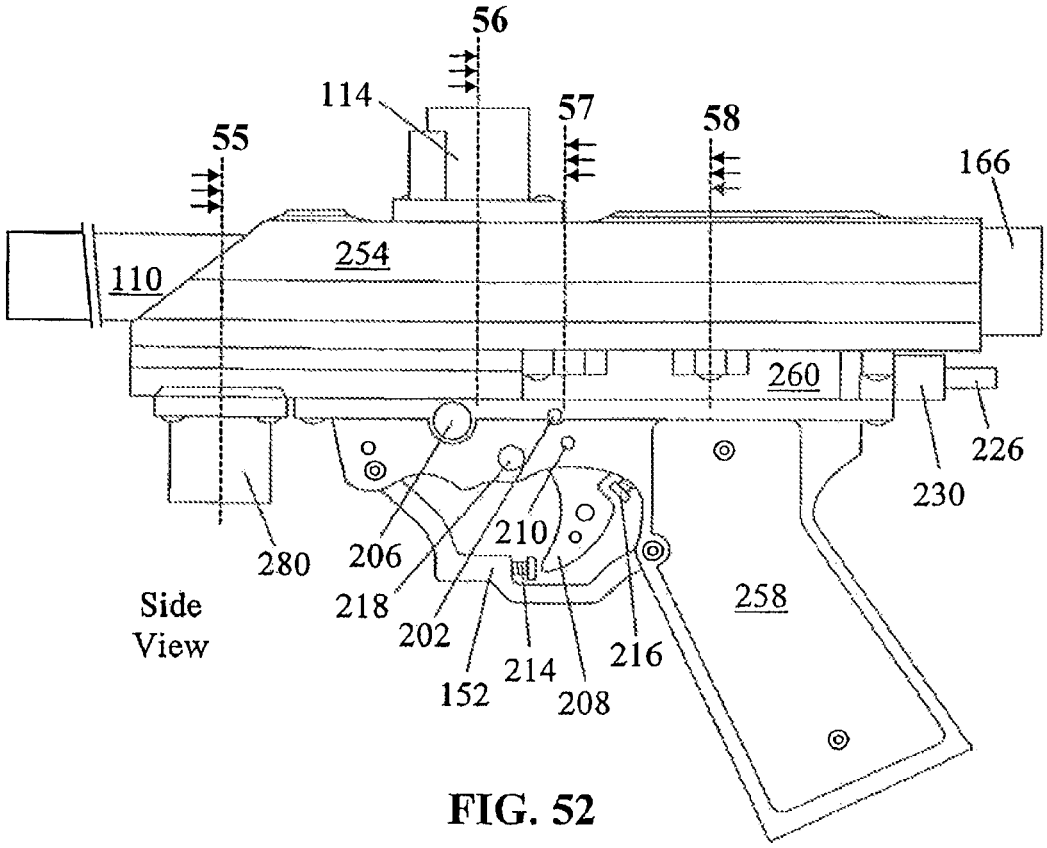
FIG. 52 is a view from the side of an alternate embodiment of a compressed gas-powered projectile accelerator made with improvements of the present invention.
Figure 53:
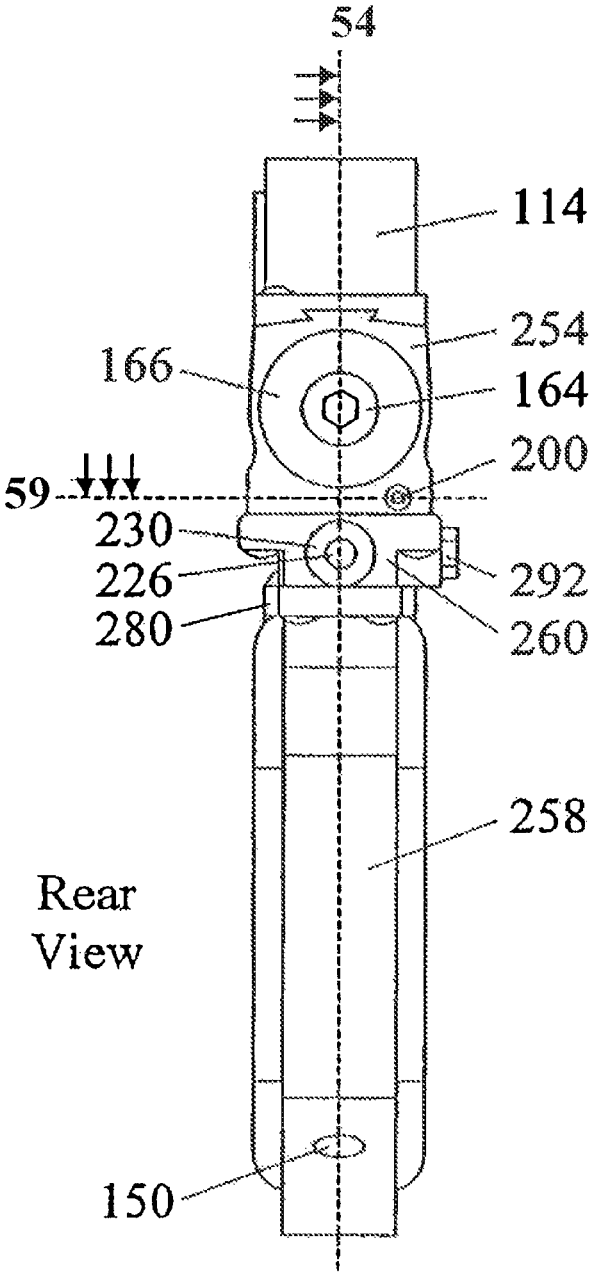
FIG. 53 is a view from the rear of an alternate embodiment of a compressed gas-powered projectile accelerator identified in FIG. 52 made with improvements of the present invention.
Figure 54:
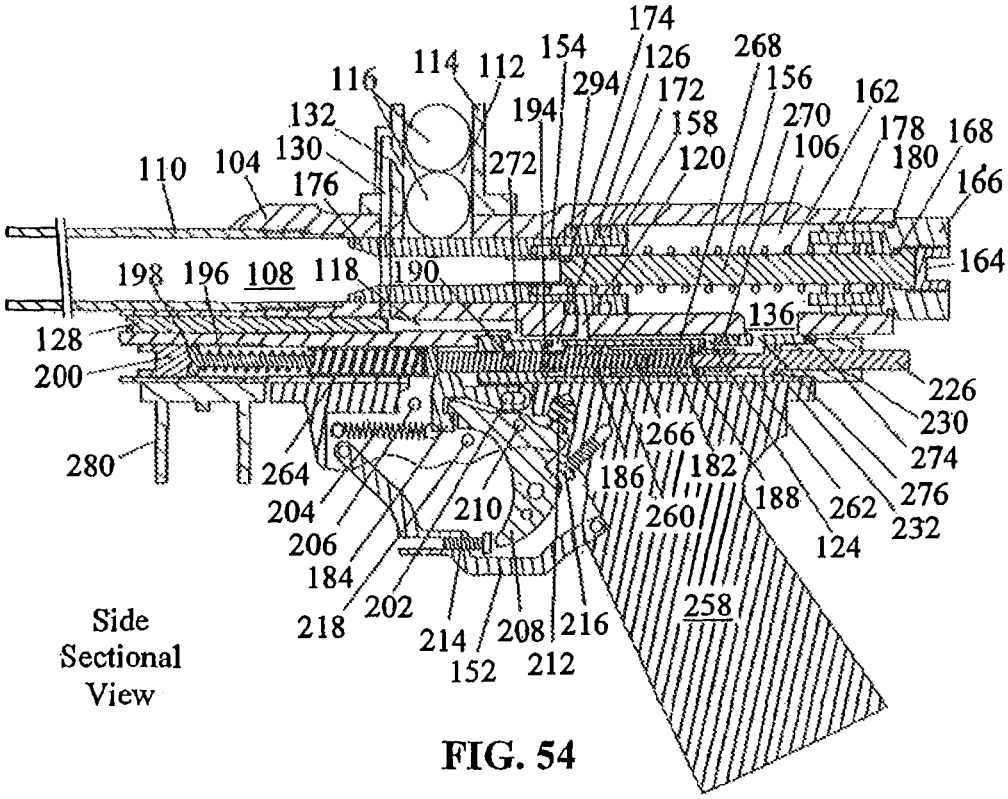
FIG. 54 is a sectional view from the side taken along line 54 of FIG. 53 of an alternate embodiment of a compressed gas-powered projectile accelerator made with improvements of the present invention.
Figure 55:
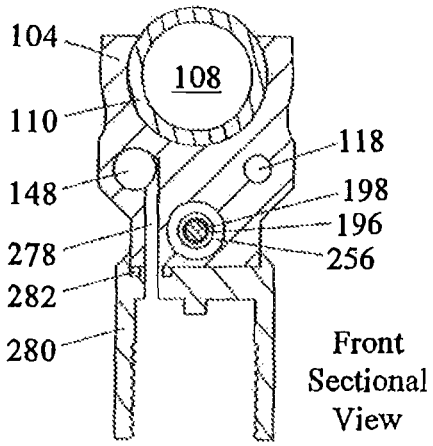
FIG. 55 is a sectional view from the front taken along line 55 of FIG. 52 of an alternate embodiment of a compressed gas-powered projectile accelerator made with improvements of the present invention in the vicinity of the intersection of the vertical source gas shaft, shown to advantage.
Figure 56:
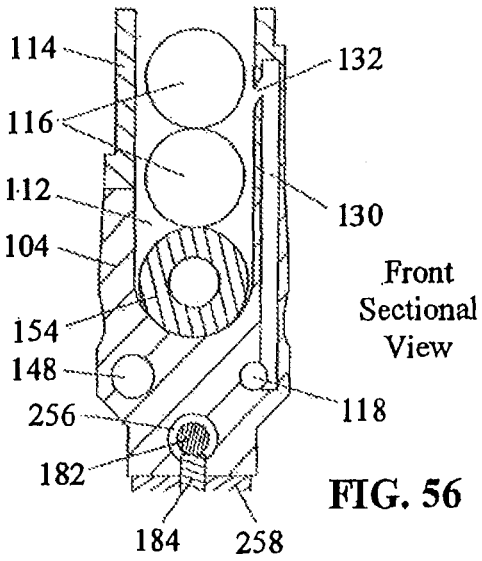
FIG. 56 is a sectional view from the front taken along line 56 of FIG. 52 of an alternate embodiment of a compressed gas-powered projectile accelerator made with improvements of the present invention in the vicinity of the intersection of the feed-assist shaft and gas distribution passage, shown to advantage.
Figure 57:
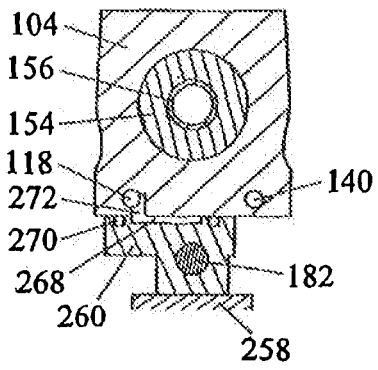
FIG. 57 is a sectional view from the rear taken along line 57 of FIG. 52 of an alternate embodiment of a compressed gas-powered projectile accelerator made with improvements of the present invention in the vicinity of the vertical shaft connecting the valve module slot and gas distribution passage, shown to advantage.
Figure 58:
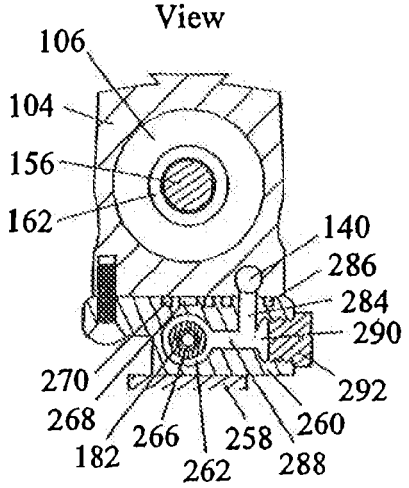
FIG. 58 is a sectional view from the rear taken along line 58 of FIG. 52 of an alternate embodiment of a compressed gas-powered projectile accelerator made with improvements of the present invention in the vicinity of the rear source gas shaft, shown to advantage.
Figure 59:
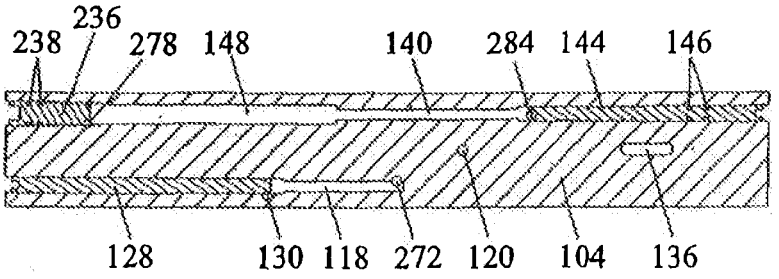
FIG. 59 is a sectional view from the top of an alternate embodiment of a compressed gas-powered projectile accelerator made with improvements of the present invention in the vicinity of a source gas passage incorporated into the upper housing.
Figure 60:
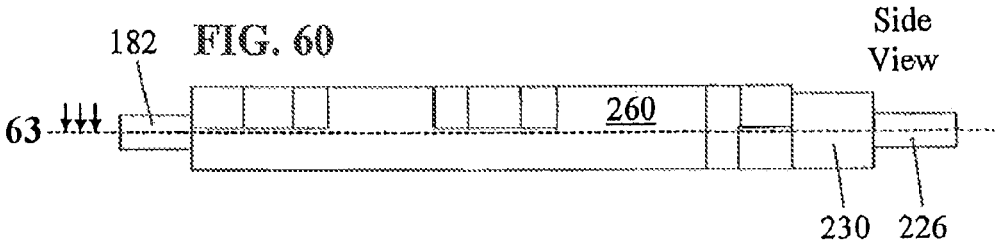
FIG. 60 is a view from the side of a valve module made according to the present invention, shown to advantage.
Figure 61:
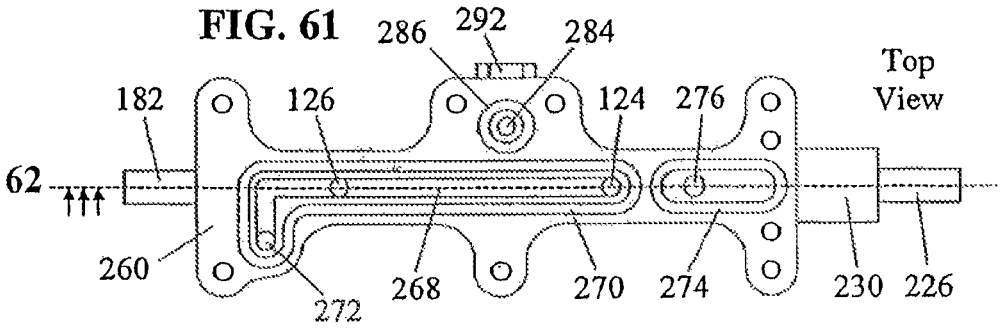
FIG. 61 is a view from the top of a valve module made according to the present invention, shown to advantage.
Figure 62:
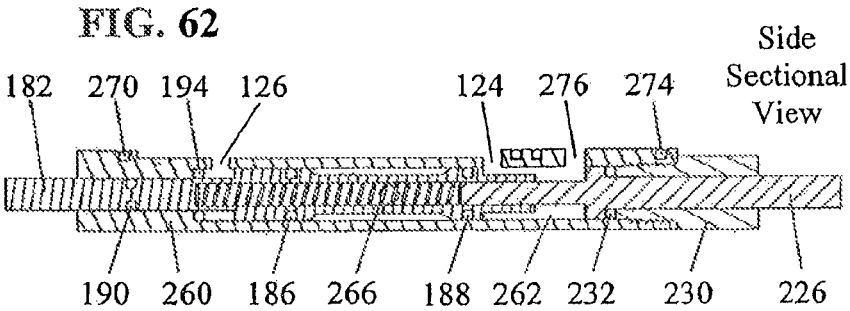
FIG. 62 is a sectional view from the side taken along line 62 of FIG. 61 of a valve module made according to the present invention shown to advantage.
Figure 63:
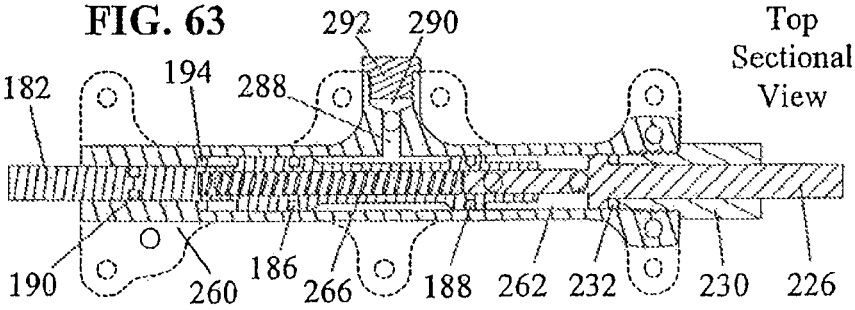
FIG. 63 is a sectional view from the top taken along line 63 of FIG. 60 of a valve module made according to the present invention, shown to advantage.

Valve Module with Integrated Cocking Button:

An alternate embodiment of the compressed gas-powered projectile accelerator is shown in FIGS. 52-23, comprised as before, but where the single piece housing 104 is replaced by three components comprised of an upper housing 254, containing the barrel 108, breech 106, gas distribution passage 118 (again shown centered in the same plane as the barrel 108, breech 106, and valve passage 122 but preferably positioned away from the centerline of the upper housing 254 to facilitate a more compact arrangement and simple intersection with the feed-assist jet 132, and also again optionally not depicted extending to the rear of the upper housing 254), and front half of the valve passage 122 as designated in the previous embodiment, hereafter denoted as the valve spring passage 256; a handle 258, containing the trigger components and to which is connected the trigger guard 152; and a valve module housing 260. The valve slider 182 is truncated to move primarily within a rear valve passage (corresponding to the rear half of the valve passage 122 in the previously described embodiment) within the valve module housing 260, but with an extension into the valve spring passage 256 in contact with a separate hollow spring cup 264 sliding within the valve spring passage 256, replacing the front portion of the valve slider 182 in the previous embodiment.

The truncated valve slider 182 is biased to move forward under the action of a valve slider/cocking plunger return spring 266 located within a cavity inside the truncated valve slider 182 and retained in position by the cocking plunger 226 sliding within the cavity within the valve slider 182, the rear valve passage 262, and the hollow retaining plug 230. The valve slider/cocking plunger return spring 266, which is less stiff than the valve spring 196, serves only to maintain continuous contact between the valve slider 182 and valve spring cup 264, and maintain a bias for the cocking plunger 226 to move rearward, supplanting the similar cocking spring 244 in the previous embodiment (which did not act on the valve slider 182). As in the previously described embodiment, the truncated valve slider 182 forms preferably o-ring/groove type seals at three places with the walls of rear valve passage 262 and it is to be appreciated that the previously described alternate configurations of the valve slider 182 and valve passage 122 shown in FIG. 46 and FIG. 47 can be equally applied to the valve slider 182 and rear valve passage 262 within the valve module housing 260 without altering the inventive concepts and principles embodied therein.

Cocking is accomplished by depression of the portion of the cocking plunger 226 protruding through the hollow retaining plug 230, firstly causing it to slide forward into contact with the truncated valve slider 182 and subsequently pushing the truncated valve slider 182 and valve spring cup 264 forward with continued depression until the valve spring cup 264 has traveled sufficiently far to allow the sear 184, acting under the bias of the sear spring 246, to rotate clockwise into contact with the valve slider 182, thereby preventing rearward return of the valve spring cup 264 when the cocking plunger 226 is allowed to return to its resting position under the bias of the valve slider/cocking plunger return spring 266 by engaging the rear face of the valve spring cup 264. The valve slider/cocking plunger return spring 266 will also act to maintain the valve slider 182 in a forward position, resting against the valve spring cup 264.

Several views of the valve module are shown in detail in FIG. 60, FIG. 61, FIG. 62, and FIG. 63. The interconnectivity of the rear valve passage 262, gas distribution passage 118, and breech 106 is identical to the previously described embodiment, but is accomplished at the interface between the valve module housing 260 and the upper housing 254, rather than through test ports closed with plugs 134 from the side of the housing 104 as in the previously described embodiment. A slot 268 surrounded by a preferably o-ring/groove type seal 270 between the top face of the valve module housing 260 and the corresponding face of the upper housing 254 connects the upper gas feed passage 120, lower gas feed passage 124, valve locking shaft 126, and a vertical shaft 272 intersecting the gas distribution passage 118. A second preferably o-ring/groove type seal 274 surrounds the region of the valve module housing 260 upper face interfacing with the bolt rest-point slot 136 and a hole 276 providing connectivity to the region of the rear valve passage 262 behind the truncated valve slider 182.

While the source gas passage 140 may be incorporated into the handle 258, corresponding to its location in the housing 104 of previously described embodiment through a similar interface as between the valve module housing 260 and upper housing 254, an alternate scheme is illustrated in FIGS. 19-23, where the source gas passage 140 is incorporated into the upper housing 254, preferably parallel and opposite the gas distribution passage 118 with respect to the center plane (intersecting the barrel 108, breech 106, and valve spring passage 256 centerlines). As in the previous embodiment, the source gas passage 140 can include an expanded section 148 to minimize liquid entry and maximize consistency of entering gas by acting as a plenum. A vertical front source gas shaft 278 connects the source gas passage expanded section 148 to a preferably standard compressed gas bottle mount 280 via a preferably o-ring/groove type seal 282, and, near the front and rear of the upper housing 254, throttling 150, 236 with preferably o-ring/groove type seals 146, 238 control the flow area at the intersections of the source gas passage 140 (and/or the source gas passage expanded section 148) with the vertical front source shaft 272 and a vertical rear source gas shaft 284 extending from the horizontal source gas passage 140 in the upper housing 254 downward through a preferably o-ring/groove type seal between the upper housing 254 and the valve module housing 260 into the valve module housing 260, to intersect a laterally oriented source gas shaft 288 connecting to the rear valve passage 262, functioning similarly to the previously described embodiments. The lateral source gas shaft 288 extends to an access port 290 at the side of the valve module housing 260, primarily an artifact of manufacture and shown blocked by a plug 292 threaded into the access port, but optionally replaceable with a pressure gauge or connectable to an alternate gas source.

It is to be appreciated that the seals 270, 274, 286 between the upper housing 254 and valve module housing 260 can be replaced by an alternate sealing scheme such as a single gasket without altering the inventive concepts and principles embodied therein.

The embodiment shown in FIGS. 52-23 also employs a combined front bolt bumper (160 in the previous embodiment) and seal (170 in the previous embodiment), or bumper seal 294, preferably an o-ring, which, in providing a stationary front bolt seal (not moving with the bolt 154), allows a reduction in the length of the breech 106 and bolt 154 by the distance required for the sliding seal 170 of the previously described embodiment to maintain continuous contact with the breech 106 wall. When not operating, and therefore not under pressure, the bumper seal 96 contact with the bolt 154 and internal surfaces of the breech 106 is maintained by pressure from the bolt 154, biased to move forward by the bolt spring 162 30. When the chamber formed between the step in the breech 106 and bolt 154 diameters is pressurized during operation, unlike in the previously described embodiment where the front bolt bumper 160 moves with the bolt 154, the gas pressure will bias the bumper seal 96 to remain against the step in the breech 106 bore and the smaller bolt 154 outer diameter, thereby preventing gas from leaking around the bolt 154 toward the barrel 108 while the bolt 154 slides rearward, and therefore requiring no forward seal on the bolt 154. The optional small, preferably o-ring/groove type seal 176 shown near the front tip of the bolt 154 does not aid in sealing gas within the chamber formed between the step in the breech 106 and bolt 154 diameters, but functions to minimize gas leakage rearward around the bolt 154 when vented into the barrel 108 through the bolt 154 to accelerate the projectile 116. The front valve slider bumper and foremost valve slider seal 44 may similarly be replaced by a combined front valve slider bumper.

In addition to the valve spring cup 264, the valve spring passage 256 contains identical components (velocity adjustment screw 49, valve spring guide 198, valve spring 196) to the front half of the valve passage 122 in the previously described embodiment. Because the valve spring 196 and valve slider/cocking plunger return spring 296 maintain constant contact between the valve spring cup 264 and truncated valve slider 182, the valve spring cup 264 and truncated valve slider 182 move together, and act in the same fashion as the valve slider 182 of the previously described embodiment; thus function of the alternate embodiment illustrated in FIGS. is identical to that of the previously described embodiment for both semi-automatic and fully-automatic operation.

It is understood that the present invention is not limited to the particular embodiments shown and described herein, but that various changes and modifications may be made without departing from the scope and spirit of the invention.

What is claimed is:

1. A compressed gas gun, comprising:

a body comprising a valve passage and a bolt passage;

a bolt positioned within the bolt passage;

a valve positioned within the valve passage of the body and having at least one portion movable within the valve passage;

a first threaded member positioned within a first passage of the body, the first passage in communication with the valve passage, the first threaded member configured for engagement with an external adjustment member, wherein movement of the first threaded member by the external adjustment member is configured to assist in controlling a velocity of a projectile fired from the compressed gas gun; and a guide positioned axially within the bolt passage, wherein at least a portion of the bolt surrounds the guide; and a removable end cap engaged to a rearward end of the body, wherein release of the end cap allows removal of the bolt and guide through a rearward opening in the compressed gas gun body.

2. The compressed gas gun of claim 1, further comprising a control circuit in communication with a pressure sensor, wherein the control circuit assists in controlling a velocity at which a projectile is fired from the compressed gas gun under the force of a compressed gas in response to a signal received from the pressure sensor.

3. The compressed gas gun of claim 1, further comprising an externally accessible trigger adjustment mechanism configured to control a position of the trigger.

4. The compressed gas gun of claim 1, further comprising a spring positioned in the body and configured to assist in movement of the bolt.

5. The compressed gas gun of claim 1, further comprising a second threaded member positioned within a second threaded passage of the body, the second threaded passage in communication with the bolt passage, the second threaded member configured for engagement with an external adjustment member, wherein movement of the second threaded member by the external adjustment member changes an operation of the bolt.

6. The compressed gas gun of claim 5, wherein one of the first threaded members and the second threaded members comprises a movable portion that is movable parallel to the longitudinal axis of the compressed gas gun.

7. The compressed gas gun of claim 1, wherein the bolt guide further comprises a gas passage.

8. The compressed gas gun of claim 1, wherein the bolt is moveable from a rearward position in the body to a forward position in the body, and wherein, at the forward position, a gas flow passage is opened allowing compressed gas contained in the compressed gas gun body to fire a projectile from the compressed gas gun.

* * * * *